US011020299B2

(12) United States Patent
Gowda et al.

(10) Patent No.: US 11,020,299 B2
(45) Date of Patent: Jun. 1, 2021

(54) PATIENT SUPPORT APPARATUS AND METHOD

(71) Applicant: KAP Medical, Inc., Corona, CA (US)

(72) Inventors: Raj K. Gowda, Corona, CA (US); Dan F. Rosenmayer, Corona, CA (US)

(73) Assignee: KAP Medical, Inc., Corona, CA (US)

( * ) Notice: Subject to any disclaimer, the term of this patent is extended or adjusted under 35 U.S.C. 154(b) by 789 days.

(21) Appl. No.: 15/412,671

(22) Filed: Jan. 23, 2017

(65) Prior Publication Data

US 2017/0128298 A1 May 11, 2017

Related U.S. Application Data

(62) Division of application No. 14/051,893, filed on Oct. 11, 2013, now abandoned.

(60) Provisional application No. 61/713,856, filed on Oct. 15, 2012.

(51) Int. Cl.

| | |
|---|---|
| ***A61G 7/057*** | (2006.01) |
| ***A47C 27/08*** | (2006.01) |
| ***A47C 27/10*** | (2006.01) |

(52) U.S. Cl.

CPC ..... *A61G 7/05776* (2013.01); *A47C 27/082* (2013.01); *A47C 27/083* (2013.01); *A47C 27/088* (2013.01); *A47C 27/10* (2013.01); *A61G 7/05769* (2013.01); *A47C 27/081* (2013.01)

(58) Field of Classification Search

CPC ..... A47C 27/08; A47C 27/081; A47C 27/082; A47C 27/083; A47C 27/084; A47C 27/088; A47C 27/10; A47C 27/18; A61G 7/001; A61G 7/05769; A61G 7/057776

USPC ..... 5/709, 706, 655.9, 652, 953, 654, 655.3, 5/710, 713, 715

See application file for complete search history.

(56) References Cited

U.S. PATENT DOCUMENTS

| | | | | |
|---|---|---|---|---|
| 4,279,044 A * | 7/1981 | Douglas | A43B 3/0084 5/654 |
| 4,833,457 A | 5/1989 | Graebe, Jr. | |
| 4,945,588 A * | 8/1990 | Cassidy | A47C 27/082 5/665 |
| 4,962,552 A | 10/1990 | Hasty | |

(Continued)

FOREIGN PATENT DOCUMENTS

| | | |
|---|---|---|
| DE | 102006008598 A1 | 8/2007 |
| EP | 2060836 A2 | 5/2009 |

(Continued)

OTHER PUBLICATIONS

EP Supplementary Search Report; European Patent Office; EP Application No. EP14770704.6; dated Nov. 3, 2016.

(Continued)

*Primary Examiner* — Robert G Santos

(74) *Attorney, Agent, or Firm* — Faegre Drinker Biddle & Reath LLP

(57) ABSTRACT

A patient support is provided. The patient support may include a plurality of inflatable members. The plurality of inflatable members may include a core including a resilient material. The patient support may be controlled with a first controller positioned within an envelope of the patient support. The patient support may include a detector to detect when an external controller is coupled to the patient support, the patient support being controlled by the second controller when the second controller is present.

14 Claims, 46 Drawing Sheets

(56) References Cited

U.S. PATENT DOCUMENTS

| | | | | |
|---|---|---|---|---|
| 4,995,124 | A * | 2/1991 | Wridge, Jr. | A47C 27/083 5/709 |
| 5,142,717 | A * | 9/1992 | Everard | A47C 27/083 5/709 |
| 5,325,551 | A * | 7/1994 | Tappel | A47C 27/082 5/709 |
| 5,359,739 | A | 11/1994 | Rains et al. | |
| 5,360,653 | A | 11/1994 | Ackley | |
| 5,530,974 | A | 7/1996 | Rains et al. | |
| 5,634,224 | A | 6/1997 | Gates | |
| D402,494 | S | 12/1998 | Langer | |
| 6,253,402 | B1 | 7/2001 | Lin | |
| 6,269,505 | B1 | 8/2001 | Wilkinson | |
| 6,357,066 | B1 | 3/2002 | Pierce | |
| 6,360,388 | B2 | 3/2002 | Langer | |
| 6,449,788 | B1 | 9/2002 | Nichols | |
| 6,668,399 | B2 | 12/2003 | Malstaff et al. | |
| 6,694,556 | B2 | 2/2004 | Stolpmann | |
| 6,739,001 | B2 * | 5/2004 | Flick | A61G 7/001 5/425 |
| 6,813,790 | B2 * | 11/2004 | Flick | A47C 27/082 5/710 |
| 7,086,101 | B2 | 8/2006 | Welch et al. | |
| 7,441,290 | B1 * | 10/2008 | Flick | A61G 7/05715 5/615 |
| 7,464,425 | B2 | 12/2008 | Chambers et al. | |
| 8,102,270 | B2 | 1/2012 | Gowda et al. | |
| 8,104,125 | B2 * | 1/2012 | Soltani | A61G 7/0755 5/690 |
| 8,261,387 | B2 | 9/2012 | Lipman et al. | |
| 8,533,879 | B1 * | 9/2013 | Taylor | A47C 27/10 5/713 |
| 8,615,831 | B2 | 12/2013 | Lipman et al. | |
| 8,875,331 | B2 * | 11/2014 | Taylor | G01L 1/18 5/713 |
| 9,271,579 | B2 * | 3/2016 | Riley | A47C 27/18 |
| 9,801,767 | B2 | 10/2017 | Gowda et al. | |
| 10,058,189 | B2 * | 8/2018 | Petrov | A61G 7/05738 |
| 2001/0009043 | A1 | 7/2001 | Langer | |
| 2002/0116766 | A1 | 8/2002 | Stolpmann | |
| 2002/0170117 | A1 * | 11/2002 | Flick | A61G 7/001 5/715 |
| 2003/0208848 | A1 * | 11/2003 | Flick | A47C 27/082 5/713 |
| 2004/0031103 | A1 | 2/2004 | Wyatt et al. | |
| 2005/0091752 | A1 | 5/2005 | Gowda | |
| 2006/0272097 | A1 | 7/2006 | Dionne et al. | |
| 2007/0186349 | A1 | 8/2007 | Lipman et al. | |
| 2008/0098532 | A1 | 5/2008 | Gowda | |
| 2009/0106906 | A1 * | 4/2009 | Soltani | A61G 7/015 5/713 |
| 2009/0265852 | A1 * | 10/2009 | Gowda | A61H 23/0236 5/600 |
| 2009/0270774 | A1 | 10/2009 | Gowda et al. | |
| 2010/0281618 | A1 | 11/2010 | O'Reagan | |
| 2013/0000048 | A1 | 1/2013 | Lipman et al. | |
| 2014/0026327 | A1 * | 1/2014 | Taylor | A61B 5/6887 5/713 |
| 2014/0101861 | A1 | 4/2014 | Gowda et al. | |
| 2014/0259432 | A1 * | 9/2014 | Gowda | A61G 7/05776 5/713 |
| 2014/0298588 | A1 * | 10/2014 | Riley | A47C 27/18 5/709 |
| 2016/0037939 | A1 * | 2/2016 | Petrov | A43B 13/203 5/655.3 |
| 2017/0128298 | A1 * | 5/2017 | Gowda | A47C 27/088 |

FOREIGN PATENT DOCUMENTS

| | | | | |
|---|---|---|---|---|
| GB | 2559455 | A * | 8/2018 | A61G 7/05776 |
| JP | 07139682 | A | 5/1995 | |
| WO | 98/22071 | | 5/1998 | |
| WO | 00/09064 | | 2/2000 | |

OTHER PUBLICATIONS

European Search Report; EP Application No. 18162147.5; dated Aug. 14, 2019.

International Search Report and Written Opinion dated Mar. 20, 2014 in related International Application No. PCT/US2013/064496.

U.S. Patent and Trademark Office; U.S. Appl. No. 14/051,893; Non-Final Rejection; dated Sep. 22, 2016.

* cited by examiner

PATIENT SUPPORT APPARATUS AND METHOD

RELATED APPLICATION

This application is a divisional application of U.S. application Ser. No. 14/051,893, filed Oct. 11, 2013, titled PATIENT SUPPORT APPARATUS AND METHOD, which claims the benefit of U.S. Provisional Application Ser. No. 61/713,856, filed Oct. 15, 2012, titled PATIENT SUPPORT APPARATUS AND METHOD, the disclosures of which are expressly incorporated by reference herein.

FIELD

The disclosure relates in general to patient supports and, more particularly, to patient supports including at least one inflatable cell.

BACKGROUND

Patient supports are known. Foam mattresses are currently used for comfort. When a patient lays on a current foam mattress air escapes from the foam mattress through the cover. When the patient egresses from the foam mattress, the mattress draws air back into the foam mattress. The air pressure within the foam mattress is the same as the air pressure outside of the foam mattress.

Further, it is known to install a sleeve over a foam mattress made of a KEVLAR brand material. The sleeve must be removed to clean or otherwise service the mattress.

Accordingly, it is desirable to provide an improved patient support apparatus and method that overcomes one or more of the aforementioned drawbacks or other limitations of the prior art.

BRIEF DESCRIPTION OF THE DRAWINGS

The above-mentioned and other features and advantages of this disclosure, and the manner of attaining them, will become more apparent and the invention itself will be better understood by reference to the following description of embodiments of the invention taken in conjunction with the accompanying drawings, wherein:

FIG. 3 illustrates a perspective view of the patient support of FIG. 1 along with exemplary fluid supply sources spaced apart there from and an exemplary portable inflation device spaced apart there from;

Corresponding reference characters indicate corresponding parts throughout the several views. The exemplifications set out herein illustrate exemplary embodiments of the invention and such exemplifications are not to be construed as limiting the scope of the invention in any manner.

DETAILED DESCRIPTION OF THE DRAWINGS

Figure 1:
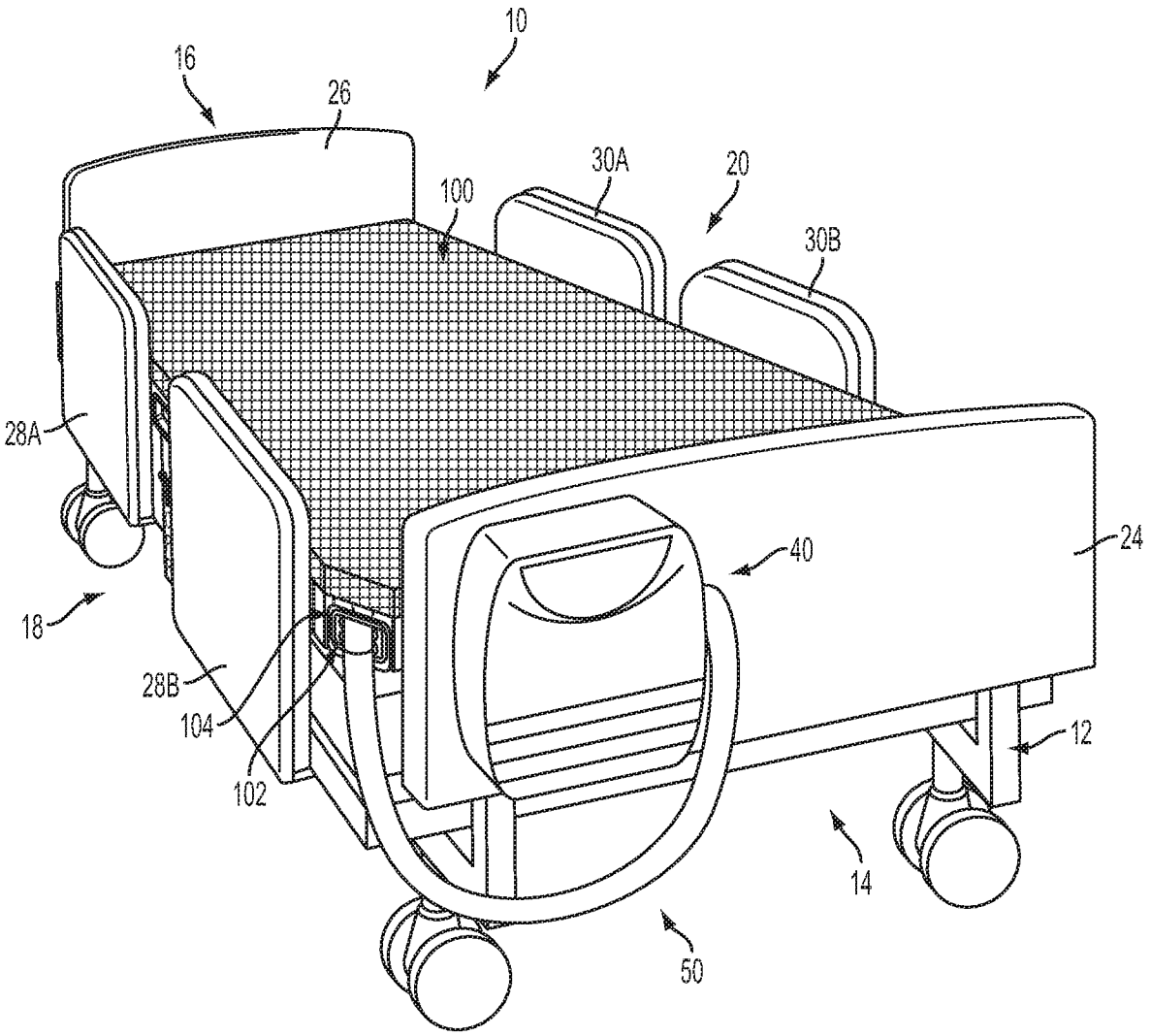
FIG. 1 illustrates a perspective view of an exemplary bed including an exemplary patient support positioned thereon.

The embodiments disclosed herein are not intended to be exhaustive or to limit the invention to the precise forms disclosed in the following detailed description. Rather, the embodiments are chosen and described so that others skilled in the art may utilize their teachings.

In an exemplary embodiment of the present disclosure a patient support is provided. The patient support comprising a cell which is inflatable with a fluid to a pressure above an ambient pressure; a core positioned within the inflatable cell, the core including an elongated resilient member; and a valve in fluid communication with an interior of the cell, the valve being configured to permit fluid to egress from the interior of the cell when the pressure is greater than a threshold pressure and to maintain the fluid in the interior of the cell when the pressure is lower than the threshold pressure, the valve being a one way valve. In one example, the elongated resilient member is a foam core. In a variation thereof, the foam core includes at least one cavity extending through the foam core from a first side of the foam core to a second side of the foam core, the second side being opposite the first side. In another variation thereof, the patient support further comprises a member positioned in a first cavity of the at least one cavity, the member maintains the first cavity in an open configuration when the resilient member is compressed. In yet another variation thereof, the foam core includes a first foam core and a second foam core, the first foam core includes the at least one cavity and the second foam core surrounds the first foam core. In a refinement thereof, the second foam core has a constant outer diameter. In a further refinement, the second foam core includes a plurality of radially inward extending recesses. In still a further refinement, the foam core further comprises a third foam core provided between the first foam core and the second foam core, a plurality of voids being formed between the second foam core and one of the first foam core and the second foam core. In still another variation, the foam core includes a central body and a plurality of protrusions extending from the central body. In a refinement thereof, the central body is cylindrical and the plurality of protrusions extend radially outward from the central body. In another example, the cell includes a cell wall, the patient support further comprising a first fluid connector passing through the cell wall and being in fluid communication with the interior of the cell, wherein the first fluid connector is in fluid communication with the valve. In a variation thereof, valve is an analog pressure relief valve. In another variation thereof, the patient support further comprises a second fluid connector passing through the cell wall and being in fluid communication with the interior of the cell, the second fluid connector being spaced apart from the first fluid connector. In yet another example, the patient support further comprises a pressure sensor monitoring a fluid pressure in the interior of the cell and a controller, the controller based on the fluid pressure in the interior of the cell determining if the fluid pressure corresponds to a low pressure condition. In a variation thereof, the patient support further comprises at least one notification device operatively coupled to the controller to provide a first notification if the low pressure condition exists. In a refinement thereof, the at least one notification device provides a second notification if the low pressure condition does not exist. In a further refinement, a first notification device provides the first notification and a second notification device provides the second notification.

In another exemplary embodiment of the present disclosure, a method of supporting a patient is provided. The method comprising inflating an inflatable cell comprising a core including an elongated resilient member with a fluid to a pressure above an ambient pressure; evacuating a portion of the fluid from an interior of the inflatable cell when the pressure is greater than a threshold pressure through a one-way valve; and maintaining the fluid in the interior of the inflatable cell when the pressure is less than the threshold pressure. In one example, the method further comprises providing a notification when the pressure is below a second threshold pressure.

In still another exemplary embodiment of the present disclosure a patient support is provided. The patient support comprising a cell which is inflatable with a fluid to a pressure above an ambient pressure; a core positioned within the inflatable cell, the core including an elongated resilient member including at least one cavity; and a member positioned in a first cavity of the at least one cavity of the elongated resilient member, the member maintains the first cavity in an open configuration when the resilient member is compressed. In one example, the first cavity extends through the resilient member from a first side of the resilient member to a second side of the resilient member, the second side being opposite the first side. In a variation thereof, the patient support further comprises a valve in fluid communication with an interior of the cell, the valve being configured to permit fluid to egress from the interior of the cell when the pressure is greater than a threshold pressure and to maintain the fluid in the interior of the cell when the pressure is lower than the threshold pressure, the valve being a one way valve. In another example, the elongated resilient member is a foam core. In a variation thereof, the foam core includes a first foam core and a second foam core, the first foam core includes the at least one cavity and the second foam core surrounds the first foam core. In a refinement thereof, the second foam core has a constant outer diameter. In a further refinement thereof, the second foam core includes a plurality of radially inward extending recesses. In another variation, the foam core further comprises a third foam core provided between the first foam core and the second foam core, a plurality of voids being formed between the second foam core and one of the first foam core and the second foam core. In still another variation, the foam core includes a central body and a plurality of protrusions extending from the central body. In a refinement thereof, the central body is cylindrical and the plurality of protrusions extend radially outward from the central body.

In yet still another exemplary embodiment of the present disclosure a patient support is provided. The patient support comprising a plurality of inflatable cells, each inflatable cell including a cell wall surrounding an interior to be pressurized above an ambient pressure, at least one port to communicate fluid into the interior to be pressurized to pressurize the inflatable cell, and a core including an elongated resilient member within the interior to be pressurized; and at least one valve configured to maintain the inflatable cells at at least one pressure above ambient pressure when the inflatable cells are pressurized, wherein the at least one valve includes at least one fill valve to pressurize the plurality of inflatable cells and at least one pressure relief valve which sets at least one upper threshold pressure for the plurality of inflatable cells. In one example, the interiors of the plurality of inflatable cells are at the ambient pressure. In another example, the interiors of the plurality of inflatable cells are pressurized above the ambient pressure. In a variation thereof, an interior of a first cell of the plurality of cells is pressurized to a first pressure above the ambient pressure and a second cell of the plurality of cells is pressurized to a second pressure above the ambient pressure, the second pressure being greater than the first pressure. In yet another example, the plurality of inflatable cells includes a first group of inflatable cells and a second group of inflatable cells, the first group of inflatable cells having a first pressure relief valve in fluid communication with the interiors of the first group of inflatable cells and the second group of inflatable cells having a second pressure relief valve in fluid communication with the interiors of the second group of inflatable cells. In still yet another example, the elongated resilient member includes at least one cavity and further comprising a member positioned in a first cavity of the at least one cavity of the elongated resilient member, the member maintains the first cavity in an open configuration when the resilient member is compressed. In a variation thereof, the first cavity extends through the resilient member from a first side of the resilient member to a second side of the resilient member, the second side being opposite the first side. In another variation thereof, the elongated resilient member is a foam core. In a refinement thereof, the foam core includes a first foam core and a second foam core, the first foam core includes the at least one cavity and the second foam core surrounds the first foam core. In a further refinement thereof, the second foam core has a constant outer diameter. In yet another further refinement thereof, the second foam core includes a plurality of radially inward extending recesses. In still another variation thereof, the foam core further comprises a third foam core provided between the first foam core and the second foam core, a plurality of voids being formed between the second foam core and one of the first foam core and the second foam core. In another variation thereof, the foam core includes a central body and a plurality of protrusions extending from the central body. In a refinement thereof, the central body is cylindrical and the plurality of protrusions extend radially outward from the central body.

In still a further exemplary embodiment of the present disclosure a patient support is provided. The patient support comprising at least one inflatable cell inflated with a fluid; at least one pressure sensor monitoring a fluid pressure within the at least one inflatable cell; at least one valve in fluid communication with an interior of the at least one inflatable cell to communicate fluid relative to the interior of the at least one inflatable cell; at least one controller operating the patient support in a plurality of modes of operation. The plurality of modes of operation including a passive mode of operation wherein the at least one controller monitors the fluid pressure of the at least one inflatable cell and does not actively cause fluid to be communicated to the interior of the at least one inflatable cell; and an active mode of operation wherein the at least one controller actively causes fluid to be communicated to the interior of the at least one inflatable cell. In one example, the at least one controller includes a first controller which monitors the fluid pressure of the at least one inflatable cell in the passive mode of operation and a second controller which actively causes fluid to be communicated to the interior of the at least one inflatable cell in the active mode of operation. In a variation thereof, the first controller is positioned within an envelope of the patient support and the second controller is positioned outside of the envelope of the patient support. In a refinement thereof, the patient support further comprises an interface including at least one fluid connection in fluid communication with the interior of the at least one inflatable cell through the at least one valve, the interface being accessible from an exterior of the patient support. In another variation thereof, the patient support further comprises a sensor which detects a presence of the second controller, the sensor being operatively coupled to the first controller, the at least one controller operating the patient support in the passive mode of operation when the sensor indicates that the second controller is not present and the at least one controller operating the patient support in the active mode of operation when the sensor indicates that the second controller is present. In a refinement thereof, the sensor is a proximity sensor. In a further example, the patient support further comprises at least one low pressure notification device operatively coupled to the at least one controller, the at least one controller in the passive mode of operation causing the at least one low pressure notification devices to provide a notification when the at least one controller determines that the fluid pressure of the at least one inflatable cell is below a threshold value. In a variation thereof, the notification is at least one of a visual indicator, an audio indicator, and a signal to a remote device. In another variation thereof, the at least one inflatable cell defines a plurality of zones along a longitudinal length of the patient support and the notification is a visual indicator which provides an indication of which zone of the plurality of zones has a fluid pressure below the threshold value. In yet a further example thereof, the at least one inflatable cell includes a first plurality of cells which are monitored in the passive mode of operation and a second plurality of cells which are not monitored in the passive mode of operation. In still yet a further example thereof, the at least one inflatable cell includes a first plurality of cells which include a foam core within each of the cells. In a variation thereof, the at least one inflatable cell provides one of an alternating therapy during the active mode of operation and a turning therapy during the active mode of operation. In a refinement thereof, the first plurality of cells provide the alternating therapy during the active mode of the operation.

In yet another exemplary embodiment of the present disclosure, a method of operating a patient support is provided. The method comprising the steps of operating the patient support with a controller provided within an envelope of the patient support; determining if an external controller is connected to the patient support; and if the external controller is connected to the patient support, operating the patient support with the external controller instead of the controller. In one example, the step of operating the patient support with the controller includes the steps of: monitoring a fluid pressure of a plurality of inflatable cells; and providing a notification if the fluid pressure is less than a threshold pressure. In another example, the step of operating the patient support with the external controller includes the step of activating a fluid supply to provide a low air loss therapy through an upper surface of the patient support. In a further example, the step of operating the patient support with the external controller includes the step of activating a fluid supply to provide a turning therapy with a plurality of inflatable cells of the patient support. In still a further example the step of operating the patient support with the external controller includes the step of activating a fluid supply to provide an alternating therapy with a plurality of inflatable cells of the patient support. In yet still a further example, the step of determining if an external controller is connected to the patient support includes the steps of providing a sensor in an interface of the patient sensor, the interface coupling the external controller to a plurality of inflatable cells of the patient support; and monitoring the sensor with the controller.

In still a further exemplary embodiment of the present disclosure, a patient support adapted to be coupled to an external device is provided. The patient support comprising at least one component positioned within an envelope of the patient support; a first controller operatively coupled to the at least one component; a detection device operatively coupled to the controller and adapted to detect a presence of a second controller operable to control the external device; an interface provided through the envelope of the patient support, the interface being adapted to operatively couple the external device to the at least one component, wherein the first controller monitors the at least one component in an absence of a detection of the presence of the second controller. In one example, the first controller is positioned within the envelope of the patient support. In a variation thereof, the at least one component includes a plurality of inflatable cells, each inflatable cell including a cell wall surrounding an interior to be pressurized above an ambient pressure and at least one port to communicate fluid into the interior to be pressurized to pressurize the inflatable cell, the first controller monitoring a pressure of the plurality of inflatable cells. In a refinement thereof, the interiors of the plurality of inflatable cells are at the ambient pressure. In another refinement thereof, the interiors of the plurality of inflatable cells are pressurized above the ambient pressure. In still another refinement thereof, an interior of a first cell of the plurality of cells is pressurized to a first pressure above the ambient pressure and a second cell of the plurality of cells is pressurized to a second pressure above the ambient pressure, the second pressure being greater than the first pressure. In a further example, the detection device is a sensor operatively coupled to the first controller. In still a further example, the detection device is positioned at the interface, the detection device being adapted to detect a connection of the external device to the interface. In a variation thereof, the detection device is a sensor operatively coupled to the first controller. In another variation thereof, the interface includes an exhaust port, the exhaust port being in fluid communication with a pressure relief valve which is in fluid communication with the interior of a first inflatable cell. In a refinement thereof, when the external device is coupled to the interface, the exhaust port is plugged. In a further example thereof, the detection device is positioned at the interface, the detection device being adapted to detect a connection of the external device to the interface, the interface including a connector interface and a communication interface. In a variation thereof, the communications interface includes at least one input device to adapted to receive an input command for the first controller and at least one output device adapted to communicate status information regarding the patient support. In a further variation thereof, the connector interface is adapted to operatively couple the external device to the at least one component. In still a further variation, the communication interface surrounds the connector interface. In yet still a further variation, the connector interface is recessed relative to the communication interface.

In still yet another exemplary embodiment of the present disclosure, a patient support having a head end, a foot end, a right side, and a left side is provided. The patient support comprising a cover including an upper surface; a plurality of inflatable cells positioned below the upper surface of the cover and extending in a first direction from proximate a left side of the patient support towards a right side of the patient support; at least one inflatable side bolster positioned below the upper surface of the cover and adjacent at least one side of the patient support and generally extending in a second direction from proximate a head end of the patient support towards a foot end of the patient support; and a controller operatively coupled to the plurality of inflatable cells and the at least one inflatable side bolster, wherein the controller provides a first non-turning therapy mode of operation and a second turning therapy mode of operation with the plurality of inflatable cells, the at least one inflatable side bolster having a first bolster height in the non-turning therapy mode of operation and a second bolster height in the turning therapy mode of operation, the second bolster height being greater than the first bolster height due to fluid being communicated to an interior of the at least one inflatable side bolster. In one example, the at least one inflatable side bolster includes a core including an elongated resilient member. In a variation thereof, the elongated resilient member includes at least one cavity and further comprising a member positioned in a first cavity of the at least one cavity of the elongated resilient member, the member maintains the first cavity in an open configuration when the resilient member is compressed. In a refinement thereof, the first cavity extends through the resilient member from a first side of the resilient member to a second side of the resilient member, the second side being opposite the first side. In another variation thereof, the elongated resilient member is a foam core. In a refinement thereof, the foam core includes a first foam core and a second foam core, the first foam core includes the at least one cavity and the second foam core surrounds the first foam core. In a further refinement thereof, the second foam core has a constant outer diameter. In still a further refinement thereof, the second foam core includes a plurality of radially inward extending recesses. In another refinement thereof, the foam core further comprises a third foam core provided between the first foam core and the second foam core, a plurality of voids being formed between the second foam core and one of the first foam core and the second foam core. In still another refinement thereof, the foam core includes a central body and a plurality of protrusions extending from the central body. In a further refinement thereof, the central body is cylindrical and the plurality of protrusions extend radially outward from the central body.

In yet a further exemplary embodiment, a patient support for connection to an external device is provided. The patient support comprising an envelope; at least one inflatable cell positioned within the envelope; a component positioned within the envelope; an interface to connect the component with the external device, the envelope having a foot end, a head end, and a first side, the interface being located in a corner portion of the envelope. In one example, the interface is positioned through a second side intersecting the first side and one of the head end and the foot end. In another example, the component is a fluid conduit in fluid communication with an interior of the at least one inflatable cell. In yet another example, the interface includes a connector interface and a communication interface. In a variation thereof, the communications interface includes at least one input device to adapted to receive an input command for the first controller and at least one output device adapted to communicate status information regarding the patient support. In another variation thereof, the connector interface is adapted to operatively couple the external device to the component. In still another variation thereof, the communication interface surrounds the connector interface. In yet a further variation, the connector interface is recessed relative to the communication interface.

In still yet a further exemplary embodiment, a patient support for connection to an external device is provided. The patient support comprising an envelope; at least one inflatable cell positioned within the envelope; a component positioned within the envelope; an interface to connect the component with the external device, the envelope having a foot end, a head end, and a first side, the interface connecting the component to the external device, the interface including a connector interface and a communication interface positioned about the connector interface. In one example, the component is a fluid conduit in fluid communication with an interior of the at least one inflatable cell. In another example, the communications interface includes at least one input device to adapted to receive an input command for the first controller and at least one output device adapted to communicate status information regarding the patient support. In a further example, the connector interface is adapted to operatively couple the external device to the component. In still a further example, the communication interface surrounds the connector interface. In yet still a further example, the connector interface is recessed relative to the communication interface.

In still yet another exemplary embodiment, a patient support for connection to an external device is provided. The patient support comprising a first portion including a first fire barrier layer; a second portion including a second fire barrier layer; a coupler removably coupling at least a portion of the first portion and at least a portion of the second portion, when the first portion is coupled to the second portion the first portion and the second portion cooperate to define an interior space surrounded by the first fire barrier and the second fire barrier; and at least one inflatable support member positioned within the interior space defined by the first portion and the second portion, the at least one inflatable support member includes an elongated resilient member core. In one example, the patient support further comprises at least one foam containing support member positioned with the interior space defined by the first portion and the second portion. In another example, the elongated resilient member includes at least one cavity and the patient support further comprises a member positioned in a first cavity of the at least one cavity of the elongated resilient member, the member maintains the first cavity in an open configuration when the resilient member is compressed. In a variation thereof, the first cavity extends through the resilient member from a first side of the resilient member to a second side of the resilient member, the second side being opposite the first side. In another variation thereof, the elongated resilient member is a foam core. In a refinement thereof, the foam core includes a first foam core and a second foam core, the first foam core includes the at least one cavity and the second foam core surrounds the first foam core. In a further refinement thereof, the second foam core has a constant outer diameter. In another refinement thereof, the second foam core includes a plurality of radially inward extending recesses. In another refinement thereof, the foam core further comprises a third foam core provided between the first foam core and the second foam core, a plurality of voids being formed between the second foam core and one of the first foam core and the second foam core. In still another refinement thereof, the foam core includes a central body and a plurality of protrusions extending from the central body. In a further refinement thereof, the central body is cylindrical and the plurality of protrusions extend radially outward from the central body. In another example, the patient support further comprises at least one turning inflatable cells.

In still a further exemplary embodiment of the present disclosure, a patient support is provided. The patient support comprising at least one inflatable cell inflated with a fluid to a pressure above an ambient pressure; at least one valve in fluid communication with the fluid within the at least one inflatable cell to permit fluid to egress from the at least one inflatable cell; and a muffler in fluid communication with the at least one valve, the muffler including a housing, at least one intake, an exhaust, and a sound reducing member positioned in the housing, the fluid which egresses from the at last one inflatable cell being communicated to the interior of the housing through the at least one intake and traverses the sound reducing member to reach the exhaust. In one example, the at least one valve permits fluid to egress from the at least one inflatable cell when the pressure in the at least one inflatable cell is greater than a threshold pressure. In another example, the muffler is positioned within an envelope of the patient support. In still another example, the at least one inflatable cell includes an elongated resilient member core. In a variation thereof, the elongated resilient member includes at least one cavity and further comprising a member positioned in a first cavity of the at least one cavity of the elongated resilient member, the member maintains the first cavity in an open configuration when the resilient member is compressed.

In still a further exemplary embodiment of the present disclosure, a patient support for supporting a patient, the patient support having a head end, a foot end, a right side, and a left side, is provided. The patient support comprising a low air loss assembly having a top surface proximate the patient; a plurality of inflatable cells positioned below the low air loss assembly, the plurality of inflatable cells arranged to facilitate turning the patient; and a foam support positioned below the low air loss assembly. In one example, the patient support further comprises a controller operatively coupled to the plurality of inflatable cells, wherein the controller includes a turning therapy mode of operation with the plurality of inflatable cells. In a variation thereof, the patient support further comprises at least one inflatable side bolster positioned above the plurality of inflatable cells and below the low air loss assembly. In a refinement thereof, the controller includes at least one non-turning therapy mode of operation, the at least one inflatable bolster having a first bolster height in the non-turning therapy mode of operation and a second bolster height in the turning therapy mode of operation, the second bolster height being greater than the first bolster height due to fluid being communicated to an interior of the at least one inflatable side bolster.

In still yet another exemplary embodiment of the present disclosure, a patient support is provided. The patient support comprising a patient support having an envelope, the envelope including an upper patient support surface; a plurality of inflatable cells positioned within the envelope of the patient support; a sensor positioned within the envelope of the patient support, the sensor monitoring a characteristic of at least one of the plurality of inflatable cells; and an interface supported by the patient support, the interface including a connector interface and a communication interface, the connector interface including at least one connection operatively coupled to the plurality of inflatable cells and adapted to couple an external device and the communication interface providing a indication of the characteristic of the at least one inflatable cell. In one example, the interface is provided in a side of the patient support. In another example, the communication interface surrounds the connector interface. In a variation thereof, the connector interface is recessed relative to the communication interface. In a further example thereof, the plurality of inflatable cells include a first grouping of inflatable cells and a second grouping of inflatable cells, the communication interface including a first representation of the first grouping of inflatable cells, a second representation of the second grouping of inflatable cells, a representation of a patient positioned on the patient support relative to the first grouping of cells and the second grouping of cells, an indication of a status of the first grouping of cells, and an indication of a status of the second grouping of cells.

In still a further exemplary embodiment of the present disclosure, a patient support is provided. The patient support comprising a plurality of inflatable cells positioned within an envelope of the patient support; a first sensor which provides a first indication of an interior pressure of a first inflatable cell of the plurality of inflatable cells; a second sensor which provides a first indication of an interior pressure of a second inflatable cell of the plurality of inflatable cells; and a controller operatively coupled to the first sensor and operatively coupled to the second sensor, the controller based on the first indication of the interior pressure of the first inflatable cell and the second indication of the interior pressure of the second inflatable cell determines if the patient has exited the patient support. In one example, the controller compares a current pressure value associated with the first inflatable cell to at least one historical pressure value associated with the first inflatable cell and compares a current pressure value associated with the second inflatable cell to at least one historical pressure value associated with the second inflatable cell and determines that the patient has exited the patient support when the current pressure value associated with the first inflatable cell is less than the at least one historical value associated with the first inflatable cell and the current pressure value associated with the second inflatable cell is less than the at least one historical value associated with the second inflatable cell. In another example, the patient support further comprises a third sensor which provides a third indication of an interior pressure of a third inflatable cell of the plurality of inflatable cells and wherein the controller compares a current pressure value associated with the first inflatable cell to at least one historical pressure value associated with the first inflatable cell, compares a current pressure value associated with the second inflatable cell to at least one historical pressure value associated with the second inflatable cell, and a current pressure value associated with the third inflatable cell to at least one historical pressure value associated with the third inflatable cell and determines that the patient has exited the patient support when a threshold number of the first inflatable cell, the second inflatable cell, and the third inflatable cell have a lower current pressure value compared to the respective at least one historical value. In a variation thereof, the threshold value is two.

In still yet a further exemplary embodiment of the present disclosure, a patient support for supporting a patient, the patient support having a head end, a foot end, a right side, and a left side, is provided. The patient support comprising a top patient support surface; a plurality of elongated turning inflatable members positioned below the top patient support surface, each of the elongated turning inflatable members extending in a first direction extending from the left side of the patient support to the right side of the patient support and each of the elongated turning inflatable cells including a plurality of inflatable chambers; a plurality of elongated inflatable members supporting the plurality of elongated turning inflatable members. In one example, the plurality of elongated inflatable members extend along the first direction. In another example, the plurality of elongated inflatable members extend along a second direction, the second direction being angled relative to the first direction. In still another example, each of the plurality of inflatable chambers of the elongated turning inflatable members includes at least two overlapping inflatable chambers. In a variation thereof, each of the plurality of elongated turning inflatable members is part of an inflatable cell, the inflatable cell further including one of the plurality of elongated inflatable members. In yet a further example, each of the plurality of inflatable chambers of the elongated turning inflatable members includes at least two non-overlapping inflatable chambers. In a variation thereof, each of the plurality of elongated turning inflatable members is part of an inflatable cell, the inflatable cell further including one of the plurality of elongated inflatable members. In still a further example, each of the plurality of elongated turning inflatable members is part of an inflatable cell, the inflatable cell further including one of the plurality of elongated inflatable members.

In still a further exemplary embodiment of the present disclosure, a combination is provided. The combination comprising a patient support including a plurality of inflatable cells, each inflatable cell including a cell wall surrounding an interior to be pressurized above an ambient pressure and a core including an elongated resilient member positioned within the interior; and a shipping container surrounding the patient support, wherein the interiors of the plurality of inflatable cells are pressurized above ambient pressure while the shipping container surrounds the patient support. In one example, an interior of a first cell of the plurality of cells is pressurized to a first pressure above the ambient pressure and a second cell of the plurality of cells is pressurized to a second pressure above the ambient pressure, the second pressure being greater than the first pressure. In another example, the plurality of inflatable cells includes a first group of inflatable cells and a second group of inflatable cells, the first group of inflatable cells having a first pressure relief valve in fluid communication with the interiors of the first group of inflatable cells and the second group of inflatable cells having a second pressure relief valve in fluid communication with the interiors of the second group of inflatable cells. In still another example, the elongated resilient member includes at least one cavity and further comprising a member positioned in a first cavity of the at least one cavity of the elongated resilient member, the member maintains the first cavity in an open configuration when the resilient member is compressed. In a variation thereof, the first cavity extends through the resilient member from a first side of the resilient member to a second side of the resilient member, the second side being opposite the first side. In still another example, the elongated resilient member is a foam core.

Referring to FIG. 1, an exemplary bed 10 is shown. Bed 10 includes a bed frame 12. The bed frame 12 having a foot end 14, a head end 16, a first side 18 and a second side 20. A footboard 24 is positioned at the foot end 14 of the bed frame 12. A headboard is positioned at the head end 16 of bed frame 12. A plurality of side barriers 28A and 28B are positioned along the first side 18 of bed frame 12. A plurality of side barriers 30A and 30B are positioned along the side safety panels 20 of bed frame 12. Exemplary side barriers include side rails and other exemplary members to prevent egress of a patient.

Figure 3:
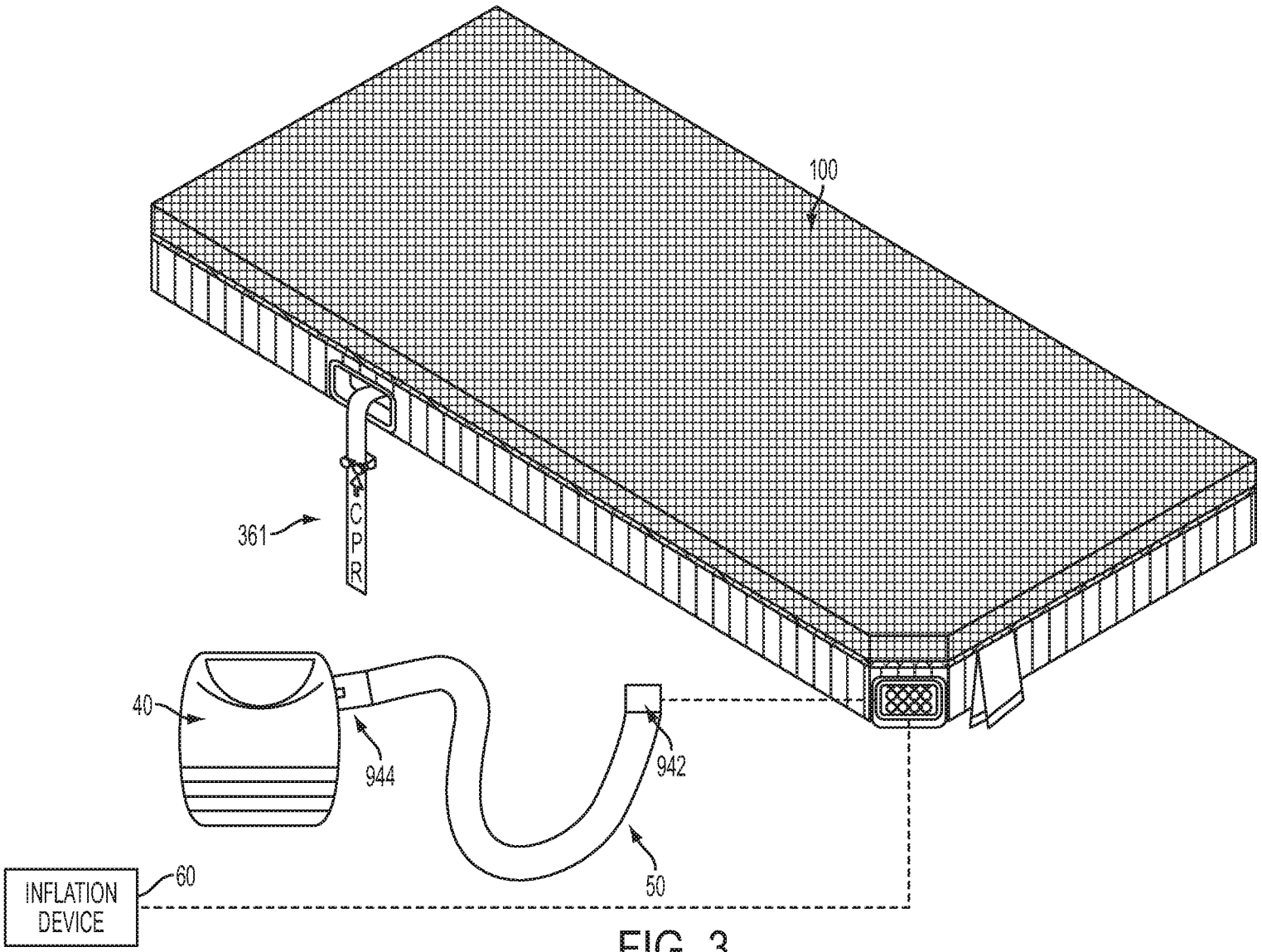

A patient support 100 is supported on bed frame 12. As shown in FIG. 1, patient support 100 is positioned between side barriers 28 and side barriers 30 and between footboard 24 and headboard 26. A fluid supply unit 40 is also supported by bed frame 12. Fluid supply unit 40 interacts with one or more components of patient support 100 through an interface 102. As illustrated in FIG. 3, fluid supply unit 40 may be separated from patient support 100.

Returning to FIG. 1, interface 102 is provided in a lower corner 104 of patient support 100. Interface 102 is accessible in a gap provided by footboard 24 and side barrier 28B. An advantage, among others, provided in one embodiment is by placing interface 102 in a corner of patient support 100, such as lower corner 104, is that interface 102 is easily accessible. An advantage, among others, provided in one embodiment is that fluid conduits within a connecting conduit 50 will not kink by placing interface 102 in a corner of patient support 100. As described herein, the fluid conduits within connecting conduit 50 connect fluid supply unit 40 to one or more inflatable cells within patient support 100.

Figure 2:
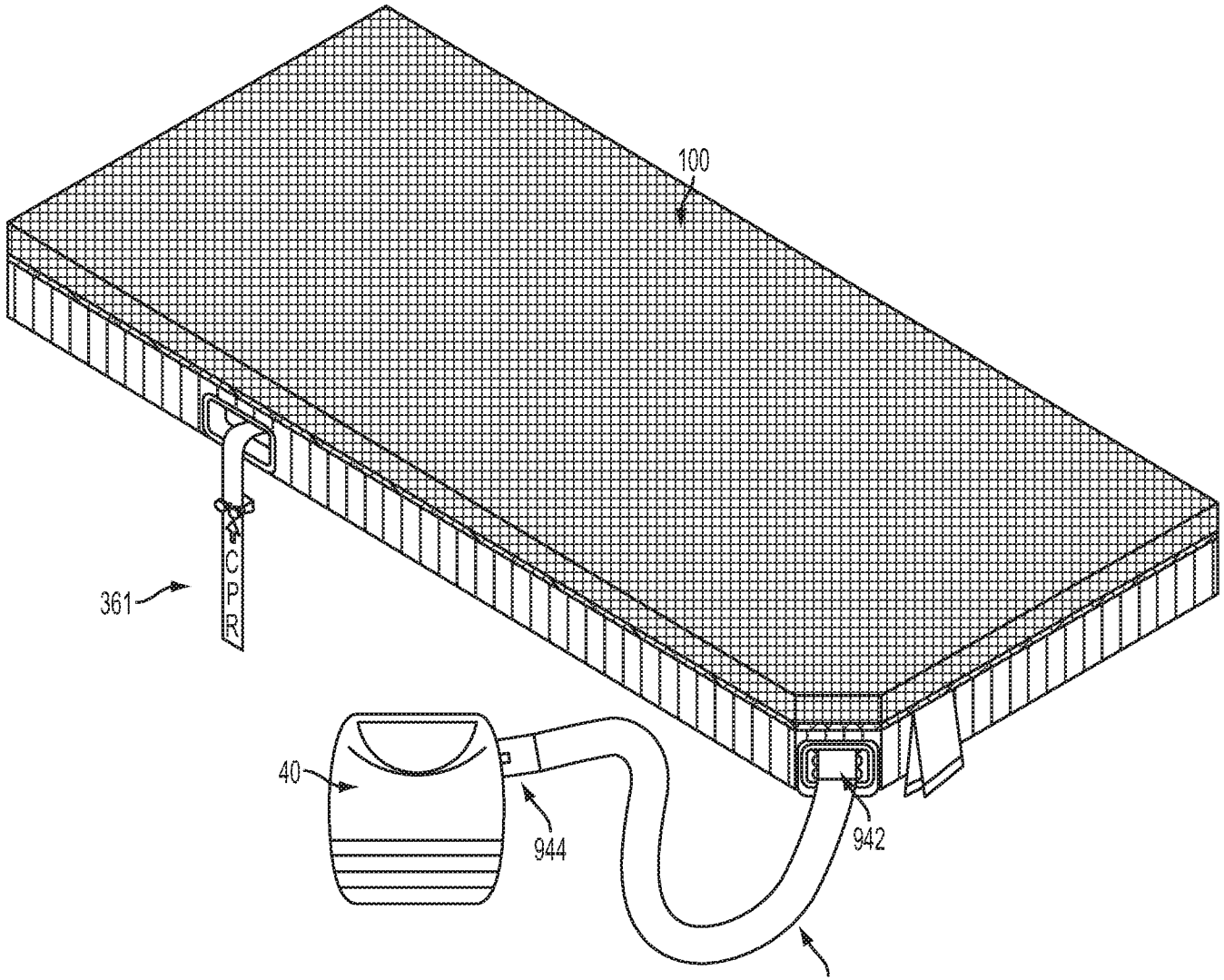
FIG. 2 illustrates a perspective view of the patient support of FIG. 1 with a fluid supply source coupled thereto.

Referring to FIG. 2, fluid supply unit 40 is shown coupled to patient support 100 through connecting conduit 50. Referring to FIG. 3, fluid supply unit 40 is shown uncoupled from patient support 100. Interface 102, as described herein, includes a plurality of fluid connections which may couple to fluid connections in connecting conduit 50 or may couple with a fluid connection of an inflation device 60. Exemplary inflation devices include manual pumps, compressors, or other suitable devices which provide compressed fluid to patient support 100. Inflation device 60 is simply an inflation device. Fluid supply unit 40 includes a controller which, in one embodiment, interfaces with components of patient support 100 through interface 102 to provide a therapy with patient support 100. Exemplary therapies include a alternating pressure therapy, a turning therapy, a low air loss cooling or heating therapy, and other suitable therapies for a patient supported on patient support 100.

Figure 4:
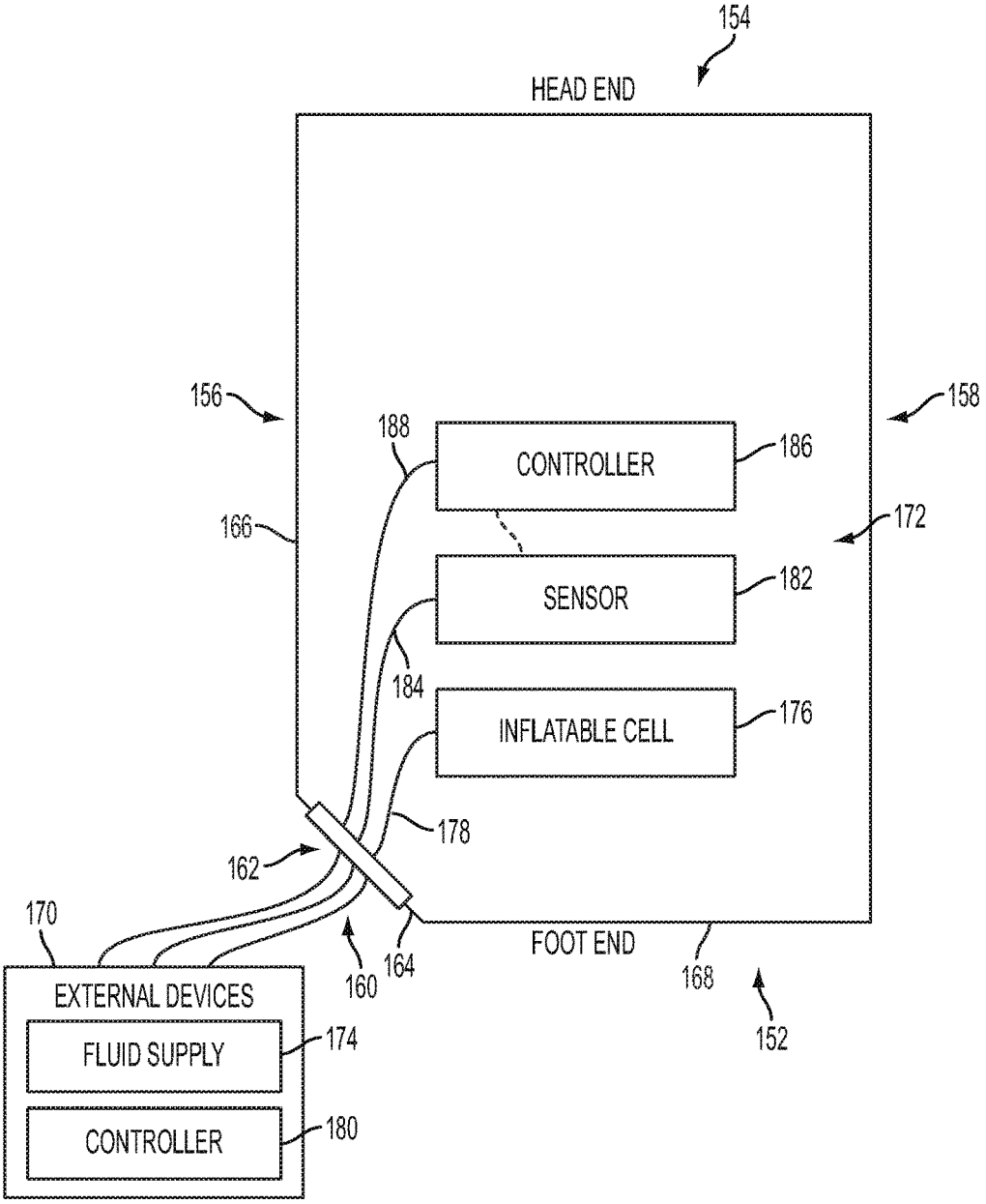
FIG. 4 illustrates a top representative view of a patient support having an interface provided in a side of the patient support.
Figure 4A:
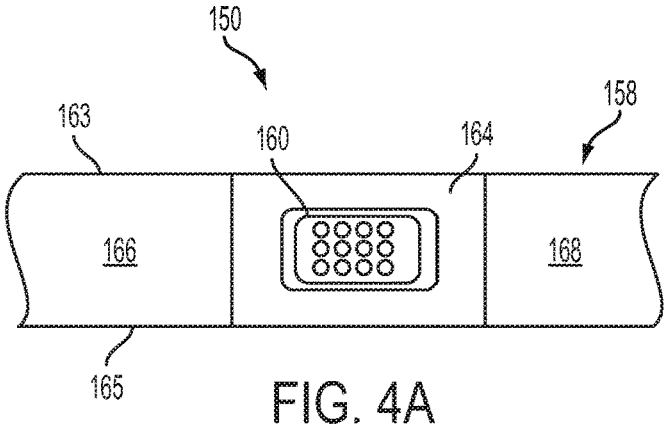
FIG. 4A illustrates a side view of the patient support of FIG. 4 from a lower corner of the patient support.

Referring to FIG. 4, an exemplary patient support 150 is shown. Patient support 100 is one example of patient support 150. Patient support 150 includes a foot end 152, a head end 154, a first side 156 and a second side 158. An interface 160 is provided in a lower corner 162 of patient support 150. As shown in FIG. 4, interface 160 is in a lower corner 162 adjacent first side 156 and foot end 152. Interface 160 is provided in a side 164 of patient support 150. In one embodiment, a top surface 163 (see FIG. 4A) of patient support 150, a bottom surface 165 (see FIG. 4A) of patient support 150, and the plurality of sides extending therebetween the top surface 163 and the bottom surface 165 define an envelope 158 of patient support 150.

Side 164 is illustrated as a chamfer making a 45 degree angle relative to a first longitudinal side 166 of patient support 150 and a foot end side 168 of patient support 150. In one embodiment, side 164 may be at a steeper angle relative to one of first longitudinal side 166 and foot end side 168. In one embodiment, patient support 150 does not include side 164 and interface 160 is provided along first longitudinal side 166, foot end side 168, or a combination thereof generally at the corner of patient support 150. In one embodiment, interface 160 is provided proximate to another corner of patient support 150. In one embodiment, side 164 is provided proximate another corner of patient support 150 and interface 160 is provided through side 164. In one embodiment, interface 160 is provided in a bottom surface of patient support 150.

Interface 160 provides a location whereat one or more external devices 170 may be coupled to one or more internal devices 172 of patient support 150. Exemplary external devices include a fluid supply 174 which may be in fluid communication with one or more inflatable cells 176 of patient support 150 through one or more fluid conduits 178 coupled to interface 160. Another exemplary device is a controller 180 which may be coupled to one or more sensors 182 of patient support 150 through electrical connections 184 coupled to interface 160. Exemplary sensors 182 include pressure sensors monitoring a fluid pressure of an interior of one or more of inflatable cells 176. Further, controller 180 may be coupled to one or more controllers 186 of patient support 150 through electrical connections 188 coupled to interface 160. Other exemplary external devices and internal devices may be provided.

Figure 32:
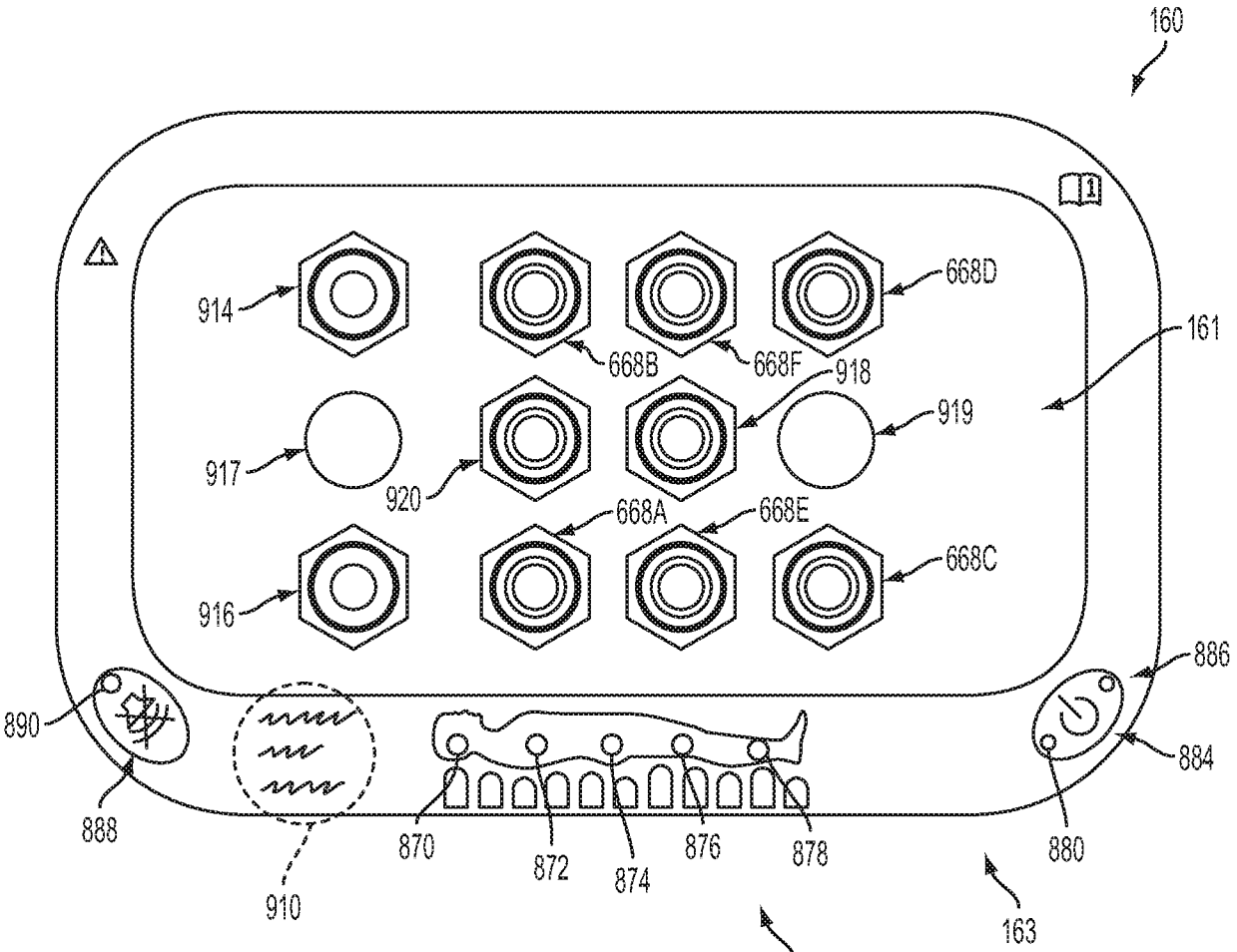
FIG. 32 illustrates a front view of an exemplary interface of the patient support of FIG. 12.

As shown in FIG. 32, an exemplary interface 160 provides both a connector interface 161 and a communication interface 163. The connector interface 161 includes one or more connections to couple one or more external devices 170 to one or more internal devices 172 of patient support 150. The communication interface includes one or more exemplary input devices to receive input commands for controller 186 of patient support 150 and output devices which and communication status information regarding the patient support 150 external to the patient support. Exemplary input devices include switches, buttons, and other suitable input devices. Exemplary output devices include visual devices, like lights, audio devices, like speakers, and other suitable devices for communicating status information. In one embodiment, the communication interface surrounds the connector interface. In one embodiment, the connector interface is recessed relative to the communication interface.

Figure 5:
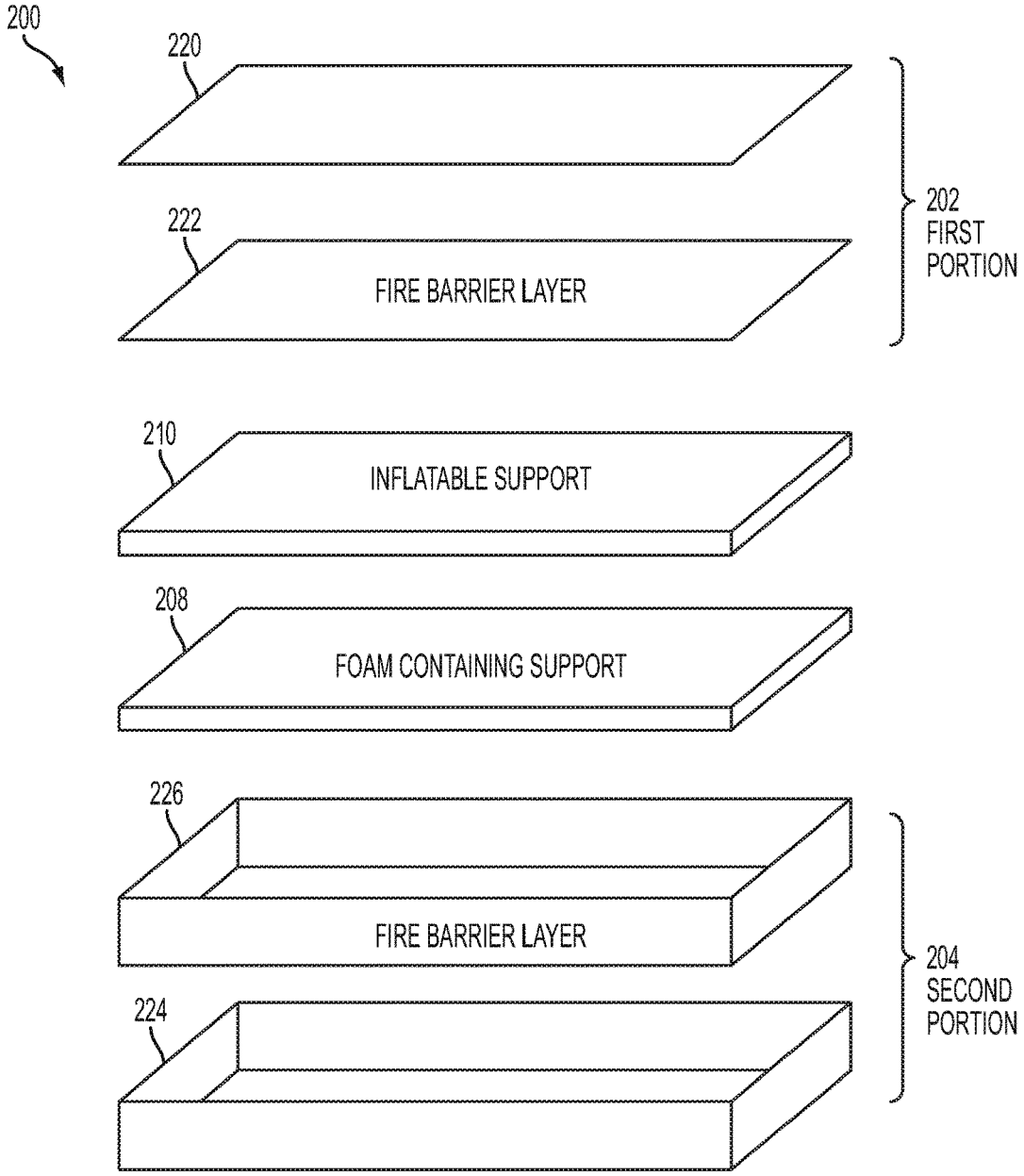
FIG. 5 illustrates an exploded representative view of a patient support including a fire barrier layer.

Referring to FIG. 5, an exemplary patient support 200 is shown. Patient support 100 is one example of patient support 200. Patient support 200 includes a first portion 202 and a second portion 204. First portion 202 and second portion 204 cooperate to define an interior 206 (see FIG. 5A) of patient support 200. Within interior 206 of patient support 100 are positioned a foam containing support 208 and an inflatable support 210. In one embodiment, support 208 and inflatable support 210 are separate support members. The separate support members may be arranged such that one of the support members supports the other support member (see FIG. 5A) or in a side-by-side relationship. In one embodiment, support 208 and inflatable support 210 are a part of the same support member. In one example, support 208 is contained within inflatable support 210. One exemplary embodiment of support 208 being contained within inflatable support 210 is the inflatable cell 400 illustrated in FIG. 9 and discussed in more detail herein.

Figure 5A:
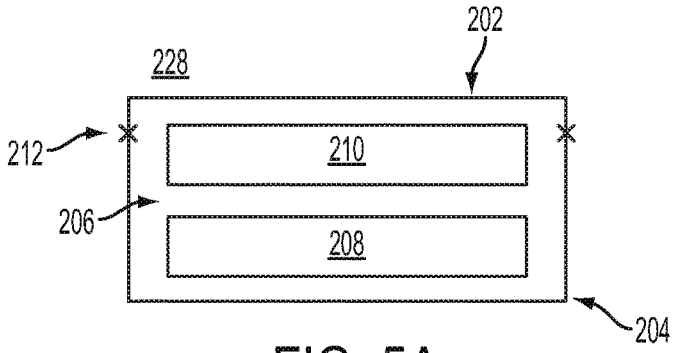
FIG. 5A illustrates an exemplary sectional view of the patient support of FIG. 5.

Referring to FIG. 5A, first portion 202 is removably coupled to second portion 204 through a coupler 212. Exemplary couplers include a zipper, snaps, buttons and button holes, and other suitable devices for securing first portion 202 to second portion 204. As illustrated in FIG. 5, first portion 202 is completely seperatable from second portion 204. By at least partially uncoupling first portion 202 from second portion 204, interior 206 may be accessed. In one embodiment, first portion 202 is not completely seperatable from second portion 204, but rather first portion 202 and second portion 204 are connected along at least a portion of at least one side. By coupling first portion 202 to second portion 204 interior 206 of patient support 100 may be closed off from an exterior environment 228 of patient support 100. In the case wherein first portion 202 is coupled to second portion 204 through a zipper, by closing the zipper, interior 206 of patient support 100 is closed off from the exterior environment 228 of patient support 200.

Returning to FIG. 5, first portion 202 includes a base layer 220 and a fire barrier layer 222. Similarly, second portion 204 includes a base layer 224 and a fire barrier layer 226. The respective fire barrier layers 222 and 226 may be coupled to their respective base layers 220 and 224. Exemplary methods of coupling include zipper, snaps, buttons and button holes, and other suitable devices for coupling the layers. In one embodiment, respective fire barrier layers 222 and 226 are sprayed on or otherwise applied to their respective base layers 220 and 224. In one embodiment, the fire barrier layers 222 and 226 are woven into or otherwise made a part of the respective base layers 220 and 224.

When first portion 202 is coupled to second portion 204 the fire barrier layer 222 and fire barrier layer 226 are positioned on all sides of support 208. Therefore, fire barrier layer 222 and fire barrier layer 226 form a fire barrier that surrounds support 208. In the illustrated embodiment, fire barrier layer 222 and fire barrier layer 226 surround both support 208 and inflatable support 210.

In one embodiment, the base layers of first portion 202 and second portion 204 are both made from a flexible material. Exemplary flexible materials include fabric, plastic, elastomers, and other suitable flexible materials. In one embodiment, the first portion 202 is made of a flexible material and the second portion 204 is made from a rigid material. In one embodiment, at least a portion of the base layers of first portion 202 or second portion 204 are made of a rigid material. Exemplary materials for fire barrier layer 222 and base layer 224 include KEVLAR brand material and other suitable fire resistant materials.

Figure 6:
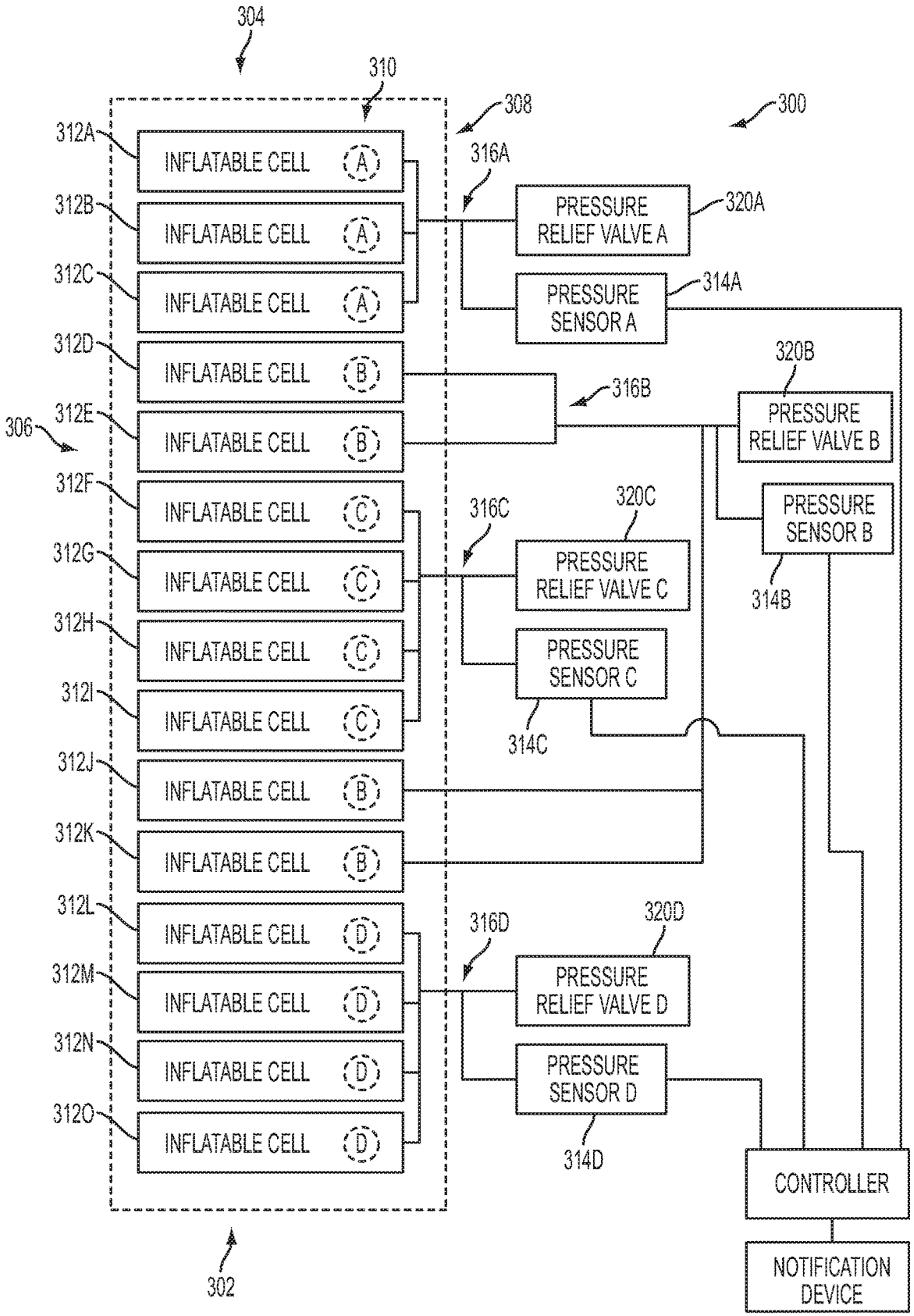
FIG. 6 illustrates an exemplary inflatable cell array which may be included as a portion of a patient support, the inflatable cell array including a plurality of inflatable cells, a plurality of pressure relief valves, a plurality of pressure sensors, a controller, and a notification device.
Figure 7:
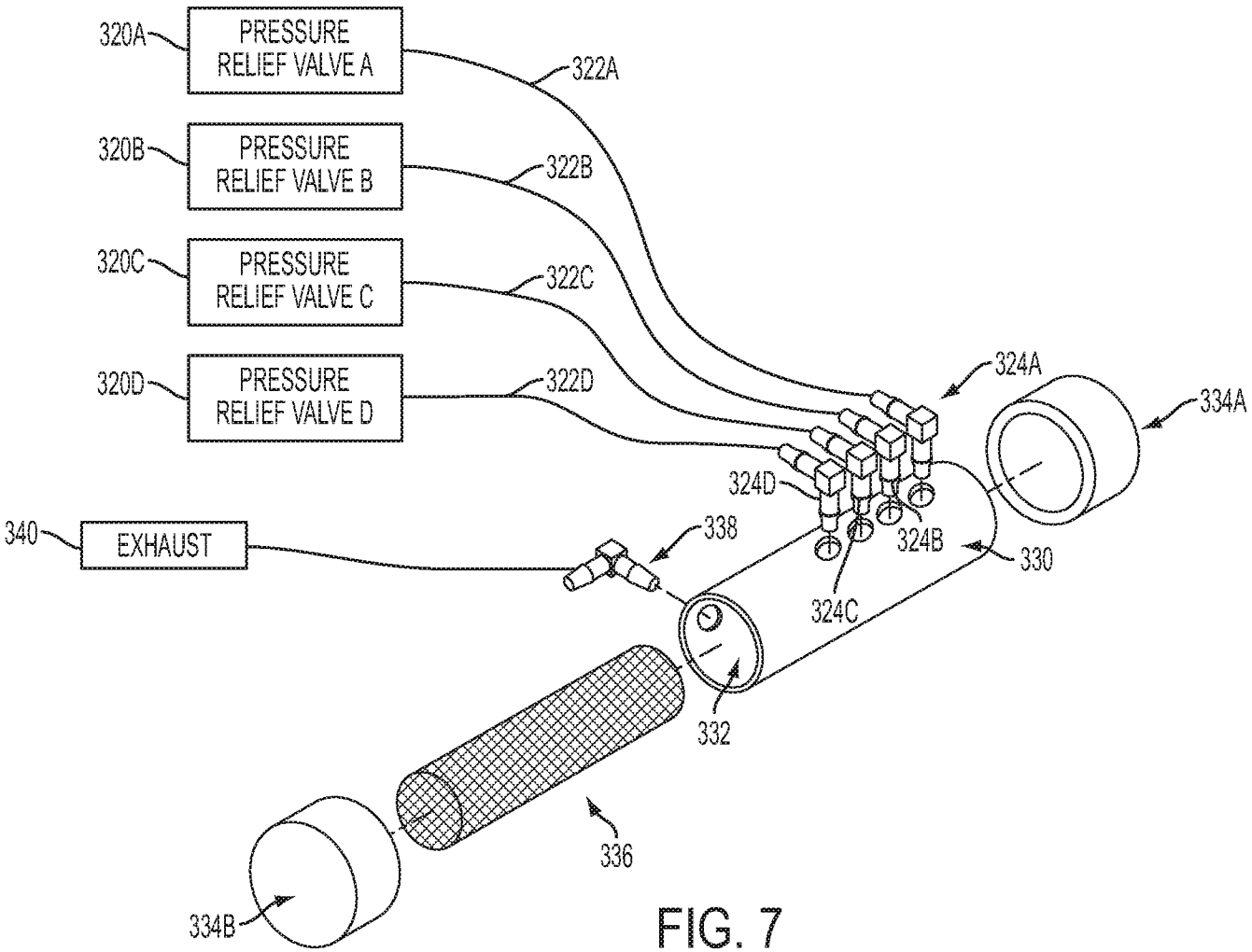
FIG. 7 illustrates an exploded view of an exemplary muffler device.
Figure 8:
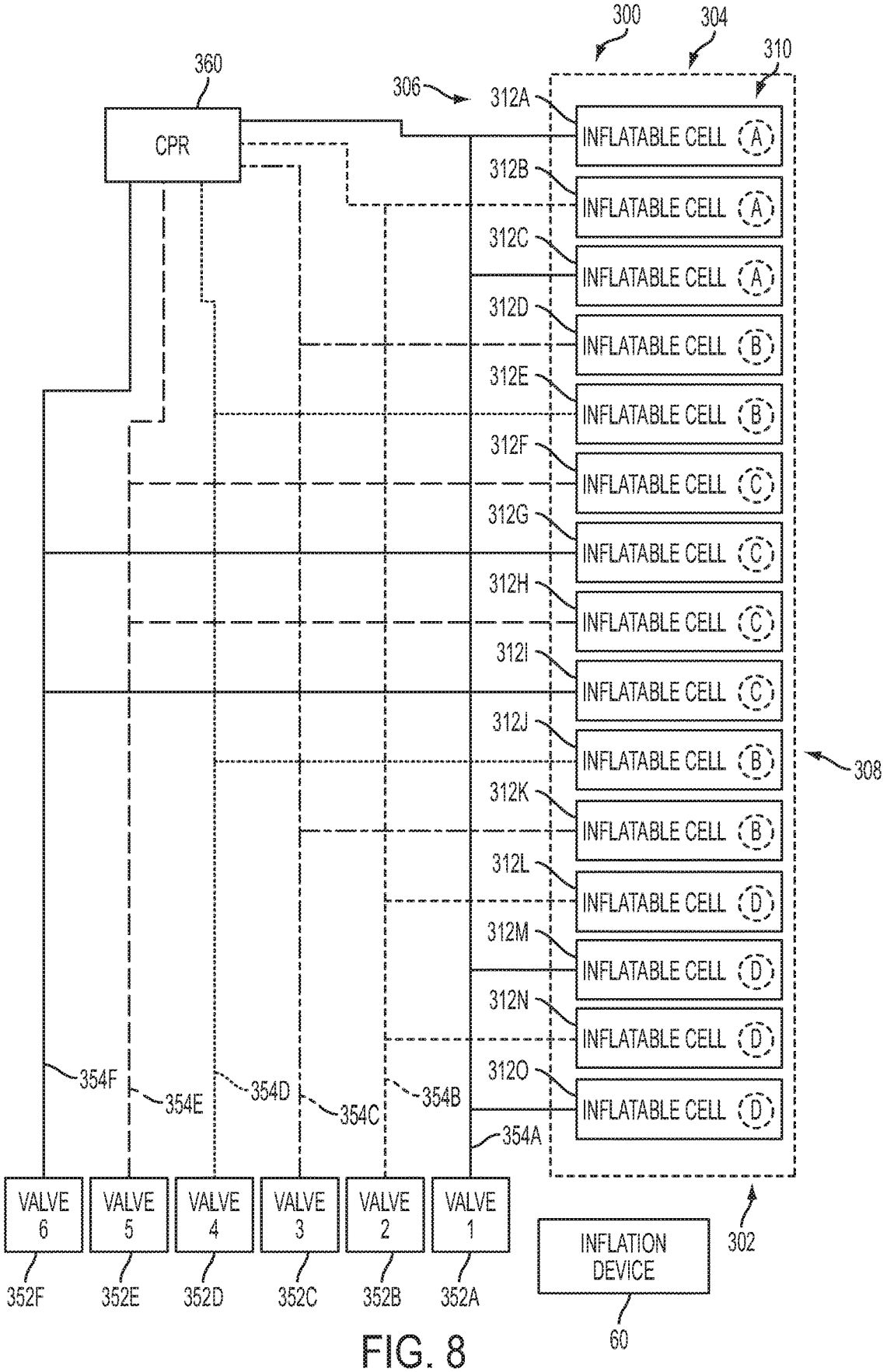
FIG. 8 illustrates the exemplary array of inflatable cells of FIG. 6 in fluid communication with a plurality of valves providing inflation and deflation of the plurality of inflatable cells.

Referring to FIGS. 6-8, an exemplary patient support 300 is shown. In one embodiment, patient support 300 is included as part of patient support 100. Patient support 300 includes a foot end 302, a head end 304, a first side 306 and a second side 308. Patient support 300 includes an array 310 of a plurality of inflatable support cells 312. In the illustrated embodiment, array 310 includes fifteen inflatable support cells 312A-O, each having a first end positioned adjacent first side 306 of patient support 300 and a second end positioned adjacent second side 308 of patient support 300. Array 310 may include more or less inflatable support cells 312. Further, inflatable support cells 312 may be arranged to extend from foot end 302 of patient support 300 to head end 304 of patient support 300 as opposed to from first side 306 of patient support 300 to second side 308 of patient support 300.

Inflatable support cells 312A-O are inflated to one or more pressures above ambient pressure. The pressures within the inflatable support cells 312A-O are monitored by respective pressure sensors 314A-D. In the illustrated embodiment of FIG. 6, the interiors of inflatable cells 312A-C are in fluid communication through a fluid conduit system 316A, the interiors of inflatable cells 312D, 312E, 312J, and 312I are in fluid communication through a fluid conduit system 316B, the interiors of inflatable cells 312F-312I are in fluid communication through a fluid conduit system 316C, and the interiors of inflatable cells 312L-O are in fluid communication through a fluid conduit system 316D. In one embodiment, inflatable support cells 312 and the respective fluid conduit systems 316 form a closed system that generally maintains the inflatable support cells 312 in an inflated state.

Figure 6A:
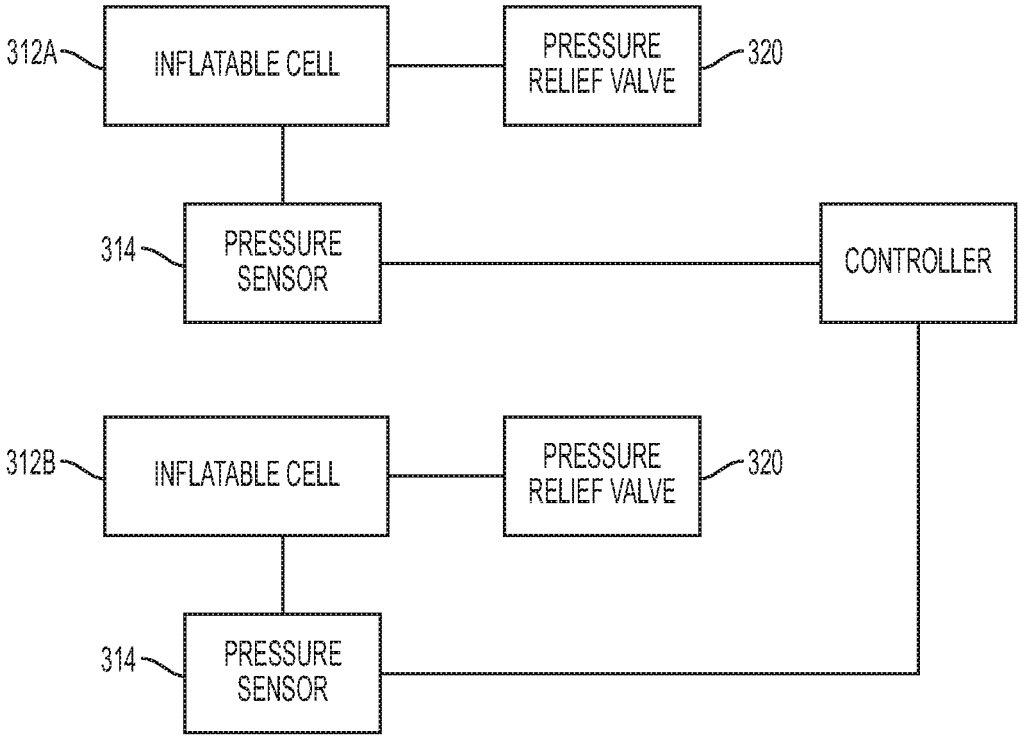
FIG. 6A illustrates an exemplary arrangement of inflatable cells, pressure sensors, and pressure relief valves.

Pressure sensors 314A-D monitor the pressure in fluid conduit system 316A-D, respectively, to monitor the pressure of the interiors of inflatable support cells 312A-O. In one embodiment, the number of pressure sensors 314 may be reduced by coupling more of inflatable support cells 312 together through a common fluid conduit system 316. For example, fluid conduit system 316D may be removed and inflatable support cells 312A-C and inflatable cells 312L-O both be coupled to fluid conduit system 316A resulting in pressure sensors 314A monitoring inflatable support cells 312A-C and inflatable cells 312L-O. Further, the number of pressure sensors 314 may be increased. Referring to FIG. 6A, inflatable support cells 312A and inflatable support cell 312B are represented. Each of inflatable support cells 312A and inflatable support cell 312B include a respective pressure sensor 314 monitoring an interior of the respective inflatable support cells 312.

In one embodiment, a portable inflation unit 60 (see FIG. 3 or FIG. 8) is coupled to an interior of inflatable support cells 312A-O to inflate the respective inflatable support cells 312A-O. Once inflated, the portable inflation unit is uncoupled from inflatable support cells 312A-O. With the portable inflation unit uncoupled, inflatable support cells 312A-O and the respective fluid conduit systems 316 are closed off from the surrounding environment and remain inflated to a pressure above ambient pressure.

In one embodiment, when a pressure in one of the inflatable support cells 312 exceeds a threshold value, the excess pressure is released to the surrounding environment. The pressure within one of inflatable support cells 312 may exceed the threshold value by being over inflated with inflation device 60 or by having a sufficiently high exterior force exerted thereon, such as a heavier patient.

In the illustrated embodiment, each of fluid conduit system 316A-D is in fluid communication with a respective pressure relief valve 320A-D. Each of pressure relief valves 320A-D may be set to a respective threshold pressure and to relieve pressures in the respective fluid conduit system 316A-D when the fluid pressure exceeds the threshold amount. For example, pressure relief valve 320C may be set to a first threshold pressure. When a patient rests on patient support 300, based on the weight and profile of the patient, the pressure in one or more of inflatable cells 312F-I may exceed the first threshold pressure. Pressure relief valve 320C permits a portion of the fluid in the interiors of inflatable cells 312F-I to escape thereby lowering the pressure in inflatable cells 312F-I to a pressure at or below the first threshold pressure. An exemplary pressure relief valve is Model No. 304304PB-0100S020-899 available from Smart Products, Inc., located at 675 Jarvis Drive in Morgan Hill, Calif. 95037.

The threshold pressure of each of pressure relief valve 320A-D may be selected to provide different pressure limits for different portion of patient support 300. For example, a head section of patient support 300 including inflatable support cells 312A-C may be held at or below a first threshold pressure associated with pressure relief valve 320A while a torso section of patient support 300 including inflatable cells 312D and inflatable cells 312E may be held at or below a second threshold pressure associated with pressure relief valve 320B. In one embodiment, each of pressure relief valves 320A-D is set to a unique pressure threshold. In one embodiment, one or more of pressure relief valves 320A-D is set to a common pressure threshold. An exemplary pressure threshold distribution is pressure relief valve 320A is set to about 0.34 psi (18 mm Hg), pressure relief valve 320B is set to about 0.5 psi (26 mm Hg), pressure relief valve 320C is set to about 1.0 psi (52 mm Hg), and pressure relief valves 320D is set to about 0.11 psi (6 mm Hg).

In one embodiment, inflatable cells 312L-O are plumbed together with inflatable cells 312A-C and pressure relief valve 320A is associated with all of the inflatable cells 312A-C and 312L-O. In this embodiment, an exemplary pressure threshold distribution is pressure relief valve 320A is set to about 0.34 psi (18 mm Hg), pressure relief valve 320B is set to about 0.5 psi (26 mm Hg), and pressure relief valve 320C is set to about 1.0 psi (52 mm Hg). Pressure relief valves 320D is not provided since pressure relief valve 320A is plumbed to both inflatable cells 312A-C and 312L-O.

In one embodiment, one or more of pressure relief valves 320A-D may be removed and the respective inflatable support cells 312 tied to one of the remaining pressure relief valves 320. Further, the number of pressure relief valves 320 may be increased. Referring to FIG. 6A, each of inflatable support cells 312A and inflatable support cell 312B have a separate pressure relief valve 320 instead of being in fluid communication with a common pressure relief valve 320.

In the illustrated embodiment, pressure relief valves 320 are stand alone analog pressure relief values whose threshold pressure is set based on the arrangement and mechanical properties of the valve elements. Exemplary analog pressure relief valves include Model No. 304304PB-0100S020-899 available from Smart Products, Inc., located at 675 Jarvis Drive in Morgan Hill, Calif. 95037. In one embodiment, pressure relief valves 320 are electronically controlled valves which may be opened and closed based on the pressure reading of the respective pressure sensors 314.

In one embodiment, each of pressure relief valve 320A-D has an output fluid conduit system 322A-D (see FIG. 7) coupled thereto. The output fluid conduit systems 322A-D are coupled to a respective input port 324A-D of a muffler device 330 as shown in FIG. 7. Ports 324A-D are coupled to a housing 330 having an interior 332. The interior 332 of muffler device 330 is capped by end caps 334A-B which are removably coupled to muffler device 330.

Fluid which is expelled from one or more of pressure relief valves 320A-D passes through the respective output fluid conduit 322A-D and into interior 332 of muffler device 330. A sound reducing member 336 is positioned within interior 332 of muffler device 330. Sound reducing member 336 interacts with the fluid entering interior 332 of patient support 300 to reduce the audible characteristics of the fluid flow. Eventually the fluid may exit interior 332 of muffler device 330 through an exhaust port 338 coupled to muffler device 330. Exhaust port 338 leads to an exhaust 340 whereat the fluid is expelled to the surrounding environment. Exemplary sound reducing member 336 includes sound reducing materials such as foam, open cell materials, solid materials, and other suitable materials to reduce the audible characteristics of the fluid flow. In one embodiment, the sound reducing member 336 includes one or more baffles inside of the muffler device. In one embodiment, muffler device 330 and end caps 334A-B are made of PVC.

As mentioned herein, the inflatable support cells 312A-O of patient support 300 may be inflated with a portable inflation device 60. Referring to FIG. 8, a plurality of fill valves 352A-F are coupled to respective groups of inflatable support cells 312 through respective fluid conduit systems 354A-F. In one embodiment, each of fill valves 352 has an open state whereby fluid may ingress or egress relative to the respective fluid conduit system 354 and a closed state wherein fluid may not ingress or egress relative to the respective fluid conduit system 354. When fluid supply unit 40 or inflation device 60 is coupled to a respective fill valve 352, the respective fill valve is placed in the open state. Otherwise, the fill valve is in the closed state.

Illustratively fluid conduit system 354A connects inflatable support cell 312A, inflatable support cell 312C, inflatable cell 312M, and inflatable cell 312O to fill valve 352A; fluid conduit system 354B connects inflatable support cell 312B, inflatable support cell 312L, and inflatable cell 312N to fill valve 352B; fluid conduit system 354C connects inflatable cell 312D and inflatable cell 312K to fill valve 352C; fluid conduit system 354D connects inflatable cell 312E and inflatable cell 312J to fill valve 352D; fluid conduit system 354E connects inflatable cell 312F and inflatable cell 312H to fill valve 352E; and fluid conduit system 354F connects inflatable support cell 312G and inflatable cell 312I to fill valve 352F. By connecting the portable inflation unit 60 to one of fill valves 352, the pressure in the corresponding inflatable support cells 312 may be raised. The illustrated arrangement of fill valves 352 and fluid conduit system 354 results in the ability to raise the pressure in every other inflatable support cells 312 by coupling portable inflation unit 60 to either a first group including fill valve 352A, fill valve 352C, and fill valve 352E or a second group including fill valve 352B, fill valve 352D, and fill valve 352F.

Each of fluid conduit systems 354 is coupled to a CPR release 360. CPR release 360 includes a handle 361 (see FIG. 2 for patient support 100) that may be pulled or twisted. As a result of the handle 361 being pulled or twisted, each of fluid conduit systems 354 is in fluid communication with the ambient atmosphere around patient support 300 through one-way check valves resulting in inflatable support cells 312 being deflated to provide a firmer support for administering CPR to a patient supported by patient support 300.

In the illustrated embodiment, the inflatable support cells 312 in a head portion of patient support 300, illustratively inflatable support cells 312A-C, and the inflatable support cells 312 in a lower leg or foot portion of patient support 300, illustratively inflatable cells 312L-O, are tied together such that an inflation of a cell 312 in one of the head portion or the lower leg portion results in an inflation in the other of the head portion and the lower leg portion. As such, one of pressure relief valves 320A and 320D may be removed and fluid conduit system 316A and fluid conduit system 316D be tied together. In one embodiment, each of inflatable support cells 312 includes a check valve to prevent fluid flow from the interior of the inflatable support cells 312 back into the respective fluid conduit system 354.

In one embodiment, inflatable support cells 312 do not include check valves and the respective inflatable support cells 312 coupled together through the respective fluid conduit system 354 are maintained at the same pressure. As explained in more detail herein, in this arrangement a fluid supply unit 40 (see FIG. 1) may be coupled to fill valves 352A-F to provide an alternating therapy with inflatable support cells 312A-O wherein the cells 312 are inflated and deflated according to an alternating pressure therapy profile.

Figure 9:
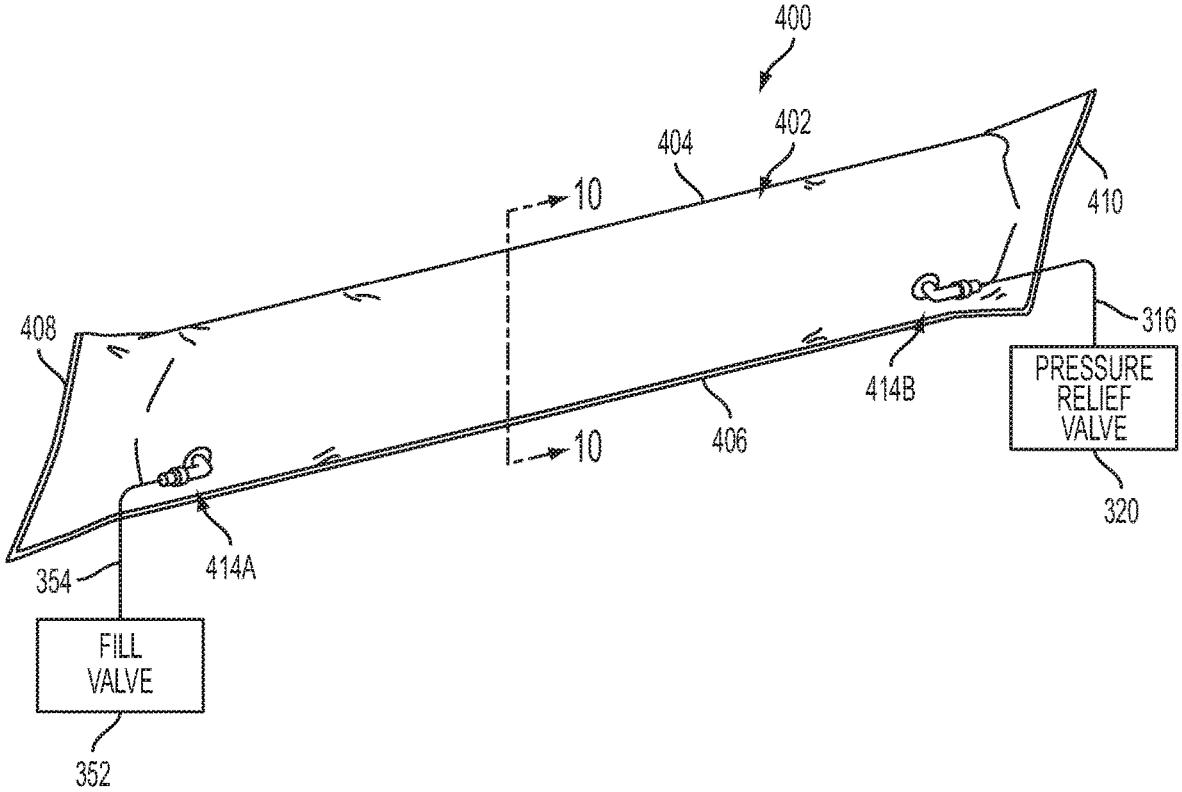
FIG. 9 illustrates a perspective view of an exemplary inflatable cell having a core including foam.
Figure 10:
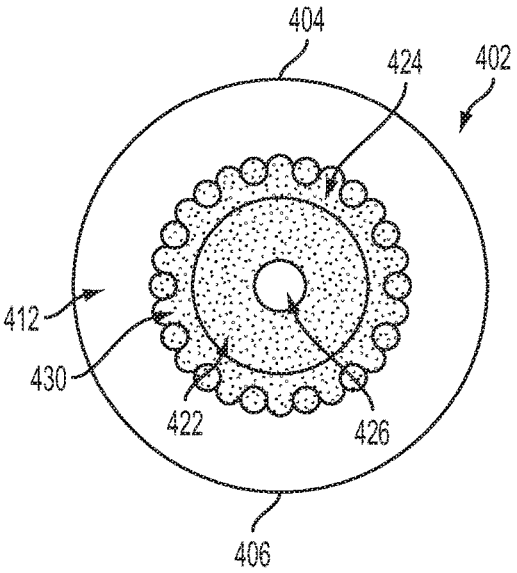
FIG. 10 illustrates a sectional view of the inflatable cell of FIG. 9 along lines 10-10 in FIG. 9.
Figure 11A:
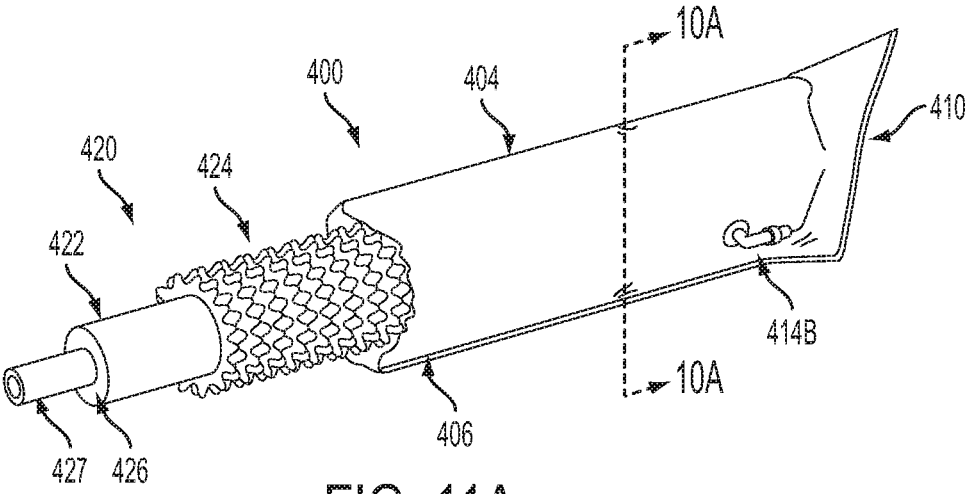
FIG. 11A illustrates a perspective view of another exemplary inflatable cell with a portion of a cell wall removed and a portion of the core member removed.
Figure 11B:
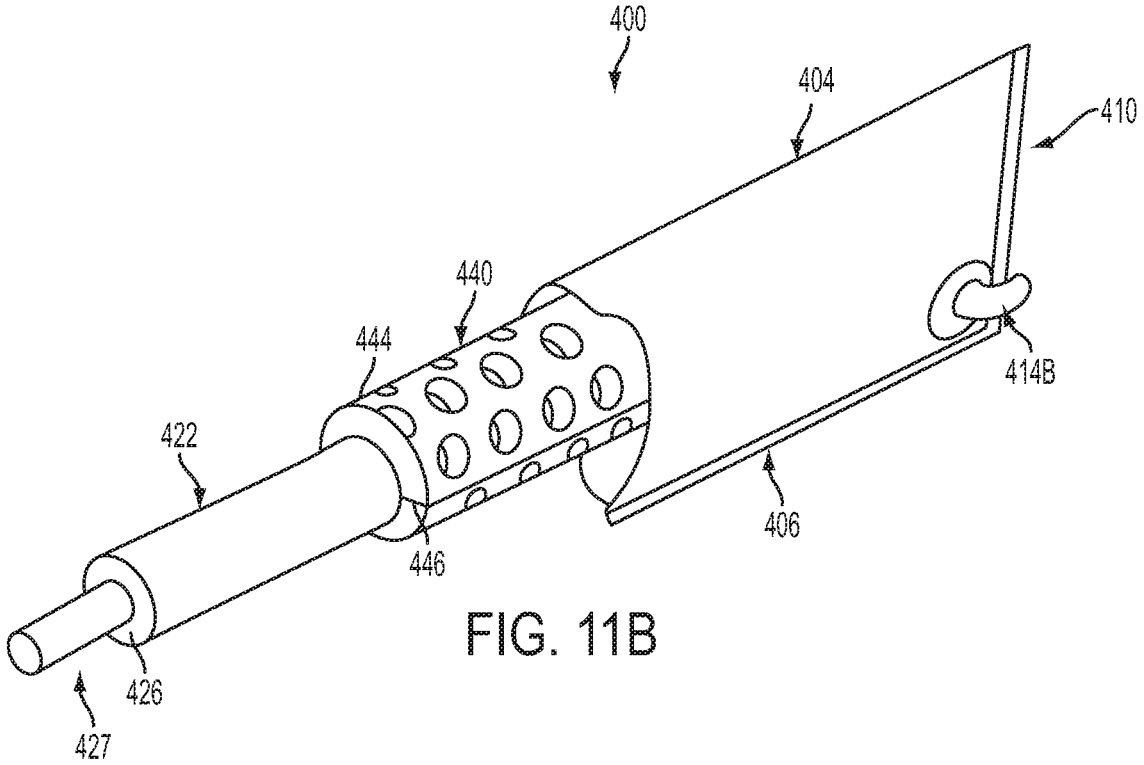
FIG. 11B illustrates a perspective view of yet another exemplary inflatable cell with a portion of a cell wall removed and a portion of the core member removed.
Figure 11C:
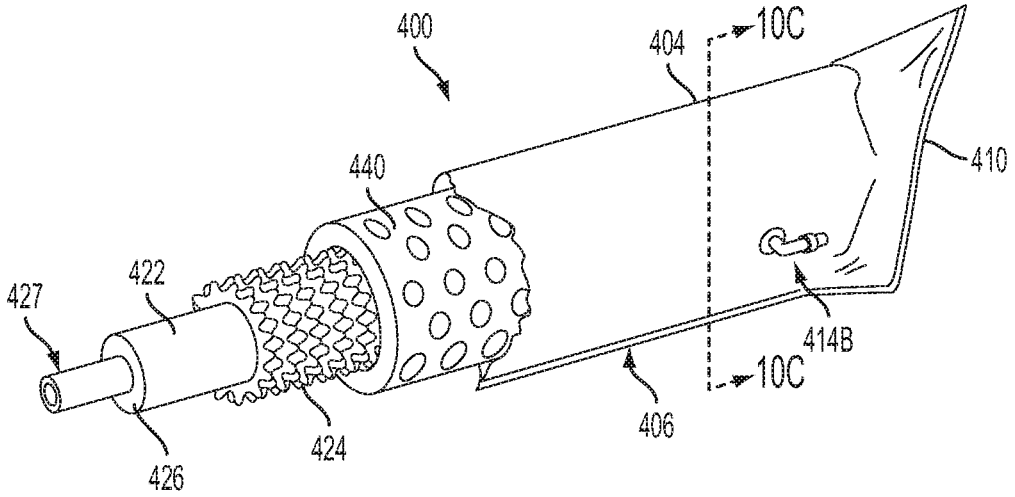
FIG. 11C illustrates a perspective view of still another exemplary inflatable cell with a portion of a cell wall removed and a portion of the core member removed.
Figure 11D:
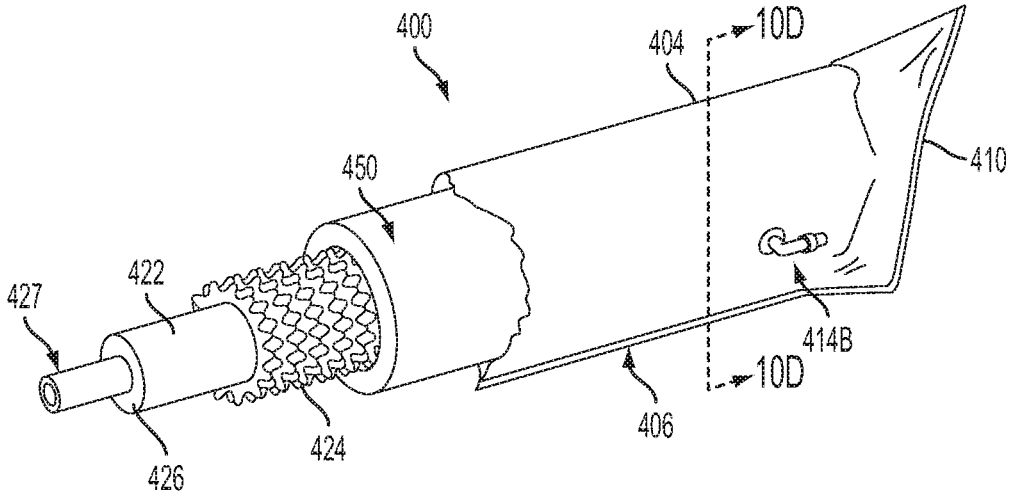
FIG. 11D illustrates a perspective view of yet still another exemplary inflatable cell with a portion of a cell wall removed and a portion of the core member removed.
Figure 11:
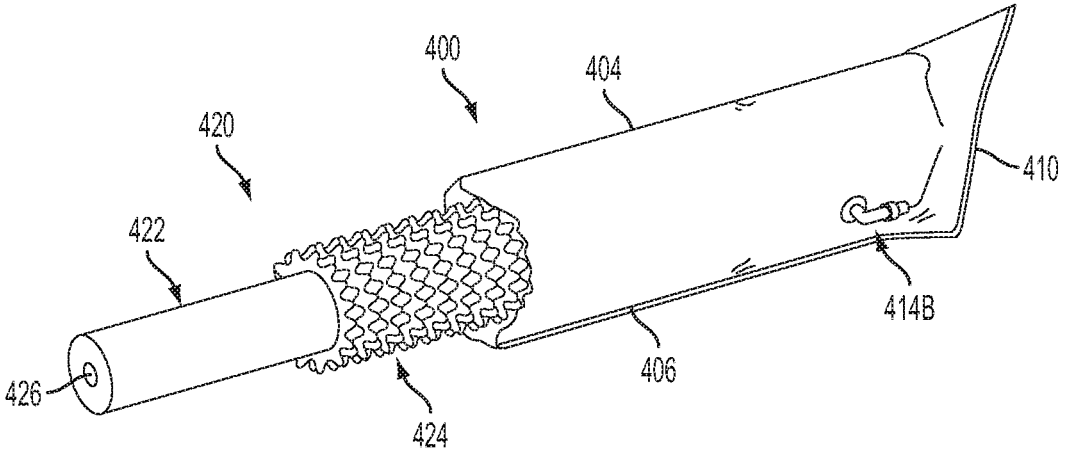
FIG. 11 illustrates a perspective view of the inflatable cell of FIG. 9 with a portion of a cell wall removed and a portion of the core member removed.

Referring to FIGS. 9-11, an inflatable support cell 400 is shown. In one embodiment, inflatable support cell 400 may be used in patient support 300 for inflatable support cells 312. Referring to FIG. 9, inflatable support cell 400 includes a flexible wall 402. In one embodiment, flexible wall 402 is made from a piece of material folded to form a top portion 404 of wall 402 and sealed to form a lower portion 406, a first end portion 408, and a second end portion 410. Fluid is communicated relative to an interior 412 (see FIG. 10) of cell 400 through a fluid connector 414A or a fluid connector 414B. In one embodiment, cell wall 402 is made from a urethane coated material.

In one embodiment, fluid connector 414A is coupled to a fill valve 352 and fluid connector 414B is coupled to a pressure relief valve 320. Fluid is communicated from fill valve 352 through a fluid conduit system 354 to interior 412 through fluid connector 414A to inflate inflatable support cell 400. Further, fluid may exit interior 412 through fluid connector 414A and out of fill valve 352, if fill valve 352 is in an open state to deflate inflatable support cell 400. When the fluid pressure in interior 412 exceeds a threshold pressure associated with pressure relief valve 320, the pressure relief valve opens to permit a portion of the fluid within interior 412 of inflatable support cell 400 to exit and lower the pressure within interior 412 of inflatable support cell 400.

In one embodiment, inflatable support cell 400 is an inflatable cell having an interior 412 void of any materials other than the fluid used to pressurize inflatable support cell 400. In one embodiment, inflatable support cell 400 includes a core member within interior 412. This core member provides support to the patient even when inflatable support cell 400 is deflated or at a low pressure which results in top portion 404 contacting a top portion of the core member. The core member is made from one or more materials which compress under a load and return to its uncompressed shape when the load is removed. An exemplary material is foam. Other suitable materials include any resilient materials, such as foams, rubber, gel, and other suitable materials.

In the illustrated embodiment of FIGS. 10 and 11, the core member is a foam core 420. Foam core 420 includes one or more foam materials which support the patient when inflatable support cell 400 is deflated or at a low pressure which results in top portion 404 contacting a top portion of foam core 420. Other suitable core members include any resilient materials, such as foams, rubber, gel, and other suitable materials.

Referring to FIG. 11, foam core 420 includes a first foam core member 422 and a second foam core member 424. The second foam core member 424 may be secured to the first foam core member in a plurality of ways. In one example, the second foam core member 424 is coupled to the first foam core member with an adhesive. In one embodiment, foam core 420 is made of a unitary foam member. In one embodiment, foam core 420 includes at least three foam members. In one embodiment, the core member includes a plurality of members, at least one of which is a foam member.

Referring to FIG. 10, first foam core member 422 is received within an opening of second foam core member 424 resulting in second foam core member 424 surrounding first foam core member 422. In one embodiment, second foam core member 424 does not completely surround first foam core member 422. In one embodiment, second foam core member 424 is wrapped around the first foam core member. First foam core member 422 includes a central opening 426 which extends through first foam core member 422. In one embodiment, the central opening extends only partially through first foam core member 422. Central opening 426 provides an additional volume within interior 412 of inflatable support cell 400 that may be filled by the fluid within inflatable support cell 400. Additional openings may be included in the core member. Further, central opening 426 may be not centrally located. In one embodiment, first foam core member 422 is fluted to provide air gaps or voids between first foam core member 422 and second foam core member 424. In one embodiment, first foam core member 422 is generally solid and does not include central opening 426. In one embodiment, first foam core 422 includes a plurality of openings similar to central opening 426. These openings may extend the entire length of first foam core 422 or may have a blind depth. Although two foam cores are illustrated, three or more foam cores may be implemented.

First foam core member 422 and second foam core member 424 may be made from the same foam material or differing foam materials. In one embodiment, the densities of one or both of the first foam core 422 and the second foam core 424 are selected based on a weight of an intended user of the patient support. The first foam core 422 and the second foam core 424 provide support for the user when the corresponding cell 400 is deflated or otherwise compressed. As such, by selecting the densities of the first foam core 422 and the second foam core 424, the patient support is tailored to a particular expected patient weight. In one embodiment, foam core member 422 has a density of 1.8, 18 compression, and foam core member 424 has a density of 1.2, 38 compression. An exemplary foam core member 422 is Model No. GM18018CM available from G&M Foam Corporation located at 2321 Arrow Highway in La Verne, Calif. 91750. An exemplary foam core member 424 is Model No. GM12038CM available from G&M Foam Corporation located at 2321 Arrow Highway in La Verne, Calif. 91750.

Figure 11E:
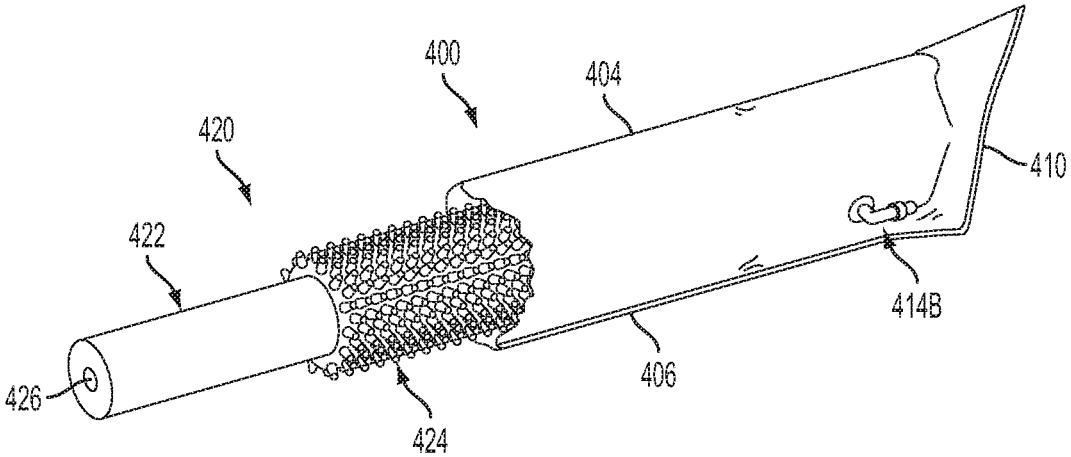
FIG. 11E illustrates a perspective view of the another exemplary inflatable cell with a portion of a cell wall removed and a portion of the core member removed.

Returning to FIG. 10, foam core 420 includes a plurality of projections 430 extending from second foam core member 424. The plurality of projections 430 extend radially outward from second foam core member 424. As shown in FIGS. 10 and 11, projections 430 are arranged in a plurality of rows around second foam core member 424. In one embodiment, the projections 430 of each row are generally aligned with the projections of the adjacent rows. In the illustrated embodiment, the projections 430 of a respective row are offset relative to the projections 430 of an adjacent row. In one embodiment, the projections 430 are not arranged in rows. In one embodiment, each projection 430 has generally the same shape. In one embodiment, each projection has a height to width ratio of about 1:1. In one embodiment, each projection has a height to width ratio of about 2:1. In one embodiment, each projection is rotationally symmetric. In one embodiment, the projections are spaced apart pillars. Exemplary spaced apart pillars are illustrated in FIG. 11E.

An advantage, among others, provided in one embodiment is that by first foam core member 422 having central opening 426 additional fluid is trapped in the interior 412 of cell 400. An advantage, among others, provided in one embodiment is that by first foam core member 422 having central opening 426 the pressurized fluid in the central opening 426 increases the stiffness of the foam core 420. An advantage, among others, provided in one embodiment is that by second foam core member 424 having spaced apart projections 430 the spaces between the projections trap additional fluid in the interior 412 of the cell 400. Exemplary fluid is air.

Figure 10A:
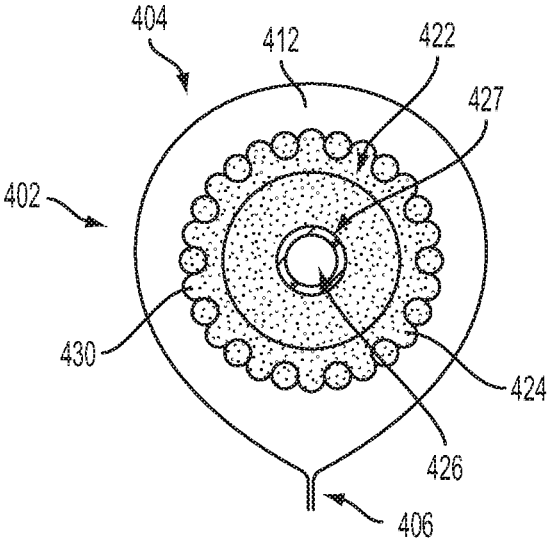
FIG. 10A illustrates a sectional view of the inflatable cell of FIG. 11A along lines 10A-10A in FIG. 11A.

In one embodiment, the central opening 426 is bound by a member 427 (see FIG. 10A and FIG. 11A) to prevent the collapsing of central opening 426. Exemplary members 427 include tubes or other support structures. Exemplary materials for member 427 include silicone tubing, metal tubing, PVC tubing, and other suitable tubings and structures. Member 427 maintains central opening 426 in an open configuration even as the resilient material of core member 422 and the core member 424 is compressed. An advantage, among others, provided in one embodiment is that the member 427 by maintaining opening 426 in an open configuration, air may be present in central opening 426 even while resilient material of core member 422 and the core member 424 is compressed.

Figure 10B:
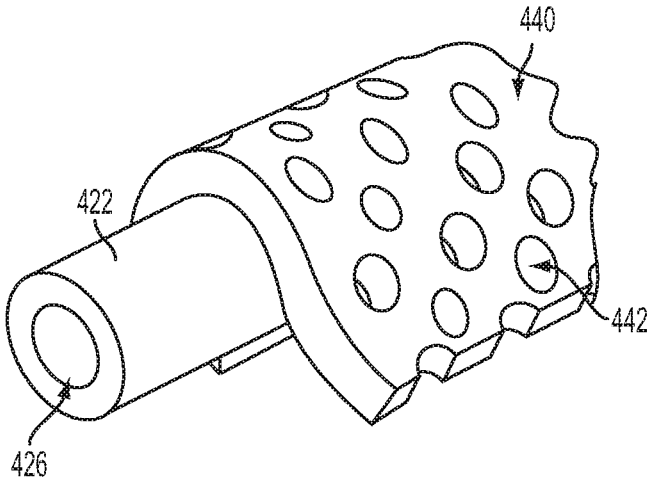
FIG. 10B illustrates a partial assembly view of the core member of FIG. 11B.

In one embodiment, illustrated in FIGS. 10B and 11B, the second core member 424 is replaced with another core member 440 which has a generally constant outer diameter 444 and includes a plurality of recesses 442 which extend radially through second core member 440. As shown in FIG. 10B, second core member 440 is a flat sheet of material with a plurality of holes 442 extending there through. The flat sheet of material is wrapped around first core member 422. The ends of the flat sheet of material form a seam 446. The second core member 440 may be secured to first core member 422 in any suitable manner. Second core member 440 may be made of any suitable resilient material. In one embodiment, second core member 440 is made of foam.

Figure 10C:
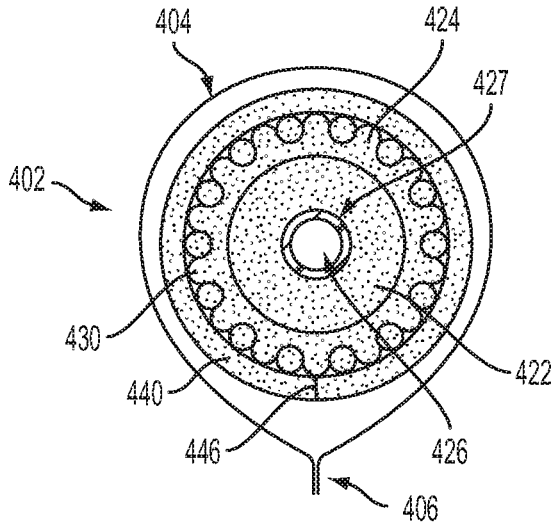
FIG. 10C illustrates a sectional view of the inflatable cell of FIG. 11C along lines 10C-10C in FIG. 11C.

In one embodiment, illustrated in FIGS. 10C and 11C, an embodiment of inflatable cell 400, with four core members is shown. As shown in FIGS. 10C and 11C, first core member 422 receives member 427 and first core member is surrounded by second core member 424. The second core member 424 is surrounded by core member 440. The spaces or voids between second core member 424 and core member 440 provide additional volume within the core member for air to be present.

Figure 10D:
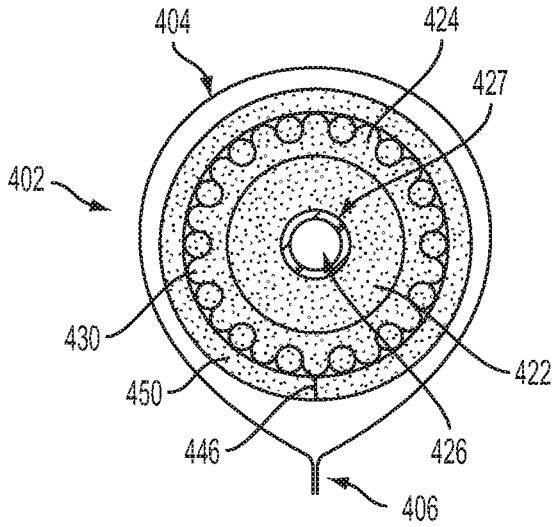
FIG. 10D illustrates a sectional view of the inflatable cell of FIG. 11D along lines 10D-10D in FIG. 11D.

In one embodiment, illustrated in FIGS. 10D and 11D, an embodiment of inflatable cell 400, with four core members is shown. As shown in FIGS. 10D and 11D, first core member 422 receives member 427 and first core member is surrounded by second core member 424. The second core member 424 is surrounded by a core member 450. Core member 450 is an example of core member 440 without the radial recesses 442 provided therein. The spaces or voids between second core member 424 and core member 450 provide additional volume within the core member for air to be present.

Figure 12:
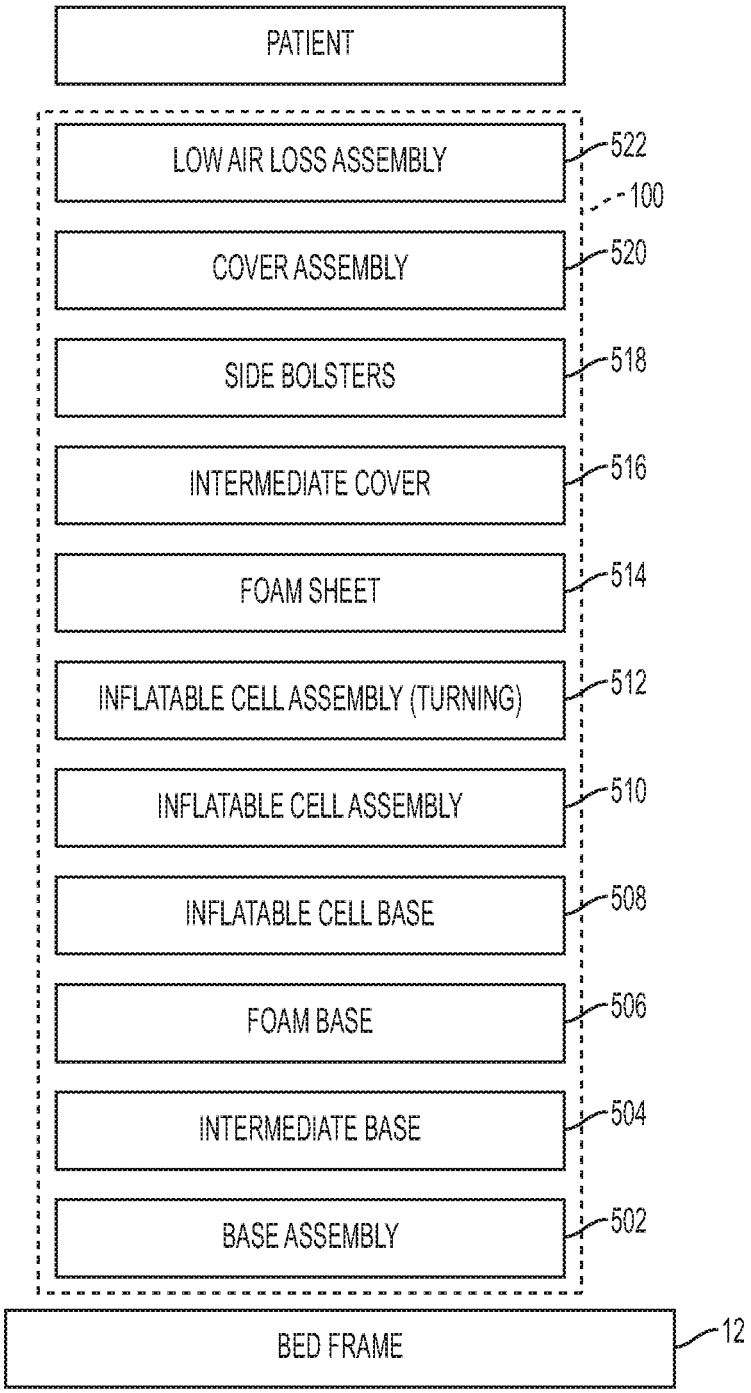
FIG. 12 illustrates a representative view of an exemplary embodiment of the patient support of FIG. 2.

Referring to FIG. 12, an exemplary embodiment of patient support 100 is represented. Patient support 100 is supported on a bed frame 12. Patient support 100 includes a plurality of support components. Exemplary support components include a base assembly 502, an intermediate base 504, a foam base 506, an inflatable cell base 508, an inflatable cell assembly 510, a turning cell assembly 512, a foam sheet 514, an intermediate cover 516, side bolsters 518, a cover assembly 520, and a low air loss assembly 522. Patient support 100 may include additional support components or fewer support components. Further, the arrangement of support components may be altered. In one embodiment, patient support 100 includes the following support components a base assembly 502, an intermediate base 504, a foam base 506, an inflatable cell base 508, an inflatable cell assembly 510, a turning cell assembly 512, a foam sheet 514, an intermediate cover 516, side bolsters 518, and a cover assembly 520. In one embodiment, patient support 100 includes the following support components a base assembly 502, an intermediate base 504, a foam base 506, an inflatable cell base 508, an inflatable cell assembly 510, a foam sheet 514, an intermediate cover 516, a cover assembly 520, and a low air loss assembly. In one embodiment, patient support 100 includes the following support components a base assembly 502, an intermediate base 504, a foam base 506, an inflatable cell base 508, an inflatable cell assembly 510, a foam sheet 514, an intermediate cover 516, and a cover assembly 520.

Figure 13:
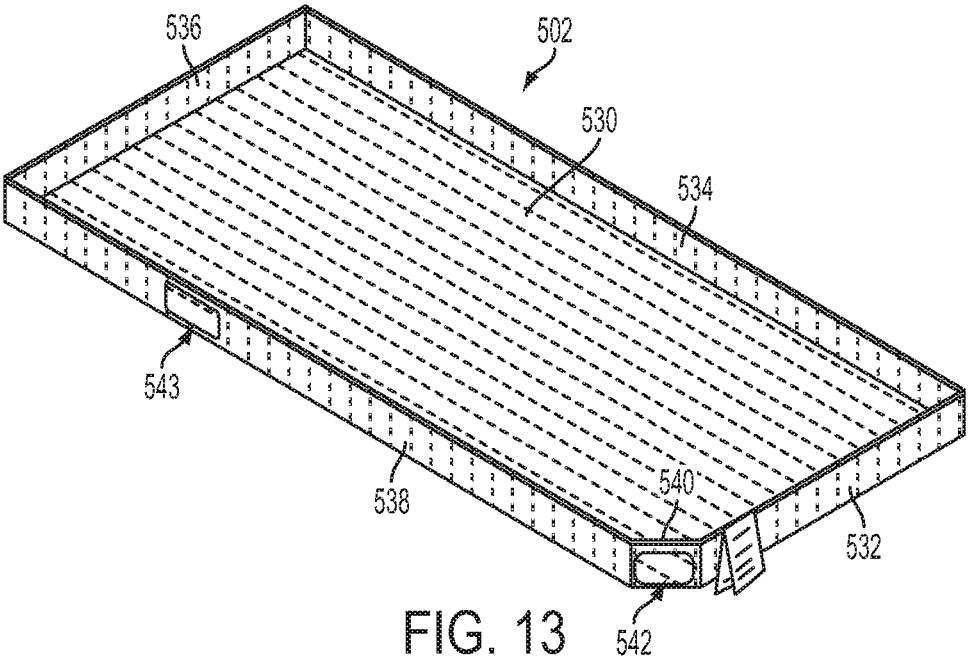
FIG. 13 illustrates an exemplary base assembly of the patient support of FIG. 12.

Exemplary support components of patient support 100 are shown in FIGS. 13-24. Referring to FIG. 13, an exemplary base assembly 502 is illustrated. Base assembly 502 includes a bottom portion 530 and a plurality of side walls 532-540. Side wall 540 has an opening 542 through which interface 102 is accessible or extends. Side wall 538 has an opening 543 through which a CPR handle 361 (see FIG. 2) of a CPR release 360 is accessible or extends.

Figure 14:
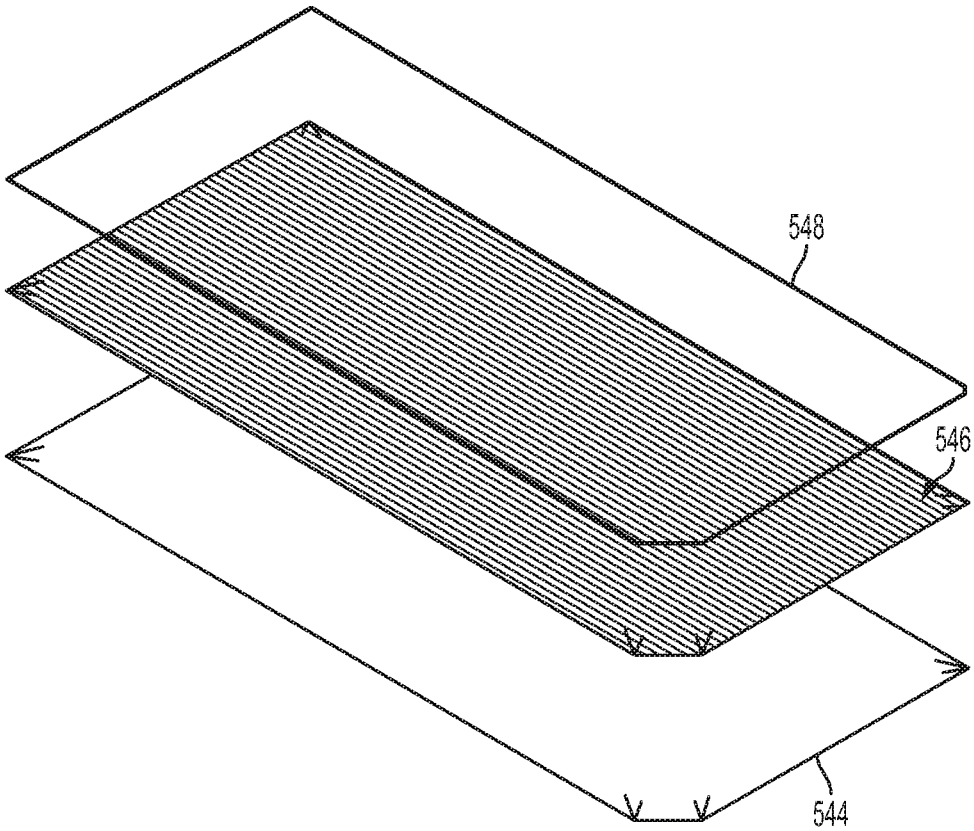
FIG. 14 illustrates an exploded view of the base assembly of FIG. 13.

Referring to FIG. 14, base assembly 502 includes a first layer 544, a second layer 546, and a coupling device 548. Exemplary materials for first layer 544 include vinyl, nylon, and other non-skid materials. In one embodiment, first layer 544 is a waterproof sheet. In one embodiment, first layer 544 is made of a non-skid material. Exemplary materials for second layer 546 include fire retardant materials and other materials. In one embodiment, second layer 546 is a KEVLAR brand material.

In the illustrated embodiment, second layer 546 and first layer 544 are sewn together along with coupling device 548 to form base assembly 502. Other suitable methods of coupling first layer 544 and second layer 546 may be used including bonding with adhesive, zippers, fasteners, and other suitable methods.

In one embodiment, second layer 546 is made of a fire resistant material, such as a KEVLAR brand material. In this embodiment, base assembly 502 may be used as a second portion 204 of patient support 200 (see FIG. 5). In one example, second layer 546 is coupled to first layer 544 and completely lines an interior of first layer 544. In one example, a fire resistant material is sprayed on first layer 544 or otherwise deposited on first layer 544 to form second layer 546.

In one embodiment, coupling device 548 is a portion of a zipper which cooperates with a similar zipper portion of cover assembly 520 (see FIG. 23) to couple cover assembly 520 to base assembly 502 and retain intermediate base 504, foam base 506, inflatable cell base 508, inflatable cell assembly 510, turning cell assembly 512, foam sheet 514, intermediate cover 516, and side bolsters 518 within an interior defined by base assembly 502 and cover assembly 520. Other coupling devices may be used including buttons and button holes, snaps, hook and loop fasteners, and other suitable coupling devices.

Figure 15:
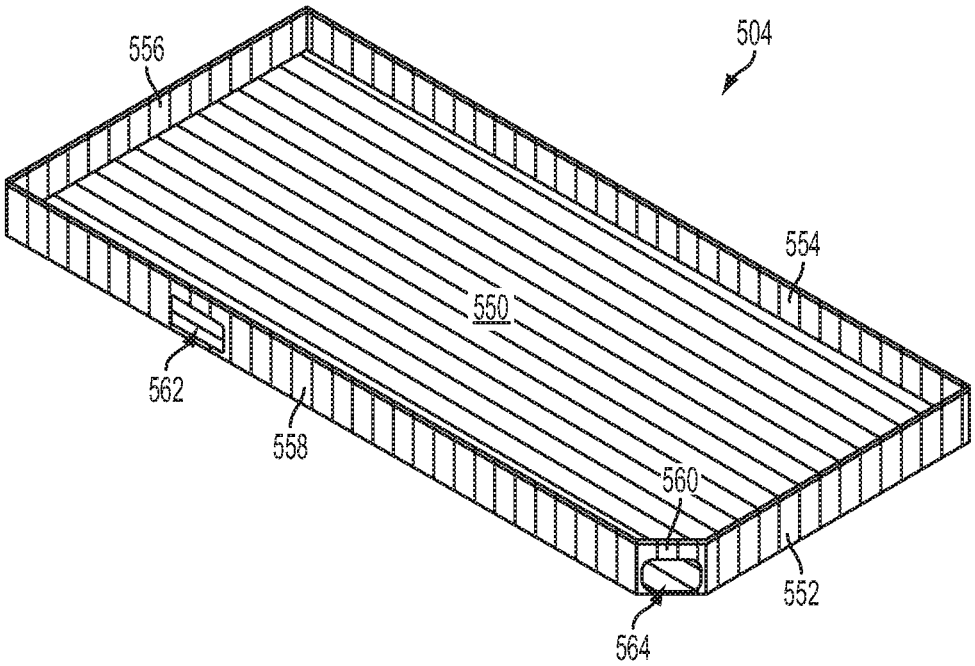
FIG. 15 illustrates an exemplary intermediate base of the patient support of FIG. 12.

Referring to FIG. 15, an exemplary intermediate base 504 is shown. Intermediate base 504 includes a base portion 550 and a plurality of side walls 552-560. Intermediate base 504 includes openings 562 and 564. Through opening 562 CPR handle 361 of CPR release 360 is accessible or extends. Through opening 564 interface 102 is accessible or extends. In one embodiment, intermediate base 504 is made of a stretchable material. In the illustrated embodiment, intermediate base 504 is coupled to top portion 690 (see FIG. 22). Exemplary couplers include zippers, snaps, hook-n-loop fasteners, fasteners, and other suitable devices.

Figure 16:
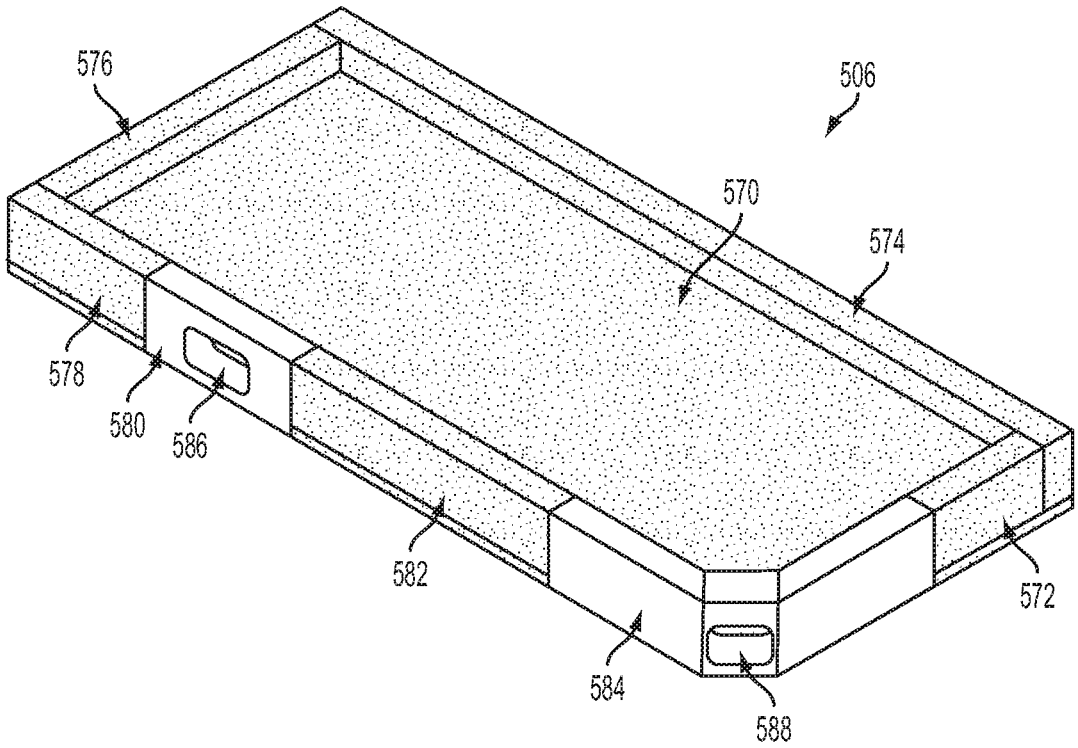
FIG. 16 illustrates an exemplary foam base of the patient support of FIG. 12.

Referring to FIG. 16, an exemplary foam base 506 is shown. Foam base 506 includes a foam base member 570 and a plurality of foam wall members 572-584. Wall members 580 and 584 include respective openings 586 and 588. Through opening 586 CPR handle 361 of CPR release 360 is accessible or extends. Through opening 588 interface 102 is accessible or extends. Wall members 580 and 584 have a fabric member wrapped over the foam to reduce the likelihood of damage. Wall members 572-584 provide an edge to the patient support.

Figure 17:
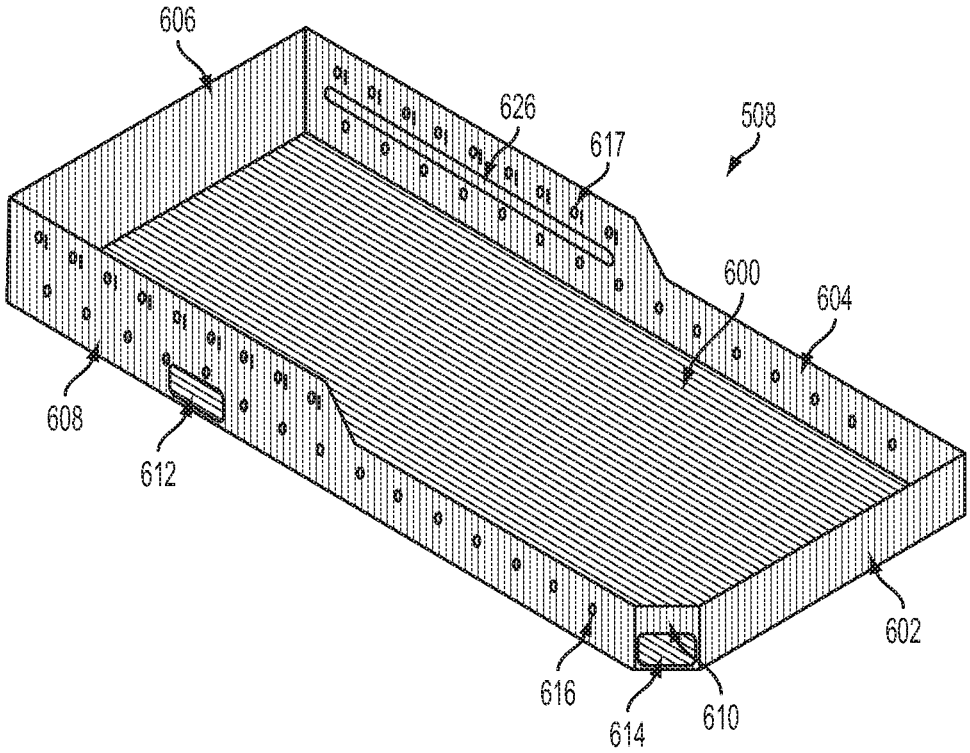
FIG. 17 illustrates an exemplary inflatable cell base of the patient support of FIG. 12.

Referring to FIG. 17, an exemplary inflatable cell base 508 is shown. Inflatable cell base 508 includes a bottom portion 600 and a plurality of side portions 602-610. Inflatable cell base 508 includes openings 612 and 614. Through opening 612 CPR handle 361 of CPR release 360 is accessible or extends. Through opening 612 interface 102 is accessible or extends. Inflatable cell base 508 is received in the recess formed by the wall members 572-584 of foam base 506. Inflatable cell base 508 is supported on foam base member 570.

Inflatable cell base 508 includes a plurality of coupling members 616 provided on side portion 604 and side portion 608 (one marked on side portion 608). These coupling members 616 cooperate with coupling members on inflatable cells 400 (see FIG. 19) of the inflatable base assembly 510 to couple the inflatable cells to inflatable cell base 508. Exemplary coupling members 616 include snap features, hook and loop fasteners, fasteners, zippers, and other suitable coupling members.

Inflatable cell base 508 also includes additional coupling members 617 provided on side portion 604 and side portion 608 (one marked on side portion 604). These coupling members cooperate with coupling members on turning cells 680 (see FIG. 20) of the inflatable cell assembly 512. Exemplary coupling members 616 include snap features, hook and loop fasteners, fasteners, zippers, and other suitable coupling members. As shown, coupling members 617 are offset between adjacent coupling members 616. This arrangement assists in positioning the turning cells 680 in-between adjacent inflatable cells 400.

Figure 18:
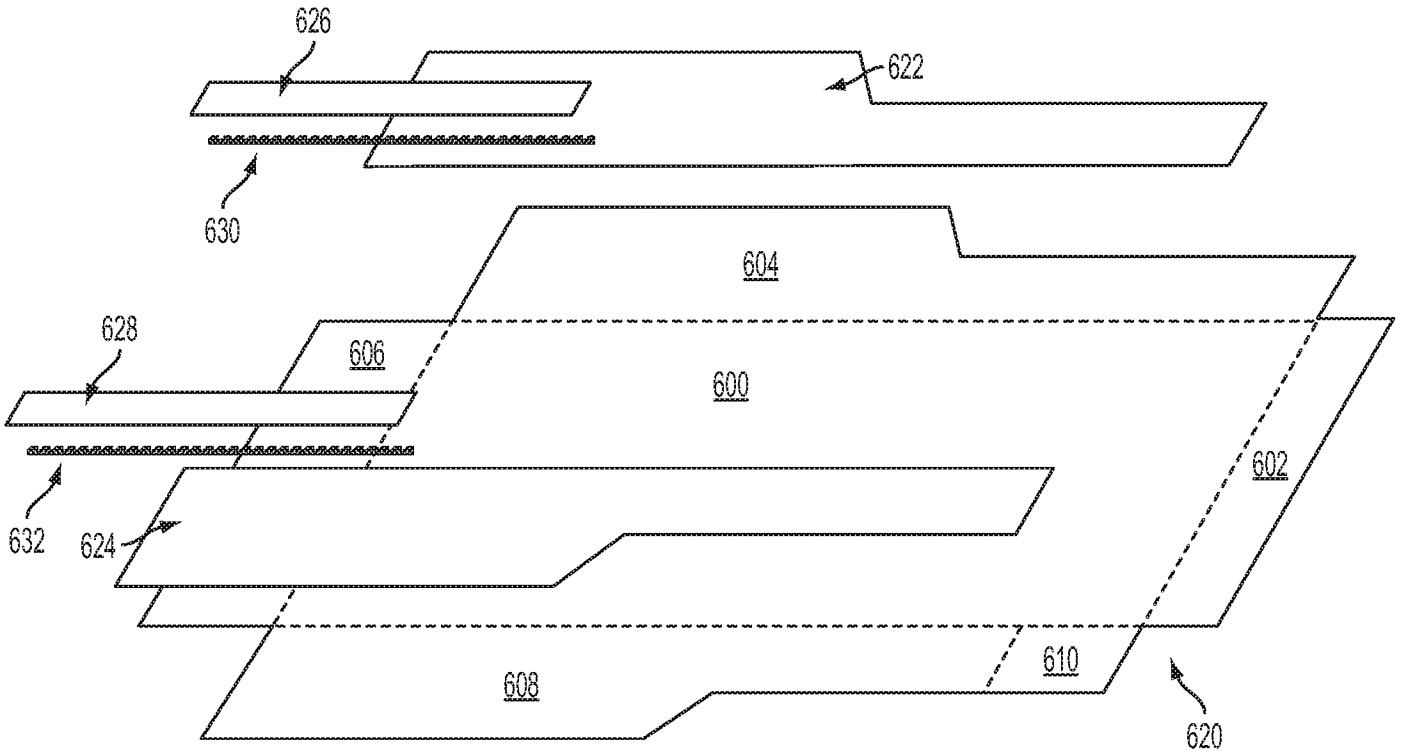
FIG. 18 illustrates an exploded view of the inflatable cell base of FIG. 17.

Referring to FIG. 18, in one embodiment, inflatable cell base 508 includes a base member 620, a first side reinforcement member 622, a second side reinforcement member 624, a first side manifold cover 626, and a second side manifold cover 628. Base member 620 will be cut to include openings 612 and 614. Base member 620 forms bottom portion 600 and side portions 602-610. The portions of base member 620 corresponding to each of bottom portion 600 and side portions 602-610 are generally represented in FIG. 18.

Side portion 604 and side portion 608 are reinforced by coupling first side reinforcement member 622 and second side reinforcement member 624 thereto respectively. In one embodiment, base member 620 is made of a fabric and first side reinforcement member 622 and second side reinforcement member 624 are made of a fabric or other suitable materials. In one embodiment, first side reinforcement member 622 and second side reinforcement member 624 are coupled to base member 620 by sewing first side reinforcement member 622 and second side reinforcement member 624 to base member 620. Other exemplary methods of coupling include zippers, snaps, hook and loop fasteners, and other suitable coupling devices.

In the illustrated embodiment, inflatable cell base 508 is deeper along head side portion 606 than along foot side portions 602. This height shift permits inflatable cell base 508 to accommodate turning cell assembly 512.

First side manifold cover 626 is coupled to side portion 604 with a zipper 630. First side manifold cover 626 holds a plurality of fluid conduits associated with inflatable cell assembly 510 and described herein. In a similar fashion, second side manifold cover 628 is coupled to side portion 608 with a zipper 632. Second side manifold cover 628 also holds a plurality of fluid conduits associated with inflatable cell assembly 510 and described herein.

Figure 19:
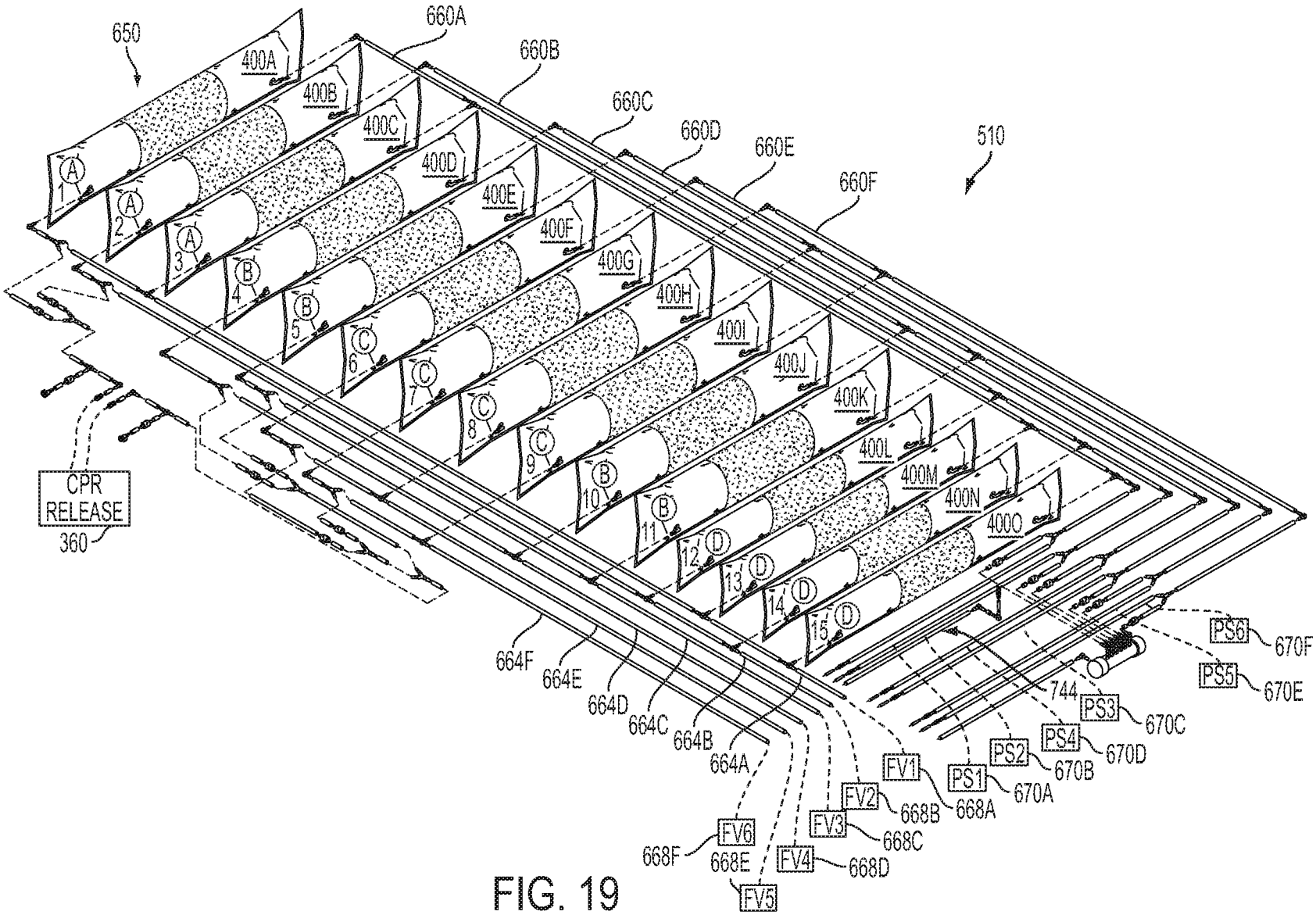
FIG. 19 illustrates an exemplary inflatable cell array of the patient support of FIG. 12.

Referring to FIG. 19, an exemplary inflatable cell assembly 510 is shown. Inflatable cell assembly 510 includes fifteen of inflatable cells 400, illustratively inflatable cells 400A-O. In the illustrated embodiment, inflatable cells 400A-C form a first group of inflatable cells "A"; inflatable cell 400D, inflatable cell 400E, inflatable cell 400J, and inflatable cell 400K form a second group of inflatable cells "B"; inflatable cells 400F-I form a third group of inflatable cells "C"; and inflatable cells 400L-O form a fourth group of inflatable cells "D". The first group of inflatable cells generally corresponds to a head region of exemplary patient support 100. The second group of inflatable cells generally corresponds to a chest region and legs region of exemplary patient support 100. The third group of inflatable cells generally corresponds to a torso region of exemplary patient support 100. The fourth group of inflatable cells generally corresponds to a foot region of exemplary patient support 100.

In one embodiment, each of inflatable cells 400A-O are the same size. In one embodiment, a inflatable cell 400 of at least one group has a different height than an inflatable cell 400 of another group. In the illustrated embodiment, group "D" including inflatable cells 400L-O have a smaller height than the remainder of inflatable cell 400. In one embodiment, the height of the inflatable cell 400 in group D are about 86% the height of the inflatable cell 400 in groups A-C. In one example, the inflatable cell 400 in groups A-C have a height of about 8.25 inches and the inflatable cell 400 in group D have a height of about 7.12 inches.

Each of inflatable cells 400A-O are received in a respective opening (not shown) of a sleeve 650. The openings of sleeve 650 are sized to accommodate the diameter of each of inflatable cells 400A-O. Sleeve 650 maintains the longitudinal relationship of the individual inflatable cell 400 of inflatable cells 400A-O along a length of inflatable cell assembly 510.

Although fifteen cells 400 are illustrated, more or fewer cells may be used for inflatable cell assembly 510. Further, inflatable cells 400 generally extend transversely across the full width of exemplary patient support 100, but may be arranged to extend longitudinally along the length of exemplary patient support 100 or other suitable arrangements. Also, in the illustrated embodiment the inflatable cell 400 are arranged in four groups of the cells, but in other embodiments more or fewer groups of cells may be provided.

Figure 19A:
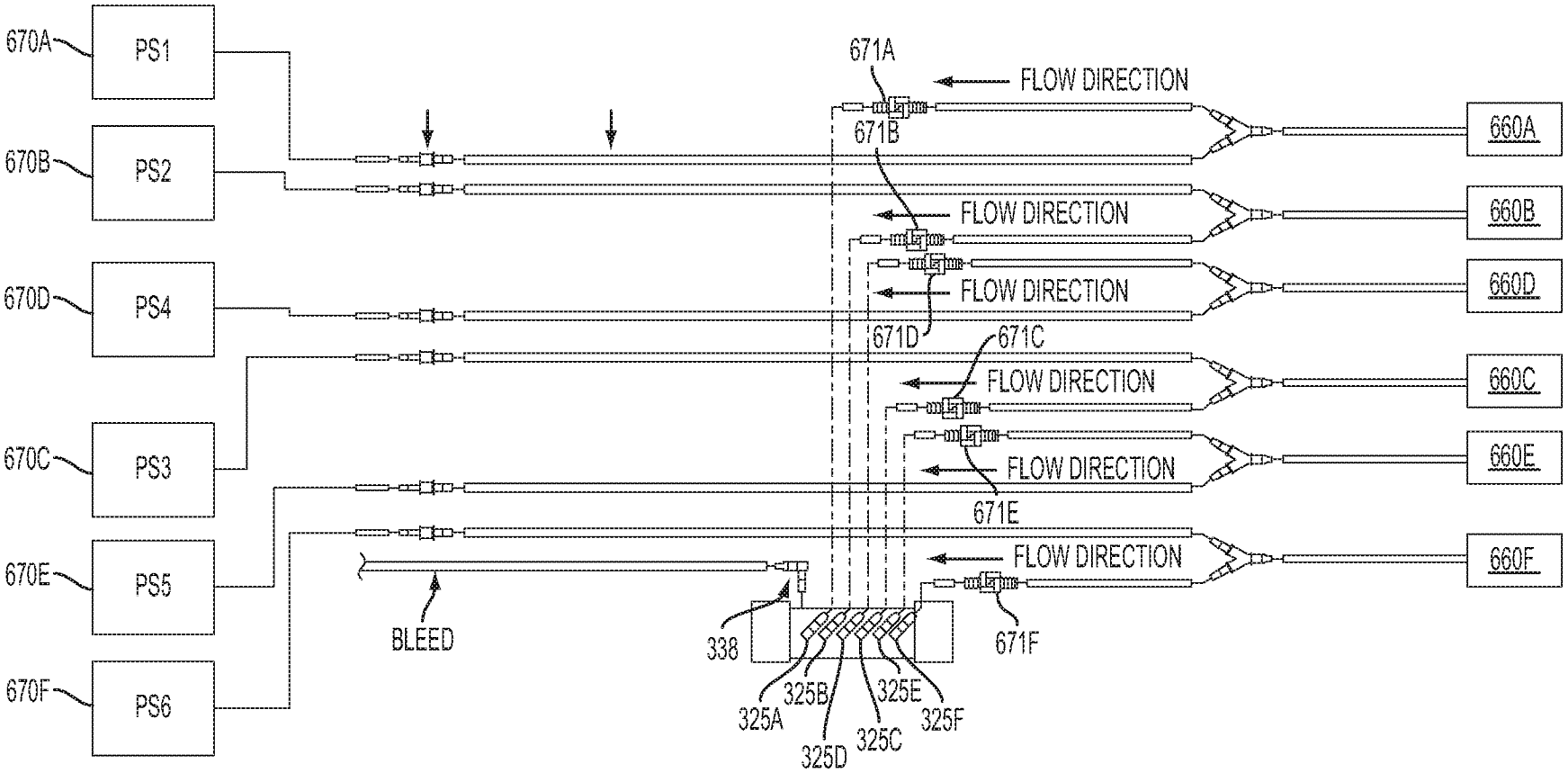
FIG. 19A illustrates a portion of the exemplary inflatable cell array of FIG. 19.

Each of inflatable cells 400A-O is coupled to one of a plurality of fluid conduit systems 660A-F. Referring to FIG. 19A, each of fluid conduit systems 660A-F terminate in a pair of conduits. A first conduit is operatively coupled to a respective pressure sensor 670A-F. A second conduit is operatively coupled to a respective pressure relief valve 671A-F. When the pressure within one of fluid conduit systems 660A-F exceeds the setting of the corresponding pressure relief valve 671A-F, the pressure relief valve opens to communicate fluid from the interior of the corresponding inflatable cells 400 through the pressure relief valve.

As shown in FIG. 19A, inflatable cells 400A-O are coupled to muffler device 330' through a plurality of fluid conduit systems 660A-F. Muffler device 330' differs from muffler device 330 in FIG. 7, in that muffler device 330' includes six input ports 324 instead of four input ports 324. An exhaust fluid conduit 662 is coupled to an exhaust port of muffler device 330' to dispense fluid from muffler device 330' to atmosphere.

Each of inflatable cells 400A-O is coupled to one of a plurality of fill valves 668A-F through one of a plurality of fluid conduit system 664A-F. Each of fill valves 668, just like fill valves 352 of patient support 300, has an open state whereby fluid may ingress or egress relative to the respective fluid conduit system 664 and a closed state wherein fluid may not ingress or egress relative to the respective fluid conduit system 664.

Illustratively fluid conduit system 664A connects inflatable support cell 400A, inflatable support cell 400C, inflatable cell 400M, and inflatable cell 400O to fill valve 668A. Fluid conduit system 664B connects inflatable support cell 400B, inflatable cell L, and inflatable cell 400N to fill valve 668B. Fluid conduit system 664C connects inflatable cell 400D and inflatable cell 400J to fill valve 668C. Fluid conduit system 664D connects inflatable cell 400E and inflatable cell 400K to fill valve 668D. Fluid conduit system 664E connects inflatable cell 400F and inflatable cell 400H to fill valve 668E. Fluid conduit system 664F connects inflatable support cell 400G and inflatable cell 400I to fill valve 668F. By connecting the portable inflation unit 60 (see FIG. 3) to one of fill valves 668, the pressure in the corresponding inflatable support cells 400 may be raised. The illustrated arrangement of fill valves 668 and fluid conduit system 664 results in the ability to raise the pressure in every other inflatable support cells 400 by coupling the portable inflation unit 60 or other device to either a first group including fill valve 668A, fill valve 668C, and fill valve 668F or a second group including fill valve 668B, fill valve 668D, and fill valve 668E.

Each of fluid conduit system 664A-F is coupled to a CPR release 360. CPR release 360 includes a handle 361 (see FIG. 3) that may be pulled or twisted. As a result of the handle being pulled or twisted, each of fluid conduit system 664A-F is in fluid communication with the ambient atmosphere around patient support 100 resulting in inflatable support cells 400 being deflated to provide a firmer support for administering CPR to a patient supported by patient support 100.

In the illustrated embodiment, inflatable support cells 400 are directly connected to fluid conduit system 664A-F without an intervening check valve. As such, the inflatable cells 400 connected to a common one of the plurality of fluid conduit system 664 have interiors generally at the same pressure level. This arrangement permits fluid to be easily administered to the interior of a respective inflatable cell 400 or removed from the interior of a respective inflatable cell 400. In this manner, a fluid supply device 40 (see FIG. 1) coupled to exemplary patient support 100 may easily provide an alternating therapy with inflatable cell assembly 510.

Inflatable cell assembly 510 includes a plurality of pressure sensors 670A-F to monitor the pressure within inflatable cells 400A-O. Pressure sensor 670A monitors the fluid pressure in fluid conduit system 660A and thus monitors the pressure in inflatable support cell 400A, inflatable cell C, inflatable cell M, and inflatable cell 400O. Pressure sensor 670B monitors the fluid pressure in fluid conduit system 660B and thus monitors the pressure in inflatable cell 400B, inflatable cell 400L, and inflatable cell 400N. Pressure sensor 670C monitors the fluid pressure in fluid conduit system 660C and thus monitors the pressure in inflatable support cell 400G and inflatable cell 400I. Pressure sensor 670D monitors the fluid pressure in fluid conduit system 660D and thus monitors the pressure in inflatable support cell 400D and inflatable cell 400J. Pressure sensor 670E monitors the fluid pressure in fluid conduit system 660E and thus monitors the pressure in inflatable support cell 400F and inflatable cell 400H. Pressure sensor 670F monitors the fluid pressure in fluid conduit system 660F and thus monitors the pressure in inflatable support cell 400G and inflatable cell 400I. In one embodiment, each inflatable cell 400 has a respective pressure sensor 670 monitoring the pressure thereof.

Figure 20:
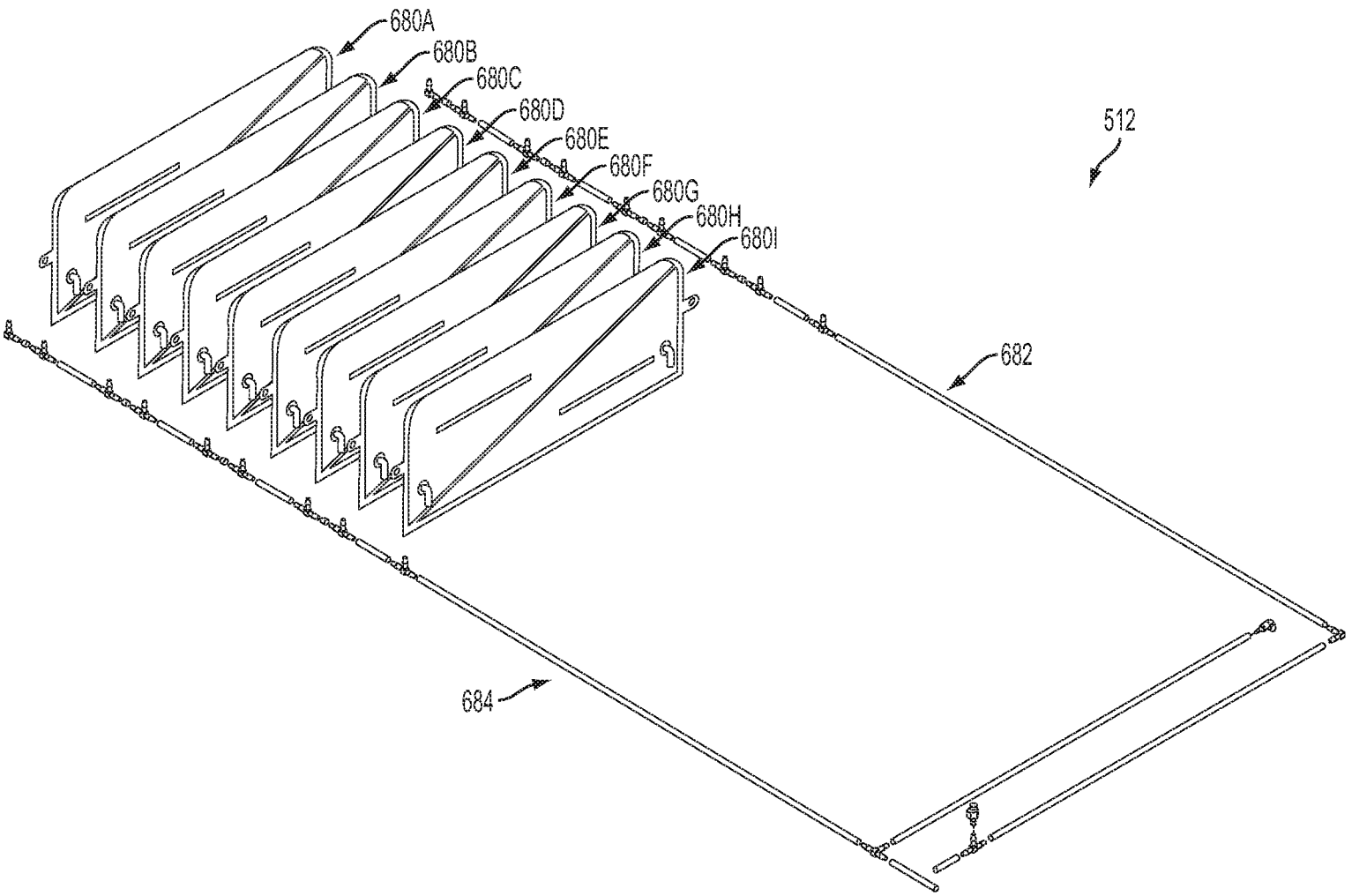
FIG. 20 illustrates exemplary inflatable turning cells of the patient support of FIG. 12.

Referring to FIG. 20, an exemplary turning cell assembly 512 of exemplary patient support 100 is shown. Turning cell assembly 512 includes a plurality of inflatable cells 680A-I. A first side of inflatable cells 680A-I are coupled to a first fluid conduit system 682. A second side of inflatable cells 680A-I are coupled to a second fluid conduit system 684. By controlling the inflation and deflation of inflatable cells 680A-I a patient supported on exemplary patient support 100 may be turned to the left or right. Additional details regarding inflatable cells 680A-I and their operation are provided in U.S. Pat. No. 7,454,809, filed on Dec. 26, 2006, Ser. No. 11/616,127, titled METHOD FOR USING INFLATABLE CUSHION CELL WITH DIAGONAL SEAL STRUCTURE, the disclosure of which is expressly incorporated by reference herein. In one embodiment, split cells are provided for inflatable cells 680. In a split cell arrangement, two non-overlapping side-by-side cells are provided as opposed to the overlapping cells of inflatable cells 680. In the illustrated embodiment shown in FIG. 20, the plurality of inflatable cells 680 only extend a partial length of the patient support. In one embodiment, additional inflatable cells 680 are included and the turning assembly 512 generally extends the length of the patient support.

Figure 20A:
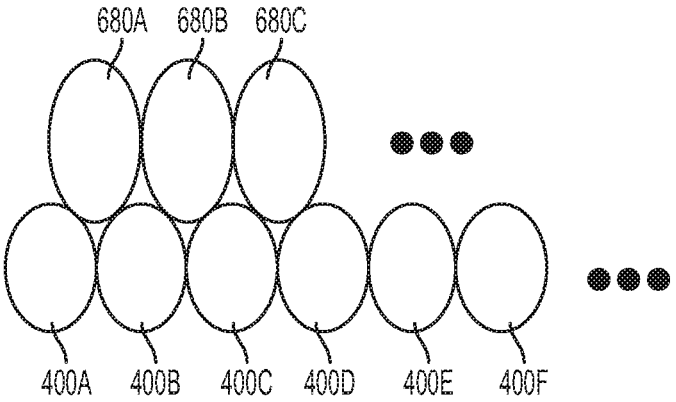
FIG. 20A illustrates an exemplary arrangement of the inflatable turning cells of FIG. 20 and the inflatable cells of FIG. 19.
Figure 20B:
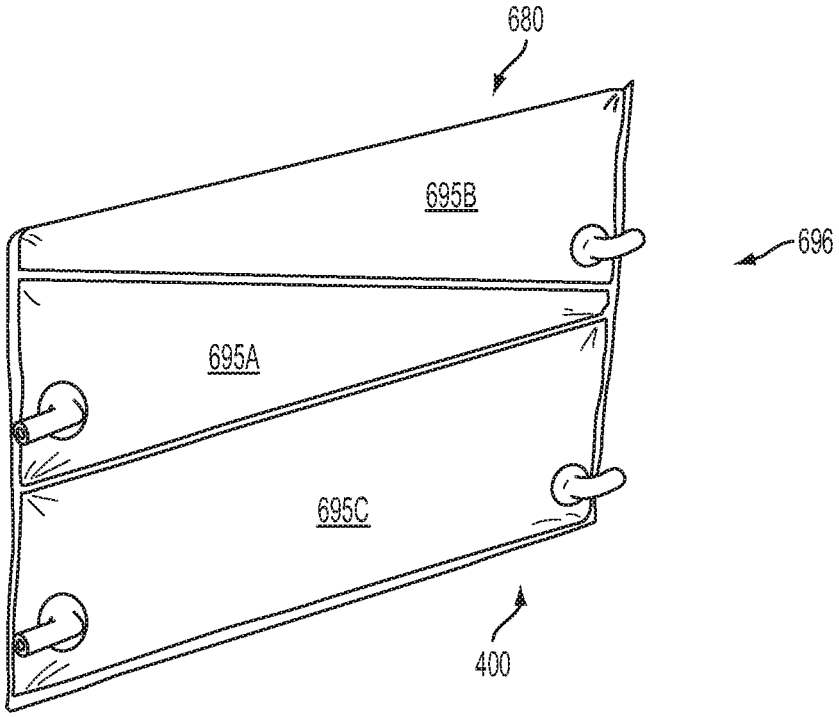
FIG. 20B illustrates an exemplary combination turning cell and inflatable cell.
Figure 20C:
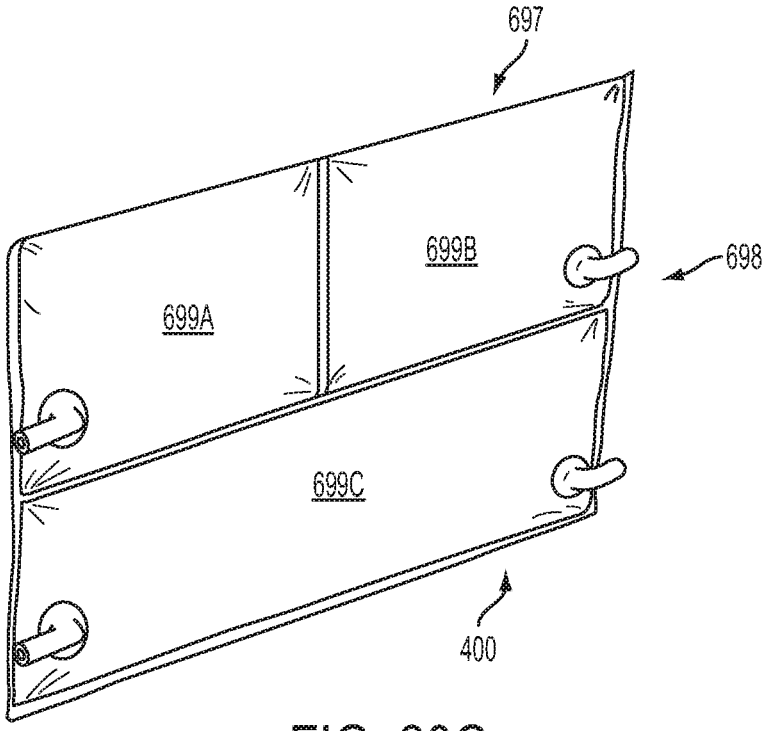
FIG. 20C illustrates another exemplary combination turning cell and inflatable cell.

Referring to FIG. 20A, an exemplary partial representation of inflatable cells 680 and inflatable cells 400 of patient support 100 is shown from a side of the patient support 100. As shown in FIG. 20A, inflatable cells 680 are supported by inflatable cells 400. In one embodiment, each inflatable cell 680 is formed as part of one of inflatable cell 400, as shown in FIG. 20B, as cell 696. As shown in FIG. 20B, inflatable cell 680 portion of inflatable cell 696 includes two inflatable chambers 695A and 695B and the inflatable cell 400 portion of inflatable cell 696 includes a single inflatable chamber 695C. In one embodiment, a split cell turning cell 697 is formed as part of one of the inflatable cells 400, as shown in FIG. 20C, as cell 698. As shown in FIG. 20C, inflatable cell 697 portion of inflatable cell 698 includes two inflatable chambers 699A and 699B and the inflatable cell 400 portion of inflatable cell 696 includes a single inflatable chamber 699C.

Figure 21:
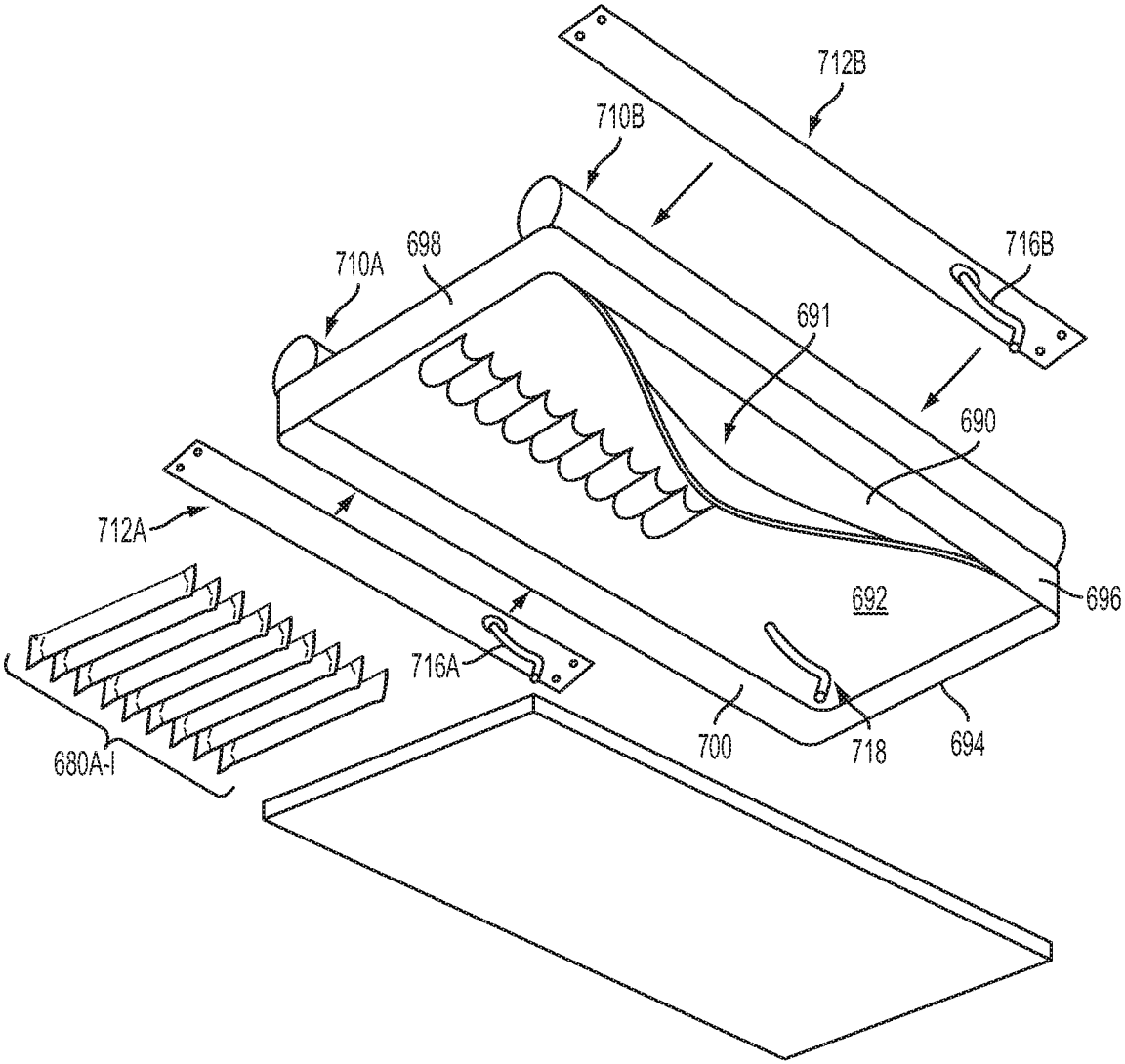
FIG. 21 illustrates a lower, exploded perspective view of an exemplary assembly including an exemplary foam sheet of the patient support of FIG. 12, an exemplary intermediate cover of the patient support of FIG. 12, exemplary bolsters of the patient support of FIG. 12, and exemplary inflatable turning cells of FIG. 20.

Referring to FIG. 21, an exemplary intermediate cover 516 of exemplary patient support 100 is shown. Intermediate cover 516 includes a top portion 690 (see FIG. 22), a bottom portion 692, and a plurality of side portions 694-700. In the illustrated embodiment, top portion 690 and side portions 694-700 are made from a single piece of fabric. Bottom portion 692 is also made of fabric. Exemplary fabrics include stretchable materials. Bottom portion 692 is coupled to top portion 690.

In the illustrated embodiment, a first side 693 of bottom portion 692 is coupled to top portion 690 with a zipper. By opening the zipper access is provided to a pocket 691 defined by top portion 690 and bottom portion 692. The pocket 691 receives an exemplary resilient sheet 514 of exemplary patient support 100. Resilient sheet 514 is made of foam, gel infused materials, silicon beads, feathers, cotton, and other suitable materials. An exemplary resilient sheet is a foam base which tapers towards the foot end of the bed by about 25 percent and memory foam layer on top. A plurality of loops 702 which receive inflatable cells 680A-I and maintain the relationship of inflatable cells 680A-I along a longitudinal length of patient support 100 are coupled to bottom portion 692. A lower edge 695 of intermediate cover 516 includes couplers to secure the intermediate cover 516 to intermediate base 504. Exemplary couplers include zippers, fasteners, snaps, hook and loop fasteners and other suitable coupling devices.

Figure 22:
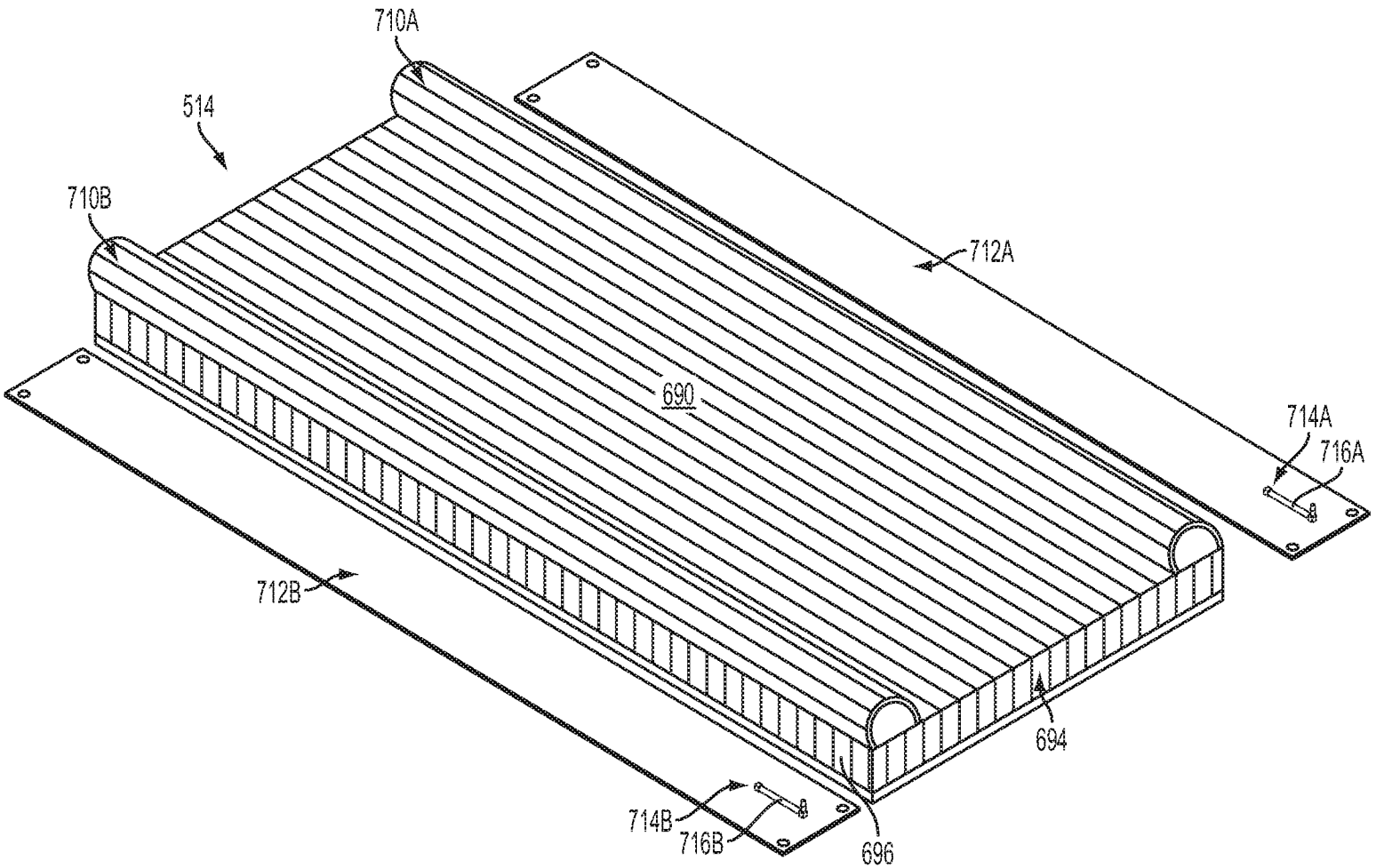
FIG. 22 illustrates a top, perspective view of the assembly of FIG. 21 with the bolsters spaced apart from the remainder of the assembly.

Referring to FIG. 22, top portion 690 has coupled thereto a pair of bolster holders 710A-B. Bolster holders 710 receive respective bolsters 712A-B. Bolsters 712 are inflatable bolsters. In one embodiment, inflatable bolsters 712 do not include a core material. In one embodiment, inflatable bolsters 712 includes a core material. In one example, the core material includes foam. In one embodiment, inflatable bolsters 712 has a core structured the same as the core of inflatable cells 400. Inflatable bolsters 712 includes a single fluid port 714 to communicate fluid to and from an interior of inflatable bolsters 712. Fluid conduits 716 are coupled to the respective single fluid port 714. Referring to FIG. 21, the fluid conduits 716 are coupled to a fluid conduit 718 which extends through top portion 690 and bottom portion 692. In one embodiment, a separate fluid conduit 718 is provided for each of fluid conduits 716 A-B.

An advantage, amongst others, in one embodiment when the bolsters are simply air inflated bolsters is that the patient support may have a flat appearance when a turning therapy is not needed by deflating the bolsters. An advantage, amongst others, in one embodiment when the bolsters include a core member is that the bolsters still provide a raised side of the patient support if the bolsters deflate.

Figure 23:
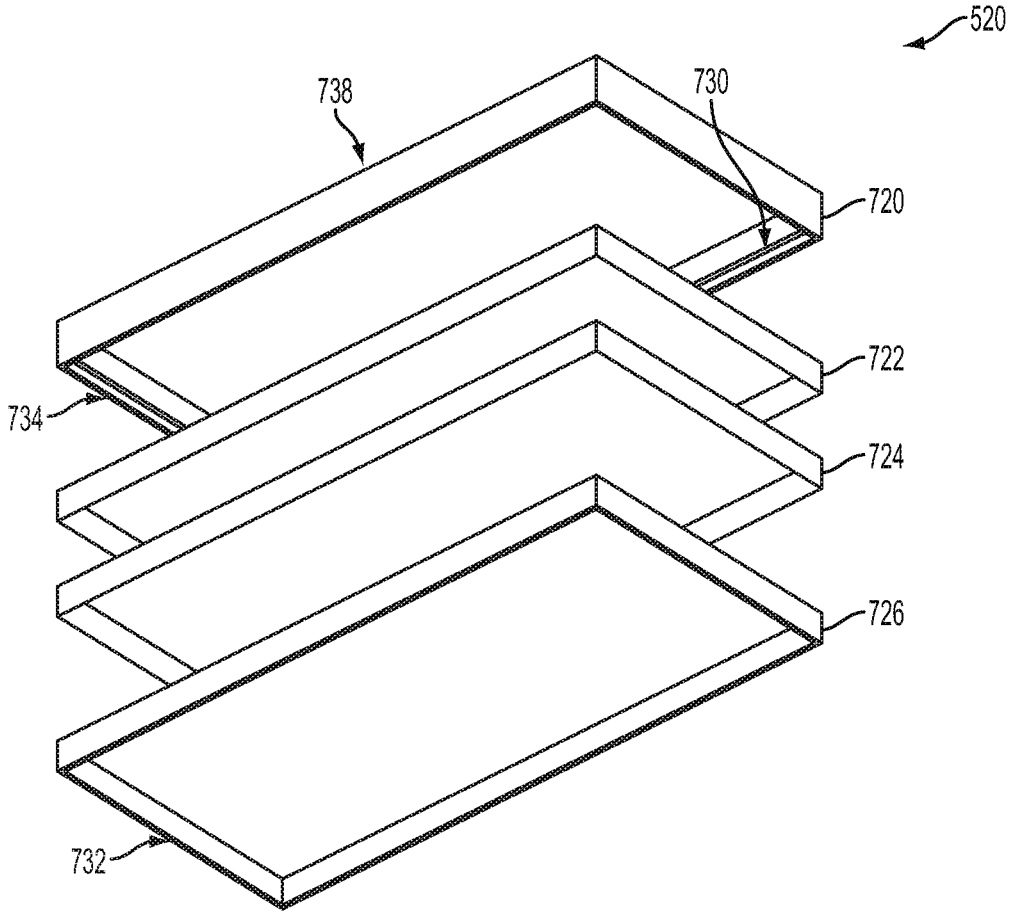
FIG. 23 illustrates a lower, exploded perspective view of an exemplary cover assembly of the patient support of FIG. 12.

Referring to FIG. 23, an exemplary cover assembly 520 is shown. In the illustrated embodiment, cover assembly 520 includes a first layer 720, a second layer 722, a third layer 724, and a fourth layer 726. In one embodiment, fourth layer 726 is made of a waterproof material. In one embodiment, third layer 724 is made of a spacer material. Exemplary spacer materials include materials which permit air flow therethrough under load. Exemplary materials include polyester spacer fabric having a repeating diamond pattern to promote air circulation. In one embodiment, second layer 722 is made of a fire retardant material. An exemplary fire retardant material is KEVLAR brand material. In one embodiment, first layer 720 is made of a breathable material. In one embodiment, first layer 720, second layer 722, and third layer 724 are sewn together. A lower portion of first layer 720 includes a zipper 730 which cooperates with a zipper 732 of fourth layer 726 to hold layers 720 and 726 together. First layer 720 also includes a second zipper 734 which cooperates with the zipper on base assembly 502 to couple base assembly 502 to cover assembly 520. Since base assembly 502 and cover assembly 520 include KEVLAR brand material layers, base assembly 502 and cover assembly 520 surround the intermediate components of patient support 100 to provide a fire barrier. In one embodiment, cover 520 is a single layer cover.

In one embodiment, first layer 720 includes a zipper 738 along a top edge to interact with a zipper 746 on an exemplary low air loss assembly 522 (see FIG. 24) to couple low air loss assembly 522 to cover assembly 520. In one embodiment, the low air loss assembly 522 is part of the cover assembly 520.

Figure 24:
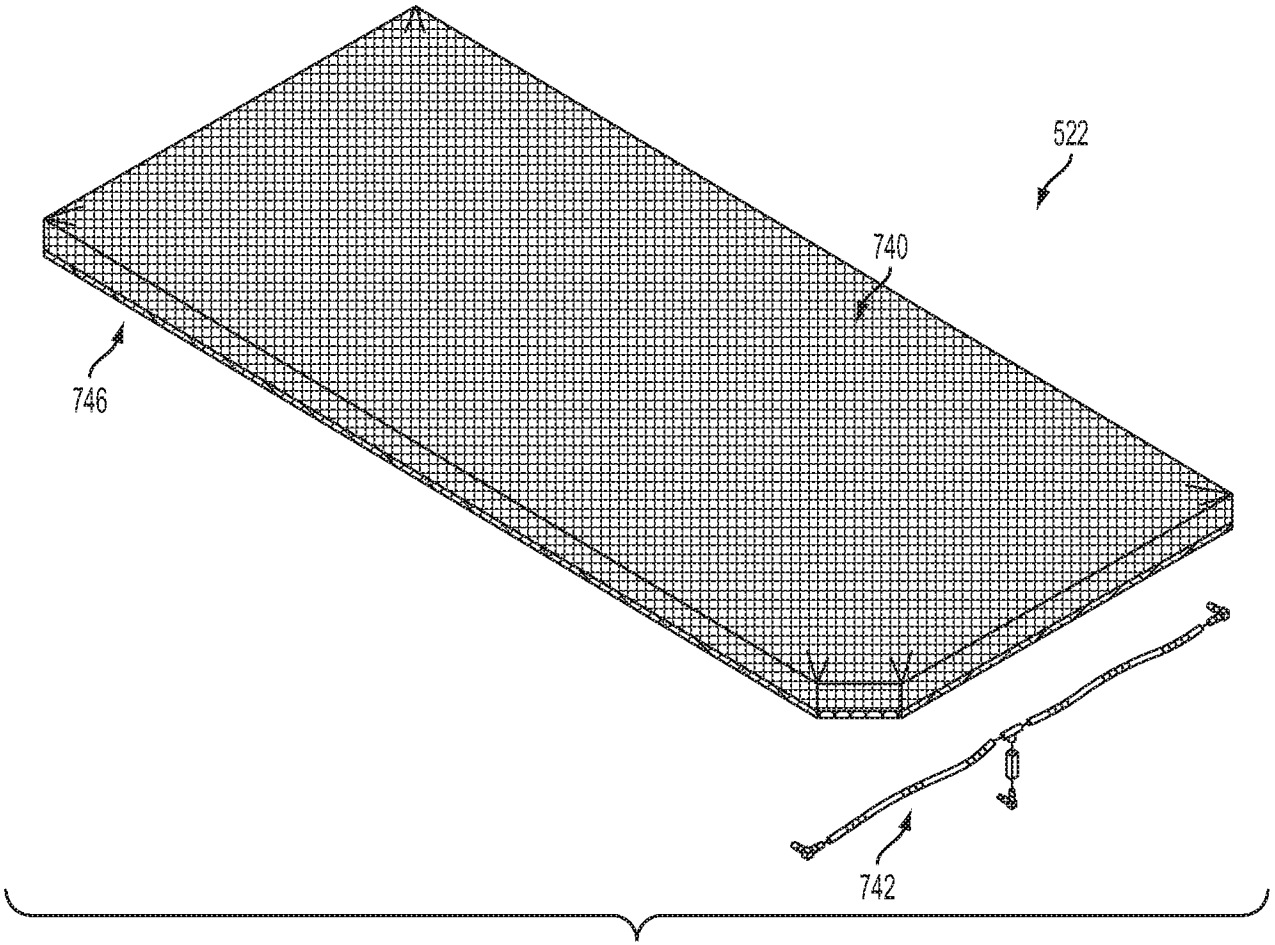
FIG. 24 illustrates an exemplary low air loss assembly of the patient support of FIG. 12.
Figure 25:
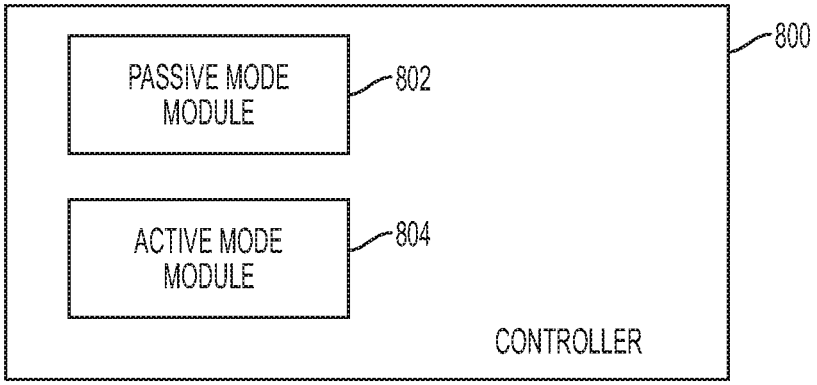
FIG. 25 illustrates an exemplary controller of the patient support of FIG. 12 providing a passive mode module and an active mode module.

Referring to FIG. 24, an exemplary low air loss assembly 522 is shown. Low air loss assembly 522 includes an upper surface 740 which allows fluid provided on an interior of low air loss assembly 522 to pass there through to provide cooling to a patient laying on patient support 100. Fluid is provided to the interior of low air loss assembly 522 through a fluid conduit system 742 which is coupled to a fluid conduit system 744 in FIG. 19. Additional details regarding low air loss assembly 522 and its operation are provided in US Published Patent Application No. 2008/0098532, Ser. No. 11/553,405, filed Oct. 26, 2006, titled MULTI-CHAMBER AIR DISTRIBUTION SUPPORT SURFACE PRODUCT AND METHOD, the disclosure of which is expressly incorporated by reference herein.

In one embodiment, the operation of patient support 100 is monitored by a controller 800. Controller 800 may be a single controller or multiple controllers. In the illustrated embodiment, controller 800 includes a passive mode module 802. The passive mode module 802 is logic that monitors the fluid pressure of at least one inflatable cell of patient support 100, but does not actively cause fluid to be communicated to the interior of the at least one inflatable cell. The passive mode module may be implemented as electrical circuits, software being executed by a processing unit, a combination thereof, or any other suitable configuration of hardware or software-enabled hardware.

Controller 800 further includes an active mode module 804. The active mode module 804 is logic that actively causes fluid to be communicated to the interior of at least one inflatable cells of patient support 100. The active mode module may be implemented as electrical circuits, software being executed by a processing unit, a combination thereof, or any other suitable configuration of hardware or software-enabled hardware.

Figure 43:
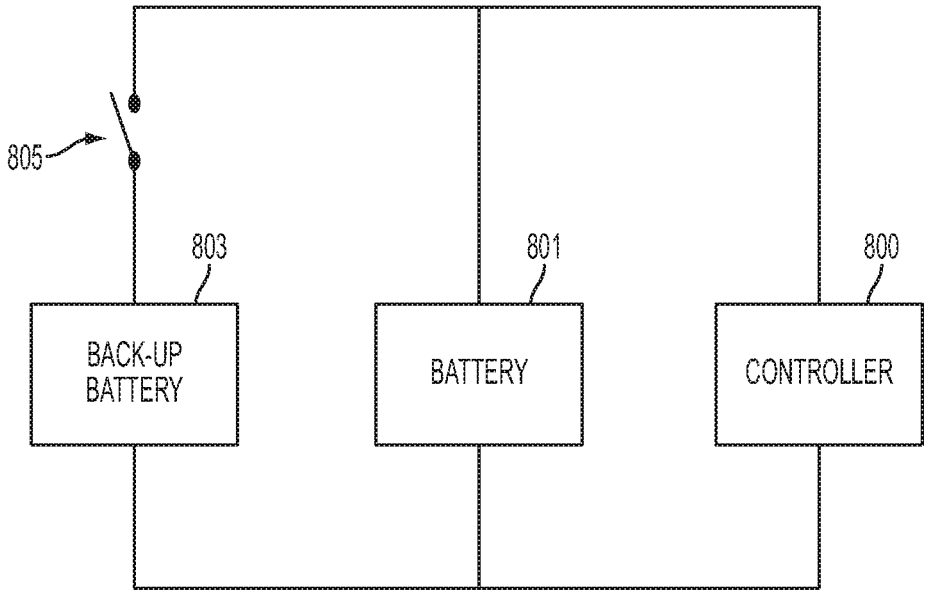
FIG. 43 illustrates an exemplary power system for the controller of FIG. 27.

Referring to FIG. 43, an exemplary power system for controller 800 is shown. controller 800 receives power from one or more batteries 801. In one embodiment, batteries 801 and controller 800 are epoxied together. A second set of one or more batteries 803 are coupled to controller 800 in parallel with the batteries 801. The batteries 803 are provided within the envelope of the patient support and are received within a pocket in the patient support. When the power from battery 801 is running low, a notification may be provided. Then, an operator may close switch 805 to couple battery 803 to controller 800.

Figure 26:
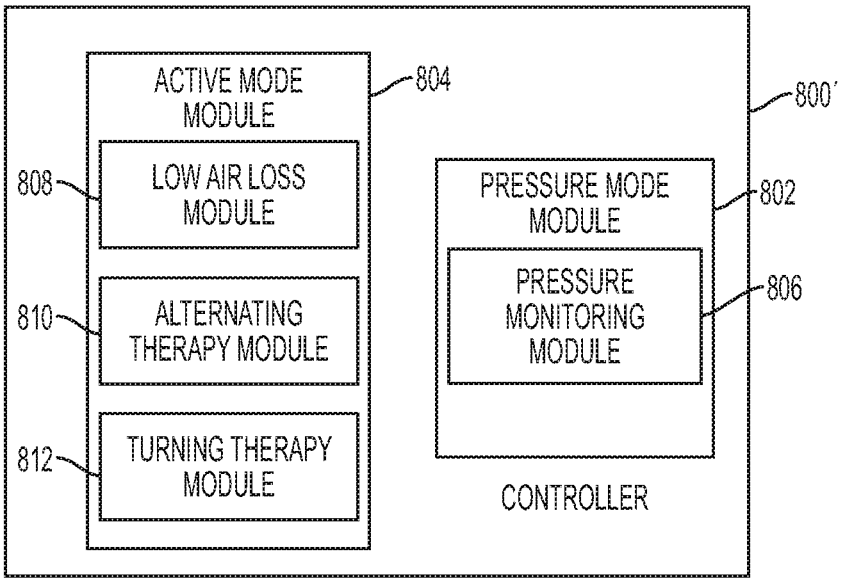
FIG. 26 illustrates another exemplary controller of the patient support of FIG. 12 providing a passive mode module and an active mode module.

Referring to FIG. 26, an exemplary representation of controller 800' is shown. As illustrated in FIG. 26, passive mode module 802 includes a pressure monitoring module 806 and active mode module 804 includes a low air loss module 808, an alternating therapy module 810, and a turning therapy module 812.

The low air loss module 808 includes providing fluid to low air loss assembly 522. The fluid exits low air loss assembly 522 through upper surface 740 on which the patient is supported. Additional details regarding exemplary loss air loss operations which may be carried out by controller 800' are provided in US Published Patent Application No. 2008/0098532, Ser. No. 11/553,405, filed Oct. 26, 2006, titled MULTI-CHAMBER AIR DISTRIBUTION SUPPORT SURFACE PRODUCT AND METHOD, the disclosure of which is expressly incorporated by reference herein.

The alternating therapy module 810 alternates the pressure profile of one or more groups of inflatable cell 400 of inflatable cell assembly 510. In one embodiment, the inflatable cells 400 are divided into two interleaved groups of inflatable cells 400 and the pressure is relieved in a first group during a first time period and then in a second time period the pressure in the first group is increased and the pressure in a second group is relieved. These pressure fluctuations are repeated.

The turning therapy module 812 alters the pressure of the inflatable cells of turning cell assembly 512 to cause a patient supported on patient support 100 to be turned by first altering a height of a first side of the patient followed by altering a height of a second side of the patient. Additional details regarding exemplary turning operations which may be carried out by controller 800 are provided in U.S. Pat. No. 7,454,809, filed on Dec. 26, 2006, Ser. No. 11/616,127, titled METHOD FOR USING INFLATABLE CUSHION CELL WITH DIAGONAL SEAL STRUCTURE, the disclosure of which is expressly incorporated by reference herein.

Figure 27:
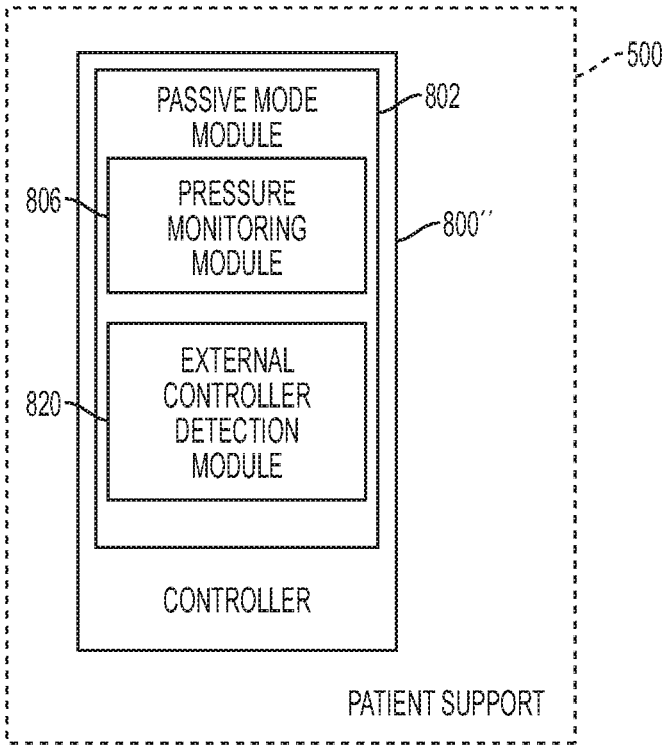
FIG. 27 illustrates another exemplary controller of the patient support of FIG. 12 providing a passive mode module.
Figure 27:
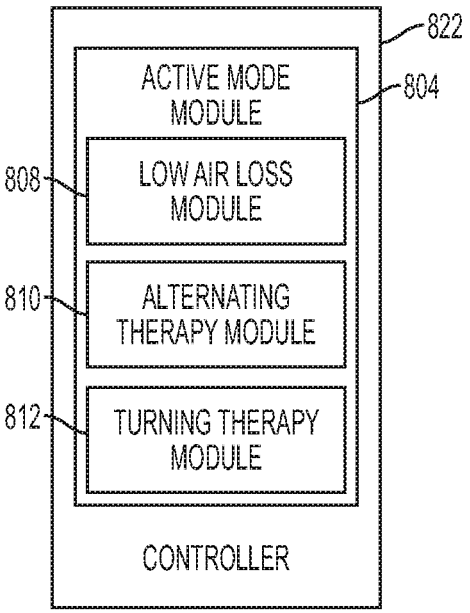

Referring to FIG. 27, another exemplary representation of controller 800" is shown. Controller 800" in the embodiment shown in FIG. 27 includes a passive mode module 802, but not an active mode module 804. Passive mode module 802 includes a pressure monitoring module 806. Controller 800" further includes an external controller detection module 820. As explained herein, external controller detection module 820 is logic which determines when an external controller 822 is coupled to patient support 100. External controller 822 includes an active mode module 804. In the illustrated embodiment, active mode module 804 includes low air loss module 808, alternating therapy module 810, and turning therapy module 812. Active mode module 804 may include additional functionality or reduced functionality. For example, if patient support 100 does not include low air loss assembly 522, then low air loss module 808 may not be included as part of active mode module 804. In one embodiment, external controller 822 is part of fluid supply unit 40 and controls a fluid pump within fluid supply unit 40 and valves to selectively inflate or deflate inflatable cells of patient support 100 and provide fluid for low air loss module 808.

Figure 28:
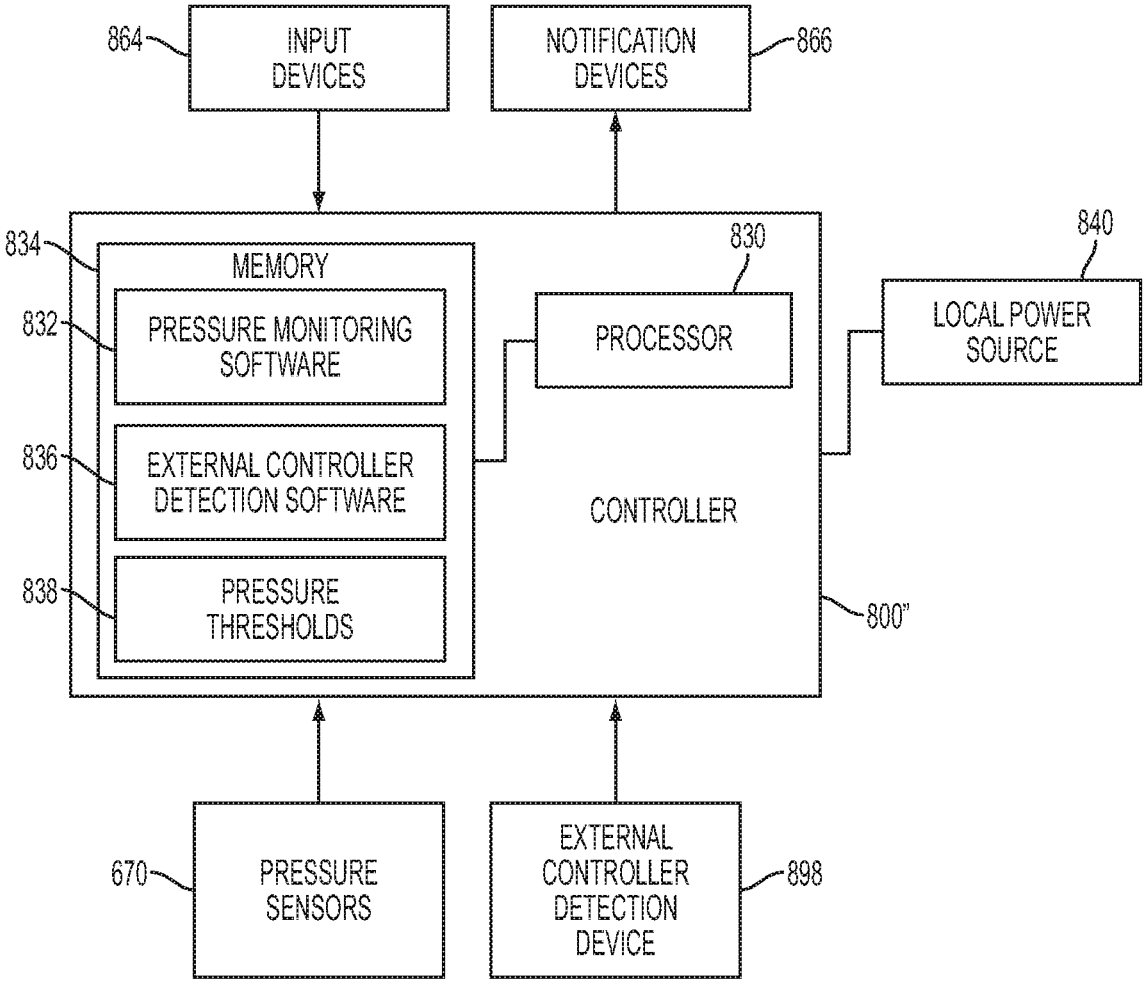
FIG. 28 illustrates the controller of FIG. 27 and related components of the patient support of FIG. 12.

Referring to FIG. 28, one embodiment of controller 800" is shown. Controller 800" includes a processor 830 which functions as pressure monitoring module 806 by executing pressure monitoring software 832 stored in a memory 834 accessible by processor 830. Processor 830 further functions as external controller detection module 820 by executing external controller detection software stored in memory 834. Pressure monitoring software 832 further includes one or more pressure threshold values 838. In one embodiment, controller 800" is positioned within an envelope of patient support 100 and is powered by a local power supply 840. Exemplary local power supplies include batteries and other suitable sources of power.

Figure 29:
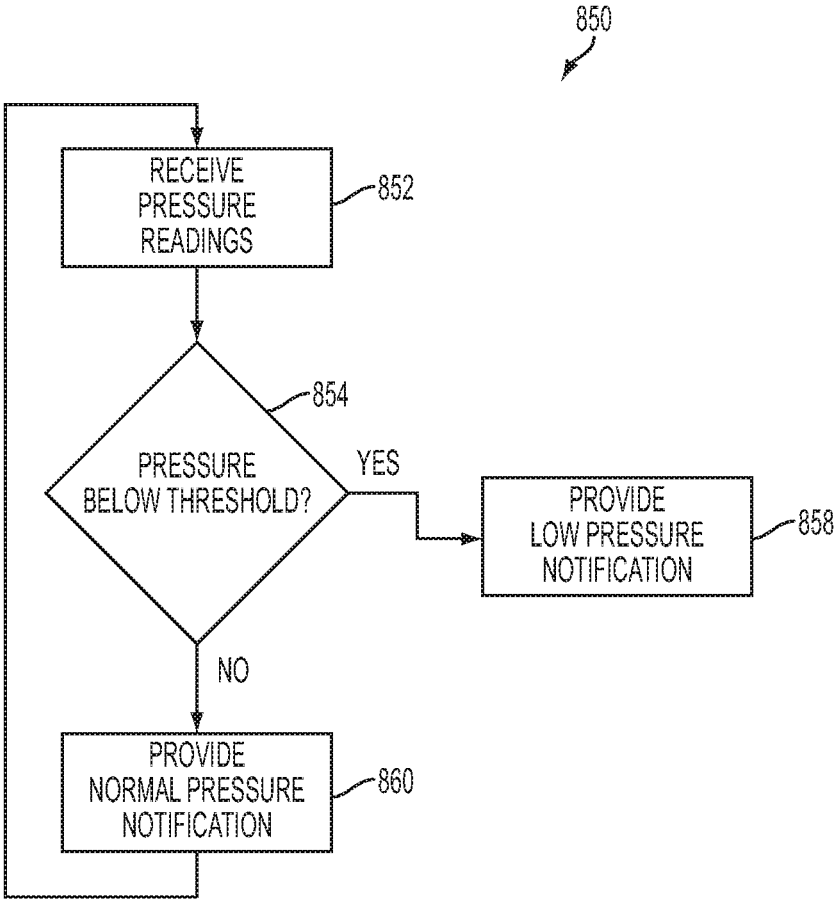
FIG. 29 illustrates an exemplary processing sequence of the controller of FIG. 27.
Figure 30:
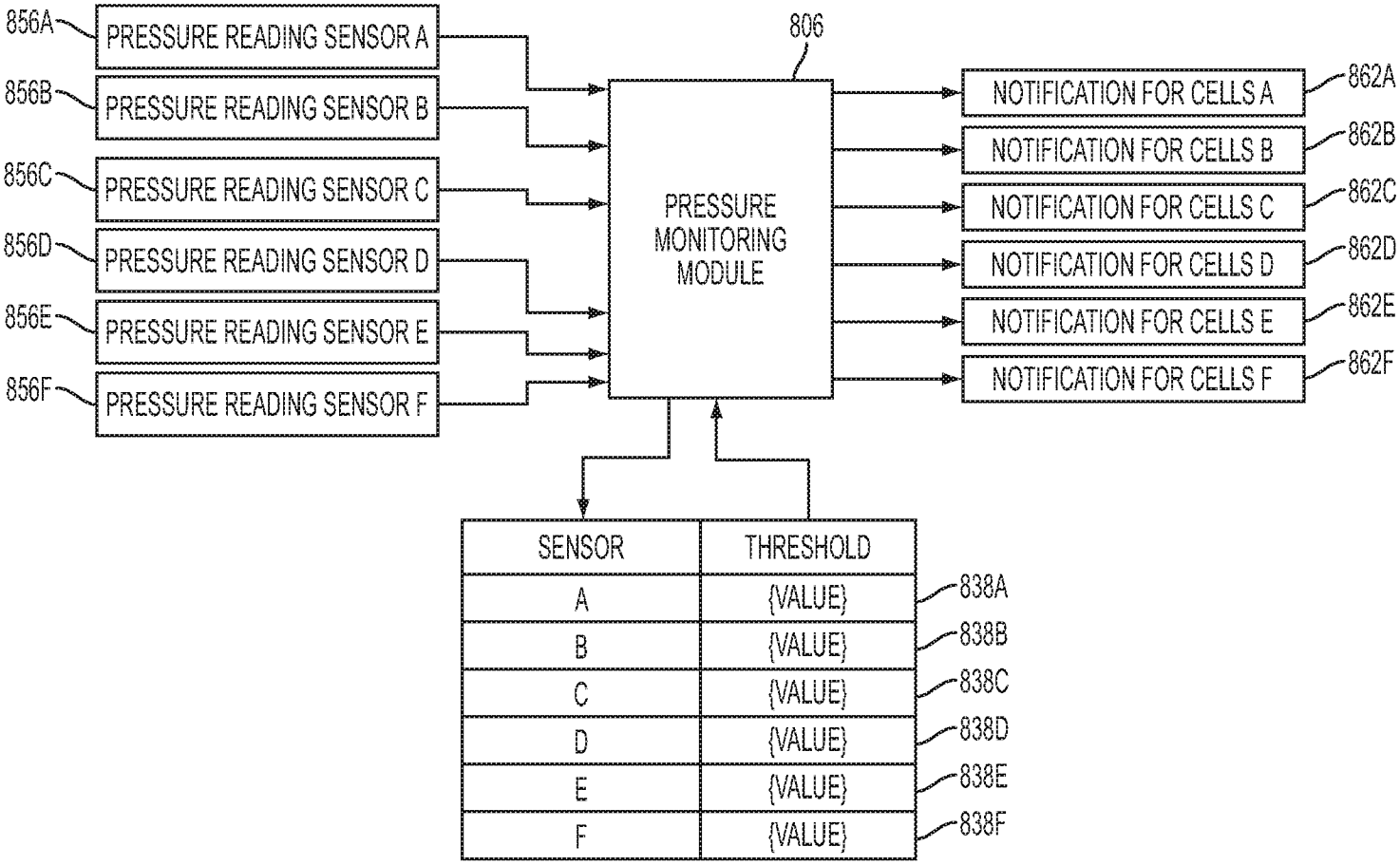
FIG. 30 illustrates an exemplary data flow of the controller of FIG. 27 executing the processing sequence of FIG. 29.

Referring to FIGS. 29 and 30, an exemplary processing sequence 850 of pressure monitoring module 806 is represented. Referring to FIG. 29, controller 800" receives pressure readings from pressure sensors 670A-F, as represented by block 852. The received pressure readings are compared to pressure threshold values 838 for each sensor to determine if one or more of the pressure readings are below a pressure threshold, as represented by block 854.

Referring to FIG. 30, the received pressure readings 856A-F correspond to pressure sensors 670A-F. Patient support 100, in the illustrated embodiment, includes six pressure sensors 670 so only six pressure readings 856 are received. Pressure monitoring module 806 may function with more or less pressure sensors 670. Exemplary pressure readings include a monitored electrical characteristic (exemplary characteristics including voltage and resistance), a digital input, a message sent over a network, or other suitable methods for controller 800" to determine a pressure value corresponding to the pressure sensed by one pressure sensor 670. The pressure readings 856A-F are compared to threshold values 838A-F. In one embodiment, the threshold values 838A-F are stored in a table accessible by controller 800". In one example, the threshold values may be set by a user with one or more input devices 864 (see FIG. 28). Exemplary input devices include switches, keys, a touch screen, or other suitable devices for providing threshold values to memory 834.

Returning to FIG. 29, if one of the respective pressure readings 856 is below the respective pressure threshold 838, then pressure monitoring module 806 provides a low pressure notification, as represented by block 858. If the respective pressure reading is not below the respective pressure threshold 838, then pressure monitoring module 806 provides a normal pressure notification, as represented by block 860. In one embodiment, a notification is only provided in a low pressure condition.

Figure 33:
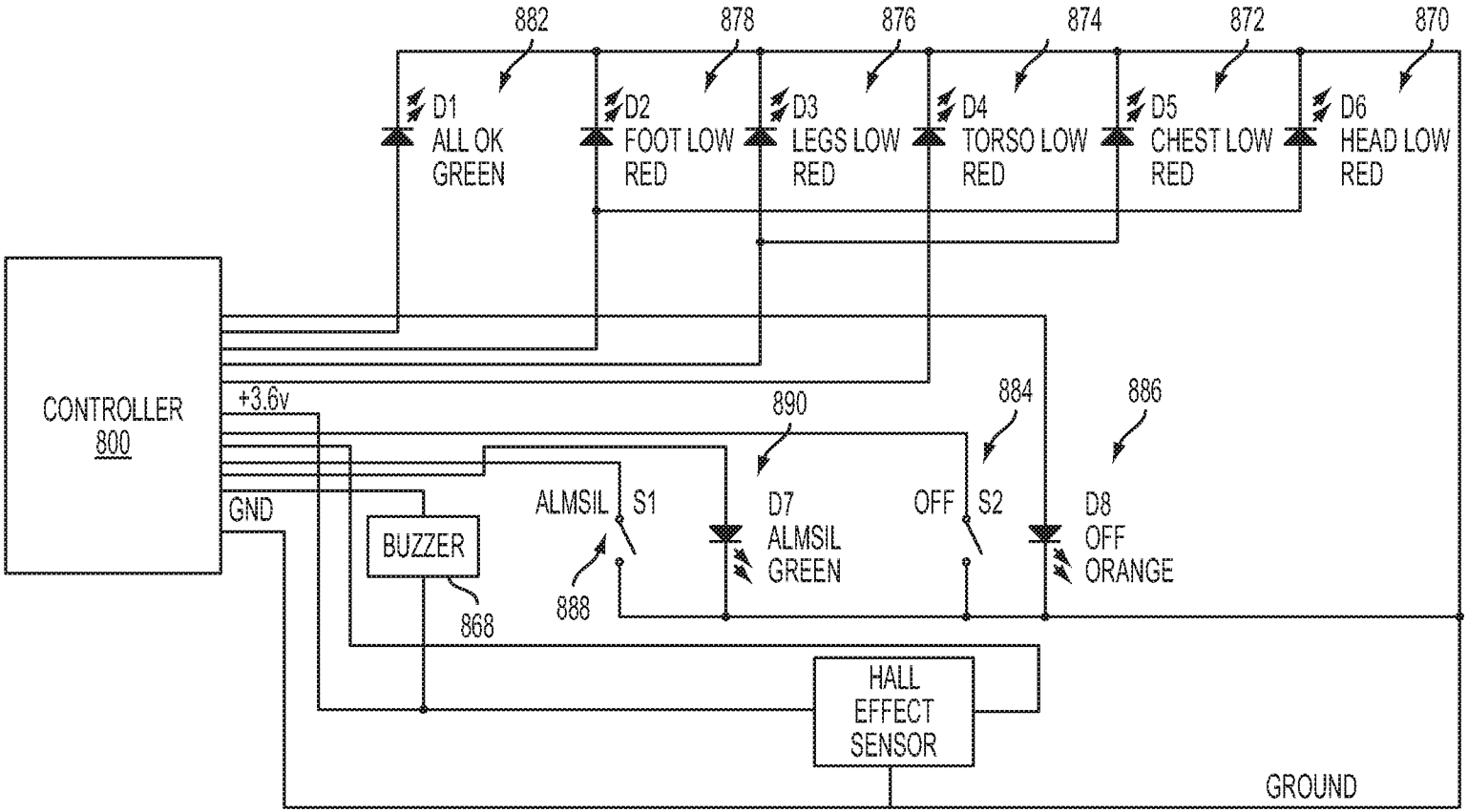
FIG. 33 illustrates an exemplary electrical diagram of an exemplary external controller detection device and a plurality of notification devices.

Referring to FIG. 30, pressure monitoring module 806 provides a notification 862 for each of pressure sensors 670A-F with one or more notification devices 866. Exemplary notifications include audio notifications, visual notifications, tactile notifications, or combinations thereof. Exemplary audio notifications include an audio alarm and other suitable audio cues. Exemplary audio alarms include a beeping sound. Exemplary visual alarms include lights, text displayed on a screen, graphics displayed on a screen, and other suitable visual cues. Exemplary tactile notifications include a vibration device. In one embodiment, when pressure is low a flashing visual cue is provided along with an audio chime alarm. In one embodiment, the notification is at least one of a visual indicator, an audio indicator, and a signal to a remote device. In one example, the signal to the remote device is communicated over a wireless connection. In another example, the signal to the remote device is communicated over a wired connection. In one embodiment, buzzer 868 (see FIG. 33) is an exemplary notification device 866.

Referring to FIG. 32, exemplary notification devices 866 are illustrated. The exemplary notification devices 866 are red light emitting diodes 870-878 which are part of a user interface 102 of patient support 100. LED 870 corresponds to the inflatable cells 400A-C of inflatable cell assembly 510 which are monitored by pressure sensors 670A and 670B. LED 872 corresponds to the inflatable cell 400D and inflatable cell 400E of inflatable cell assembly 510 which are monitored by pressure sensors 670C and 670D. LED 874 corresponds to the inflatable cells 400F-I of inflatable cell assembly 510 which are monitored by pressure sensors 670E and 670F. LED 876 corresponds to the inflatable cell 400J and inflatable cell 400K of inflatable cell assembly 510 which are monitored by pressure sensors 670C and 670D. LED 878 corresponds to the inflatable cells 400L-O of inflatable cell assembly 510 which are monitored by pressure sensors 670A and 670B. In one embodiment, when the pressure monitored by one of pressure sensors 670A-F is below the pressure threshold, controller 800" causes the corresponding LED or LEDs to flash or illuminate. If the pressure monitored by a pressure sensor 670A-F is not below the threshold value, then the corresponding LED is not illuminated. In one embodiment, if all of pressures being monitored by pressure sensors 670A-F are not below the corresponding threshold value, a green LED 880 is illuminated.

Since pressure sensor 670A monitors both inflatable cells 400A-C and inflatable cells 400L-O, when either inflatable cells 400A-C and inflatable cells 400L-O has a low pressure reading both LED 870 and LED 878 are activated. Similarly, since pressure sensor 670B monitors both inflatable cell 400D and inflatable cell 400E and inflatable cell 400J and inflatable cell 400K, when either inflatable cells 400D and inflatable cell 400E or inflatable cell 400J and inflatable cell 400K has a low pressure reading both LED 872 and LED 876 are activated. In one embodiment, each zone has a separate pressure sensor 670 instead of having a plurality of zones tied to a common pressure sensor 670.

Referring to FIG. 32, user interface 102 also includes an on/off switch 884 and a corresponding LED 886. When on/off switch 884 is in an open state, controller 800" discontinues pressure monitoring module 806 and LED 886 is illuminated. When on/off switch 884 is in a closed state, controller 800" activates pressure monitoring module 806 and LED 886 is not illuminated. User interface 102 further includes a switch 888 and a corresponding LED 890. Switch 888 is an alarm silencer switch which deactivates a current alarm.

In response to a low pressure warning, a caregiver by reviewing LED 870-878 may determine which possible inflatable cells 400 are low. Next, an inflation device 60 (see FIG. 3) may be coupled to the respective fill valve 668A-F corresponding to low inflatable cell 400. For either LED 870 and LED 878, the corresponding fill valves 668 are fill valve 668A and fill valve 668B. For either LED 872 and LED 876, the corresponding fill valves 668 are fill valve 668C and fill valve 668D. For LED 874, the corresponding fill valves 668 are fill valve 668E and fill valve 668F.

The inflation device 60 is used to add fluid to the interiors of the corresponding inflatable cell 400. Once the pressure in the corresponding inflatable cell 400 is not below the threshold value, the corresponding LED 870-878 are turned off. The caregiver may continue to add fluid to the interior of the corresponding inflatable cell 400 to raise the fluid pressure above the threshold pressure. Once the fluid pressure in the interior of the corresponding inflatable cell 400 rises to an upper threshold pressure set by the corresponding pressure relief valve 320, the excess fluid pressure is bled away. The caregiver then uncouples the inflation device 60 from the patient support 100.

An advantage, amongst others, in one embodiment is that the patient support provides a passive pressure monitoring system monitors air pressure to make sure that the support is at a proper pressure level without the need of an external control unit.

Returning to FIG. 28, an external controller detection device 898 is operatively coupled to controller 800". Exemplary external controller detection devices 898 include switches, sensors, optical sensors, magnetic sensors, and other suitable devices which provide an indication of a presence of external controller 822. The indication may be a monitored electrical characteristic (exemplary characteristics including voltage and resistance), a digital input, a message sent over a network, or other suitable indications for controller 800" to determine a presence of the external controller 822.

An advantage, amongst others, in one embodiment is that an external controller detection device provides a smart patient support that can detect presence of external control unit resulting in disabling of pressure monitoring of the passive mode of operation.

Figure 31:
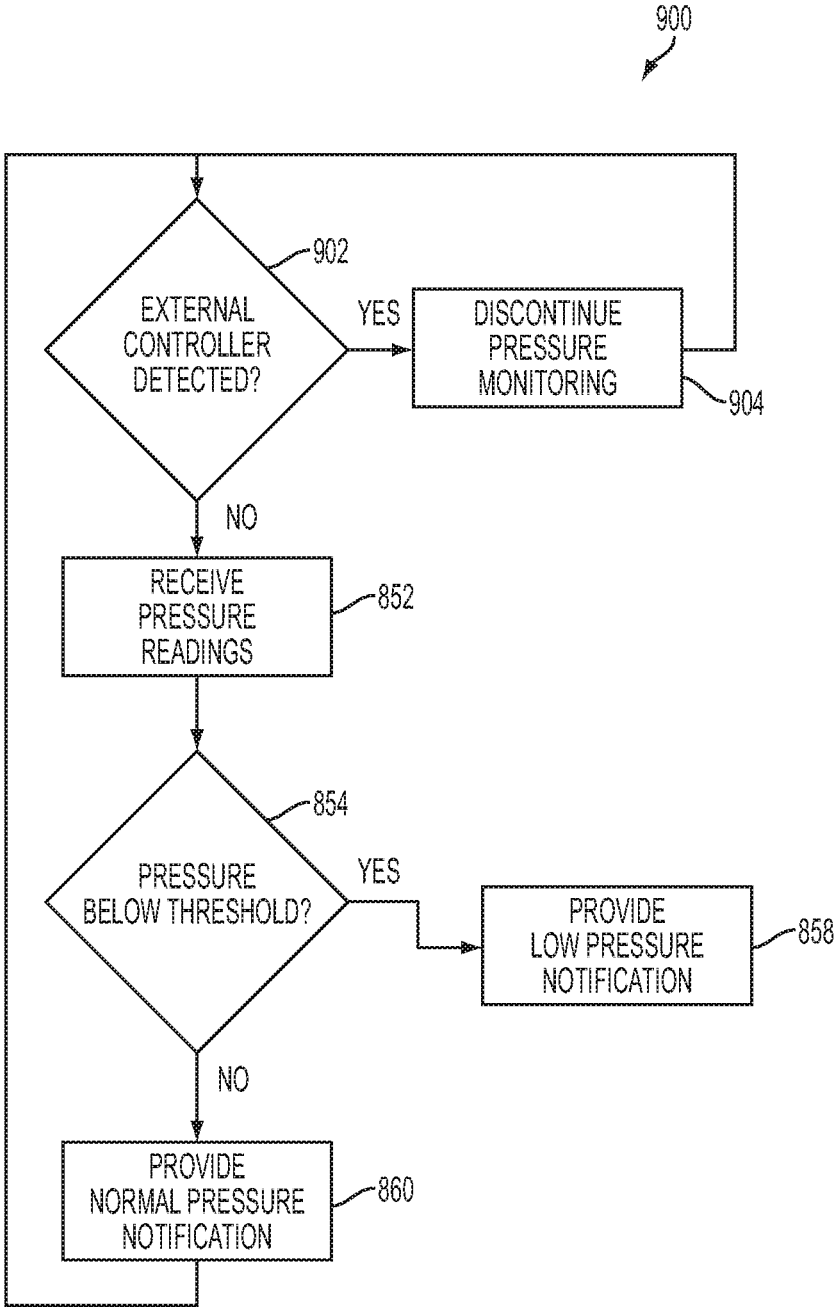
FIG. 31 illustrates an exemplary processing sequence of the controller of FIG. 27.

Referring to FIG. 31, an exemplary processing sequence 900 of external controller detection module 820 is represented. Referring to FIG. 31, controller 800" determines if external controller 822 is present, as represented by block 902. If it is determined that the external controller 822 is present then pressure monitoring module 806 is discontinued, as represented by block 904, until the external controller 822 is no longer detected. If it is determined that external controller 822 is not present then pressure monitoring module 806 is carried out and controller 800" continues to monitor for the presence of external controller 822.

Referring to FIG. 32, an exemplary external controller detection device 898 is shown, illustratively a hall effect sensor 910. An exemplary hall effect sensor is the A3212 integrated circuit available from Allegro MicroSystems, Inc. located at 115 Northeast Cutoff in Worcester, Mass. 01615-0036.

Figure 34:
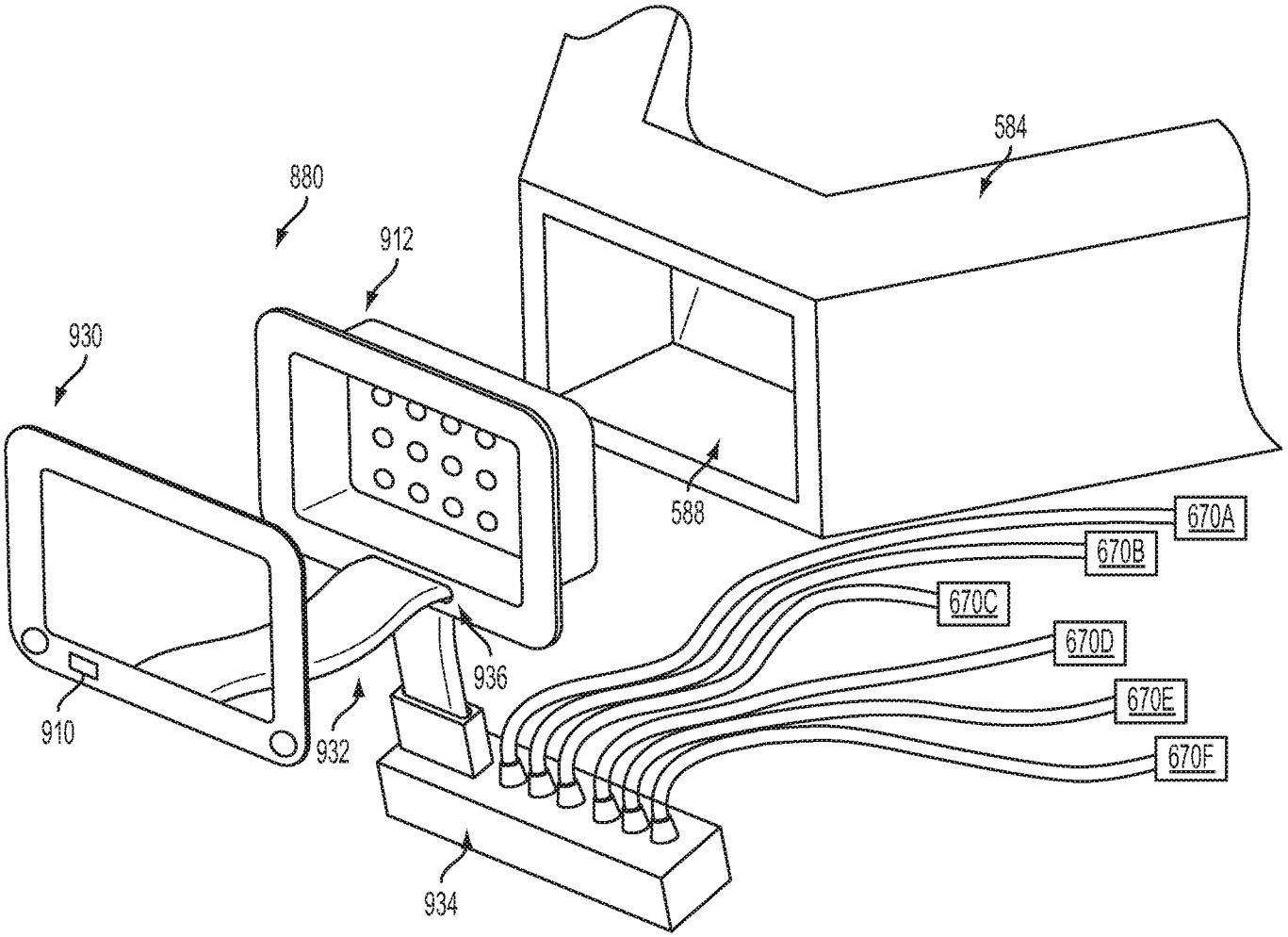
FIG. 34 illustrates an exemplary assembly of the patient support of FIG. 12 including a control module housing the controller of FIG. 27 and the interface of FIG. 32.

Referring to FIG. 34, an exploded view of user interface 102 is shown. User interface 102 includes a coupling tray 912 having a recessed area wherein a plurality of valves are located. Referring to FIG. 32, coupling tray 912 supports fill valves 668A-F, an open connection 914 connecting to conduit 742 of low air loss assembly 522, an open connection 916 connected to exhaust fluid conduit 662, open connections 918 and 920 connected to fluid conduits 682 and 684, respectively, of turning cell assembly 512, and open connections 917 and 919 connected to fluid conduits 716A and 716B, respectively, of side bolsters 712A and 712B.

Returning to FIG. 34, user interface 102 includes a front panel 930 which is mounted to coupling tray 912. A front view of front panel 930 is shown in FIG. 32. Front panel 930 includes LED 870-878, on/off switch 884, LED 886, switch 888, LED 890, and hall effect sensor 910. Front panel 930 is connected to controller 800" through a ribbon cable 932. Controller 800" is housed within a control module housing 934. As shown in FIG. 34, ribbon cable 932 is received in an opening 936 in coupling tray 912. In one embodiment, control module housing 934 is positioned inside of foam base 506 by passing control module housing 934 through openings 588 in wall member 584 of foam base 506. Coupling tray 912 is then partially inserted into openings 588 of wall member 584. Front panel 930, if not already, is coupled to coupling tray 912.

Referring to FIG. 3, fluid supply unit 40 is coupled to patient support 100 through a conduit 50. Conduit 50 includes a first coupler 942 to couple to user interface 102 and a second coupler 944 to couple to fluid supply unit 40. Conduit 50 includes a plurality of fluid conduits that connect fluid supply unit 40 to various portions of patient support 100. The connections between fluid supply unit 40 and the various portions of patient support 100 are used to selectively inflate or deflate portions of patient support 100.

Figure 35:
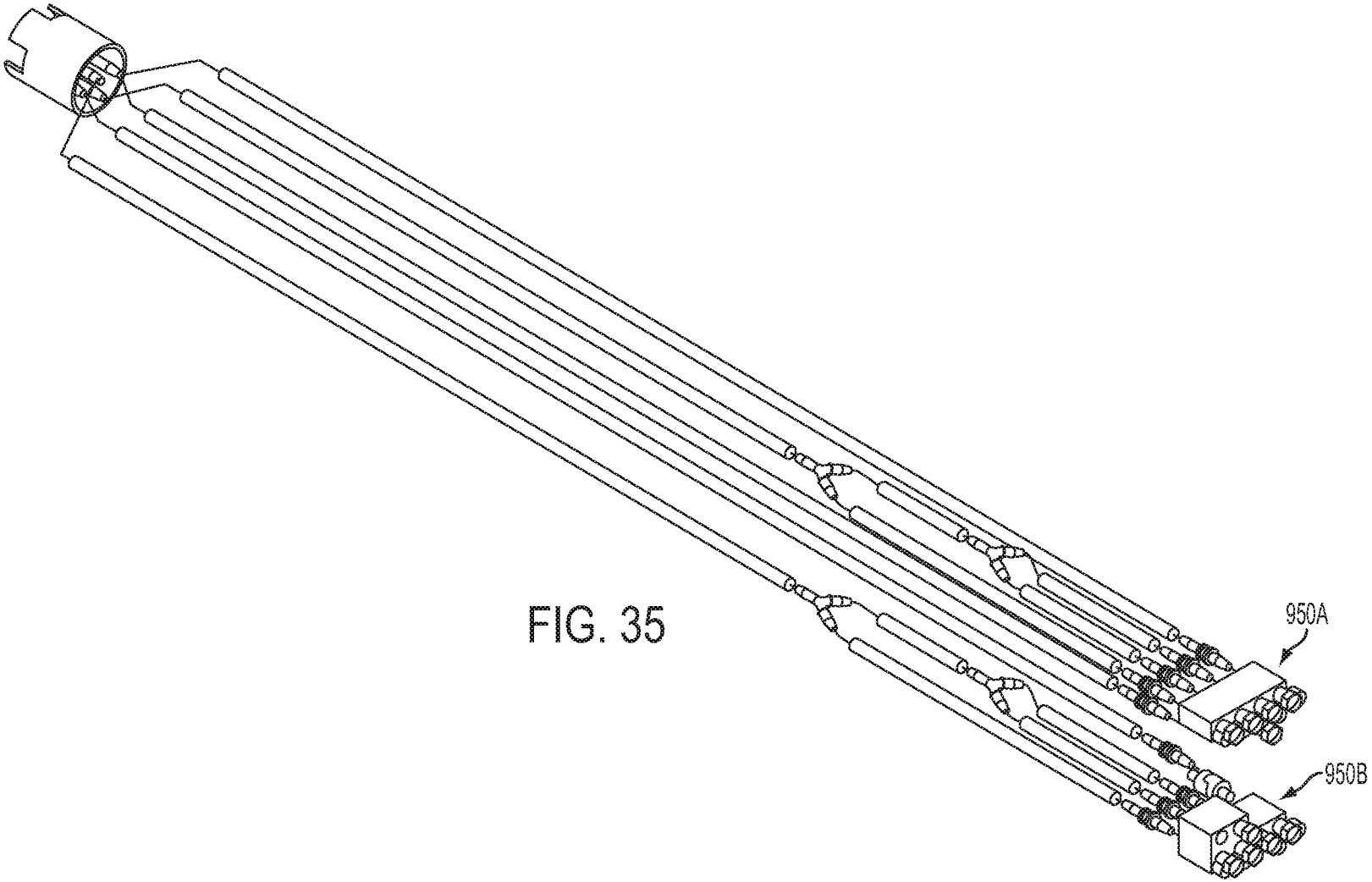
FIG. 35 illustrates an exemplary coupling device which couples the fluid supply device of FIG. 2 with the interface of FIG. 32.
Figure 36:
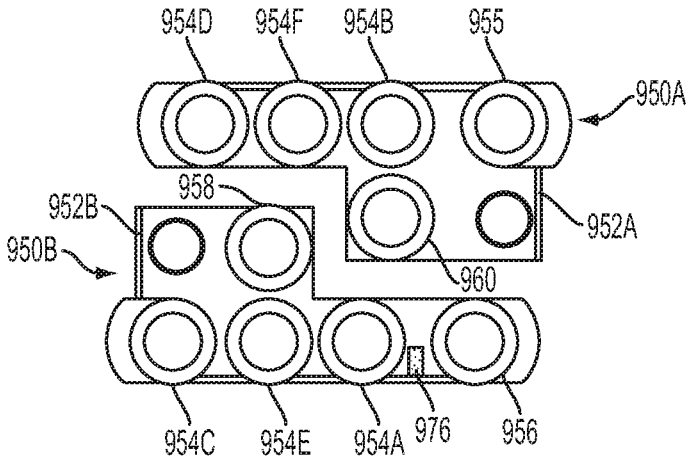
FIG. 36 is an end view of an interface end of the coupling device of FIG. 35.
Figure 37:
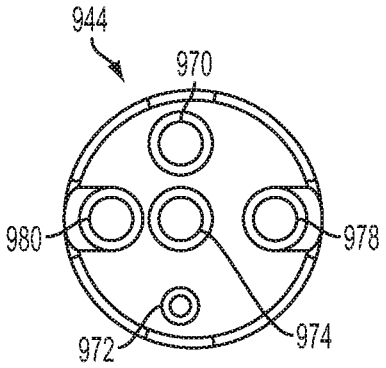
FIG. 37 is an end view of a fluid supply end of the coupling device of FIG. 35.

Referring to FIG. 35, the internal fluid conduits of conduit 50 are illustrated. Referring to FIG. 36 an end view of a pair of coupling blocks 950 of first coupler 942 is shown. Referring to FIG. 37 an end view of second coupler 944 is shown. In one embodiment, coupling blocks 950 are made of plastic. Other exemplary materials may be used.

Returning to FIG. 36 coupling block 950A and coupling block 950B include identical base members 952 which mate together. Coupling block 950A and coupling block 950B collectively support connectors 954A-F which sealingly mate with fill valve 668A-F of user interface 102 and open the fill valves 668A-F to permit fluid to pass therethrough. Coupling block 950A supports a connector 955 which sealingly mates with valve 914 of user interface 102. Coupling block 950B supports a connector 956 which sealingly mates with valve 916 of user interface 102. Coupling block 950A and coupling blocks 950 collectively support connectors 958 and 960 which sealingly mate with valves 918 and 920, respectively, of user interface 102.

As shown in FIG. 35, the fluid conduits between coupling blocks 950 and second coupler 944 are combined to reduce the number of fluid connections to fluid supply unit 40. The fluid conduits coupled to connector 954A, connector 954C, and connector 954E of coupling blocks 950 are combined to provide a single fluid connection 970 at second coupler 944. Similarly, the fluid conduits coupled to connector 954B, connector 954D, and connector 954F of coupling blocks 950 are combined to provide a single fluid connection 972 at second coupler 944. Due to the fluid connections within conduit 50, fluid supply unit 40 may provide an alternating therapy to the patient with inflatable cell assembly 510 by altering the pressure through single fluid connection 970 and single fluid connection 972. Connector 955, connector 978, and connector 980 of coupling blocks 950 each have a corresponding connection 974, 978, and 980 at second coupler 944.

In one embodiment, connector 956 is exhausted to atmosphere. In one embodiment, connector 956 is plugged such that pressure relief valves 320A-D can no longer exhaust fluid to atmosphere. This permits external controller 822 to inflate inflatable cell 400 above their present threshold pressures. Therefore, external controller 822 may have control over the pressure profile of the array of inflatable cells 400. The pressure profile may be set based on a height and weight of the patient.

Referring to FIG. 36, coupling block 950B supports a magnet 976. As coupling block 950B is inserted into user interface 102, hall effect sensor 910 of user interface 102 detects the presence of magnet 976. Controller 800" interprets the presence of magnet 976 as fluid supply unit 40 is coupled to patient support 100. Therefore, the controller of fluid supply unit 40, illustratively external controller 822, will control the operation of patient support 100.

Figure 38:
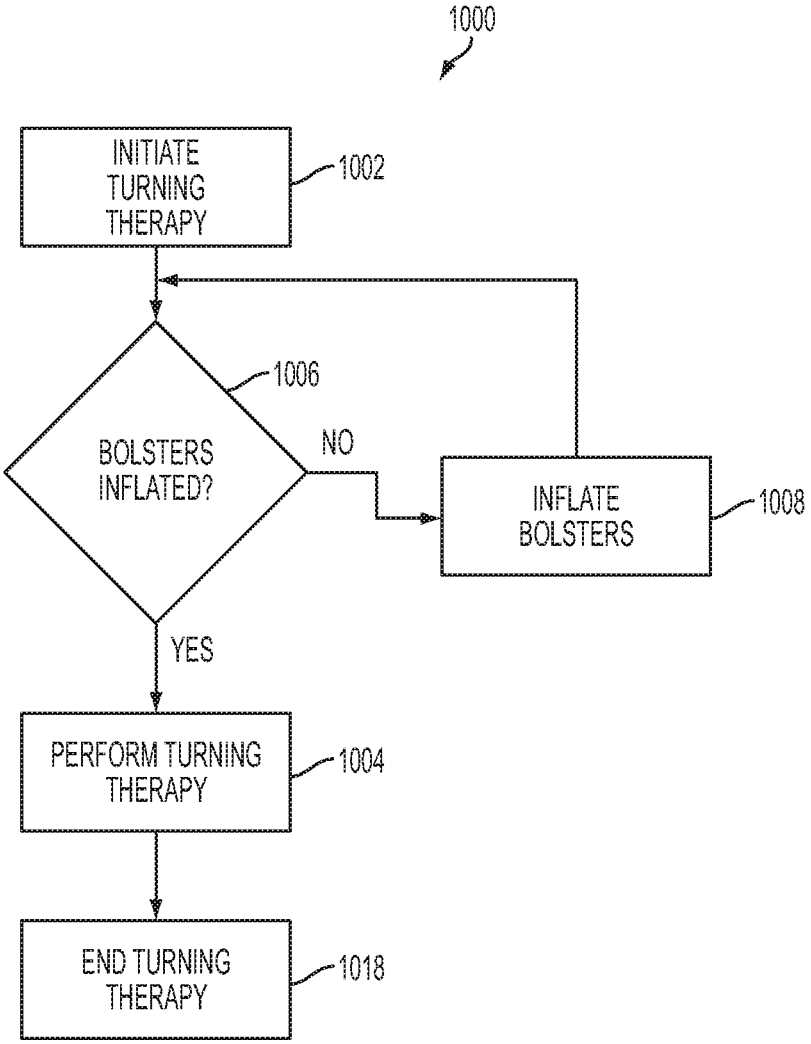
FIG. 38 illustrates an exemplary processing sequence of the controller of FIG. 26.

As mentioned herein patient support 100 includes inflatable bolsters 712. In one embodiment, external controller 822 provides a turning therapy 812 with patient support 100. Referring to FIG. 38, an exemplary processing sequence 1000 of turning therapy 812 is shown. The turning therapy is initiated, as represented by block 1002. During the turning therapy, inflatable turning cells 680 are inflated and deflated to turn a patient which is being supported by patient support 100, as generally represented by block 1004. Prior to executing the turning therapy, external controller 822 determines if inflatable bolsters 712 are inflated, as represented by block 1006. If inflatable bolsters 712 are not inflated, external controller 822 causes fluid supply unit 40 to provide fluid to ports 917, 919 on interface 102 to inflate inflatable bolsters 712, as represented by block 1008. After a given time period, the turning therapy is ended and the bolsters are deflated, as represented by block 1018.

Figure 39:
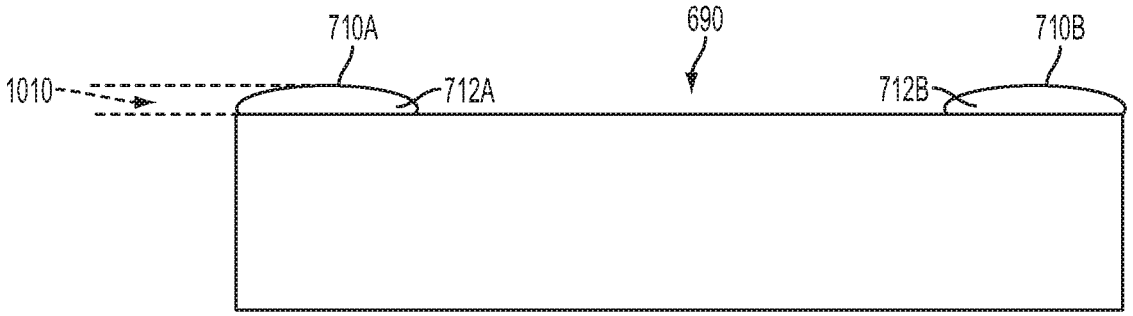
FIG. 39 illustrates the inflatable bolsters of the patient support of FIG. 12 deflated.
Figure 40:
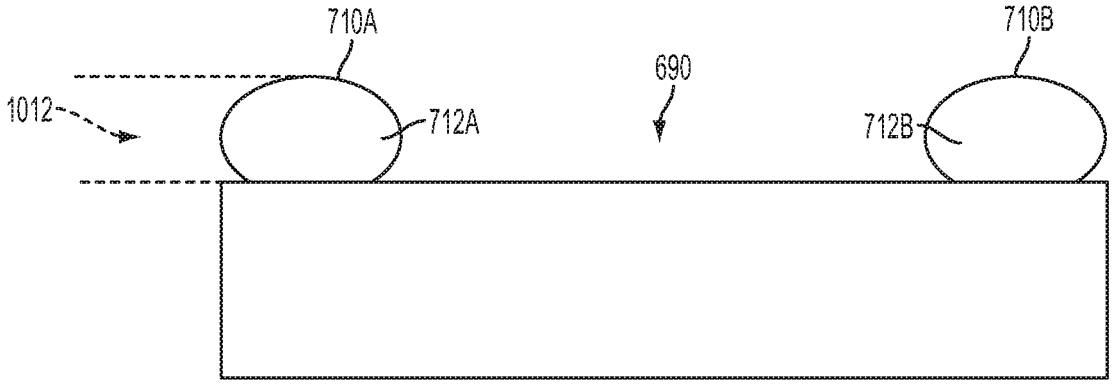
FIG. 40 illustrates the inflatable bolsters of the patient support of FIG. 12 inflated.

In one embodiment, the fluid pressure within inflatable bolsters 712 is monitored with pressure sensors to determine of inflatable bolsters 712 are inflated. In one embodiment, when inflatable bolsters 712 are deflated, inflatable bolsters 712 have a first height 1010 (see FIG. 39) above upper surface of top portion 690 and when inflatable bolsters 712 are inflated, inflatable bolsters 712 have a second height 1012 (see FIG. 40) above upper surface top portion 690.

Patient support 100 is capable of providing one or more therapies individually or in various combinations. In one embodiment, patient support 100 provides a static foam air therapy when external controller 822 is not present. In one embodiment, patient support 100 provides a static foam air therapy and a low air loss therapy by coupling a fluid supply device to connection 914 of interface 102. In one embodiment, patient support 100 provides one or more therapies under the control of external controller 822. In one example, patient support 100 provides an alternating pressure therapy. In another example, patient support 100 provides an alternating pressure therapy and a low air loss therapy. In a further example, patient support 100 provides a turning therapy. In yet a further example, patient support 100 provides a turning therapy and a low air loss therapy.

In one embodiment, during a turning therapy, the side bolsters 712 are inflated. In one embodiment, during the turning therapy, the side bolster corresponding to the side of the turning cells being inflated is inflated prior to deflation of the turning cell. This is repeated for the opposite side bolster when the patient is turned the opposite direction.

Figure 12A:
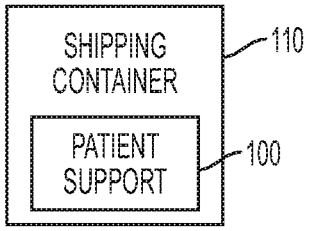
FIG. 12A illustrates a combination of a shipping container and a patient support.

In one embodiment, the inflatable cells 400 of patient support 100 are pressurized at the manufacturing site and shipped to the customer already pressurized. In this scenario, a customer may simply place patient support 100 on a bed frame 12 and the customer has an air foam patient support without the need to inflate the support. Inflatable cells 400 remain pressurized subject to any bleed off of pressure through the pressure relief valves 320A-D. In one embodiment, the patient support 100 including the inflatable cells 400 are placed in a shipping container 110 (see FIG. 12A)

prior to shipment from the manufacturing site. The shipping container 110 surrounds the patient support. Exemplary shipping containers include boxes, bags, crates, and other suitable containers to store the patient support. In one embodiment, the inflatable cells 400 of patient support 100 are not shipped to the customers in a pressurized state.

Figure 41:
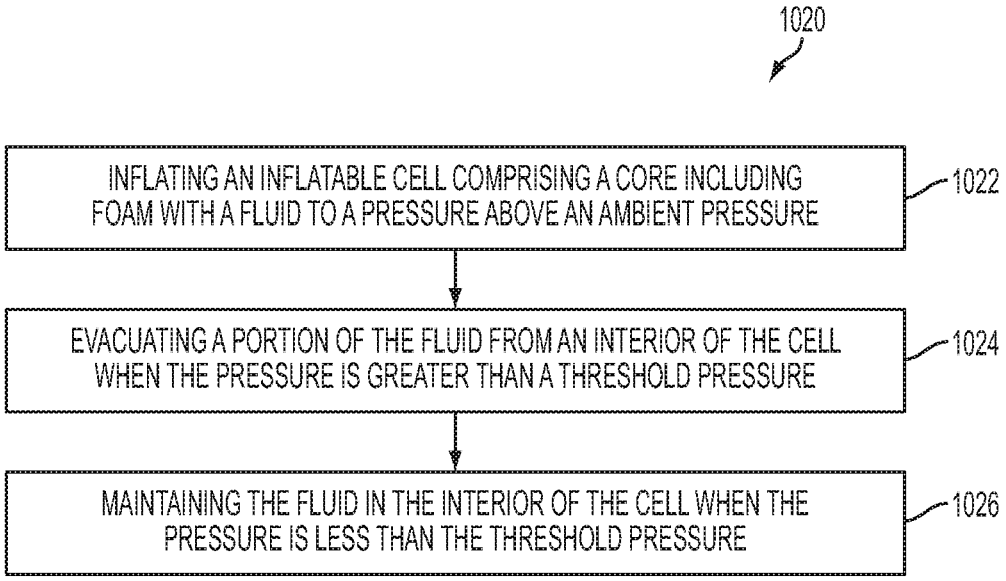
FIG. 41 illustrates an exemplary processing sequence of the controller of FIG. 27.

An exemplary method 1020 of supporting a patient is provided in FIG. 41. Referring to FIG. 41, a step of inflating an inflatable cell comprising a core including foam with a fluid to a pressure above an ambient pressure, is represented by block 1022. A step of evacuating a portion of the fluid from an interior of the cell when the pressure is greater than a threshold pressure, is represented by block 1024. A step of maintaining the fluid in the interior of the cell when the pressure is less than the threshold pressure, is represented by block 1026.

Figure 42:
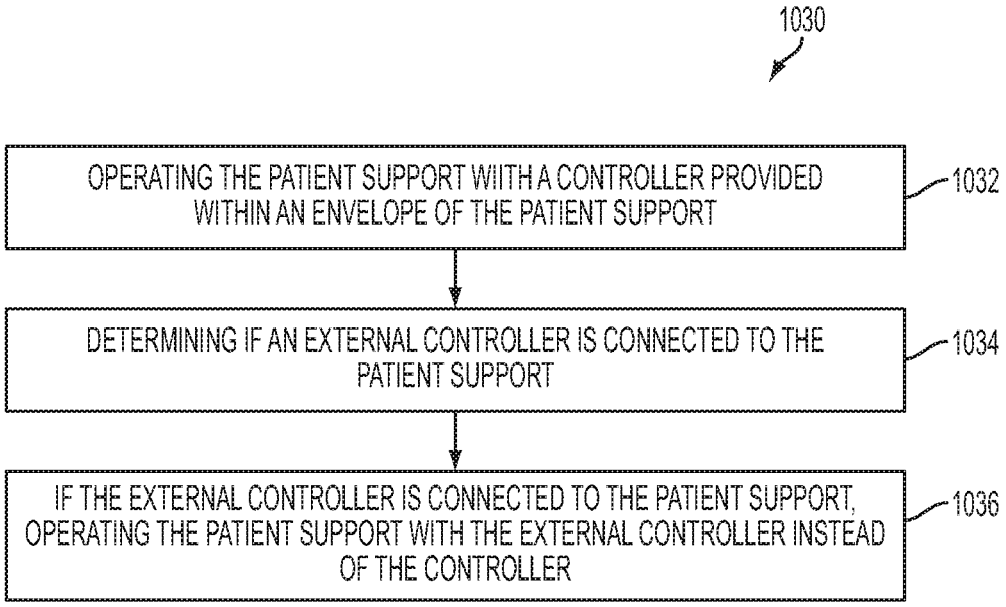
FIG. 42 illustrates an exemplary processing sequence of the controller of FIG. 27.

An exemplary method 1030 of operating a patient support is provided in FIG. 42. Referring to FIG. 42, a step of operating the patient support with a controller provided within an envelope of the patient support, is represented by block 1032. A step of determining if an external controller is connected to the patient support, is represented by block 1034. A step of if the external controller is connected to the patient support, operating the patient support with the external controller instead of the controller, is represented by block 1036.

Figure 44:
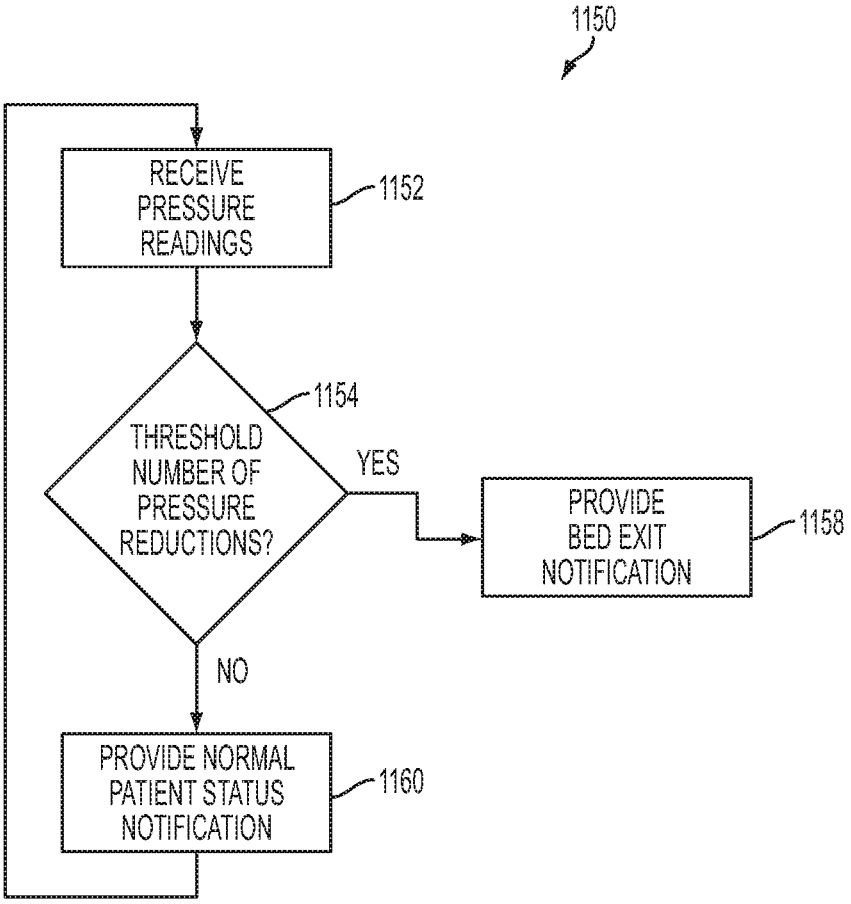
FIG. 44 illustrates an exemplary processing sequence of the controller of FIG. 27.
Figure 45:
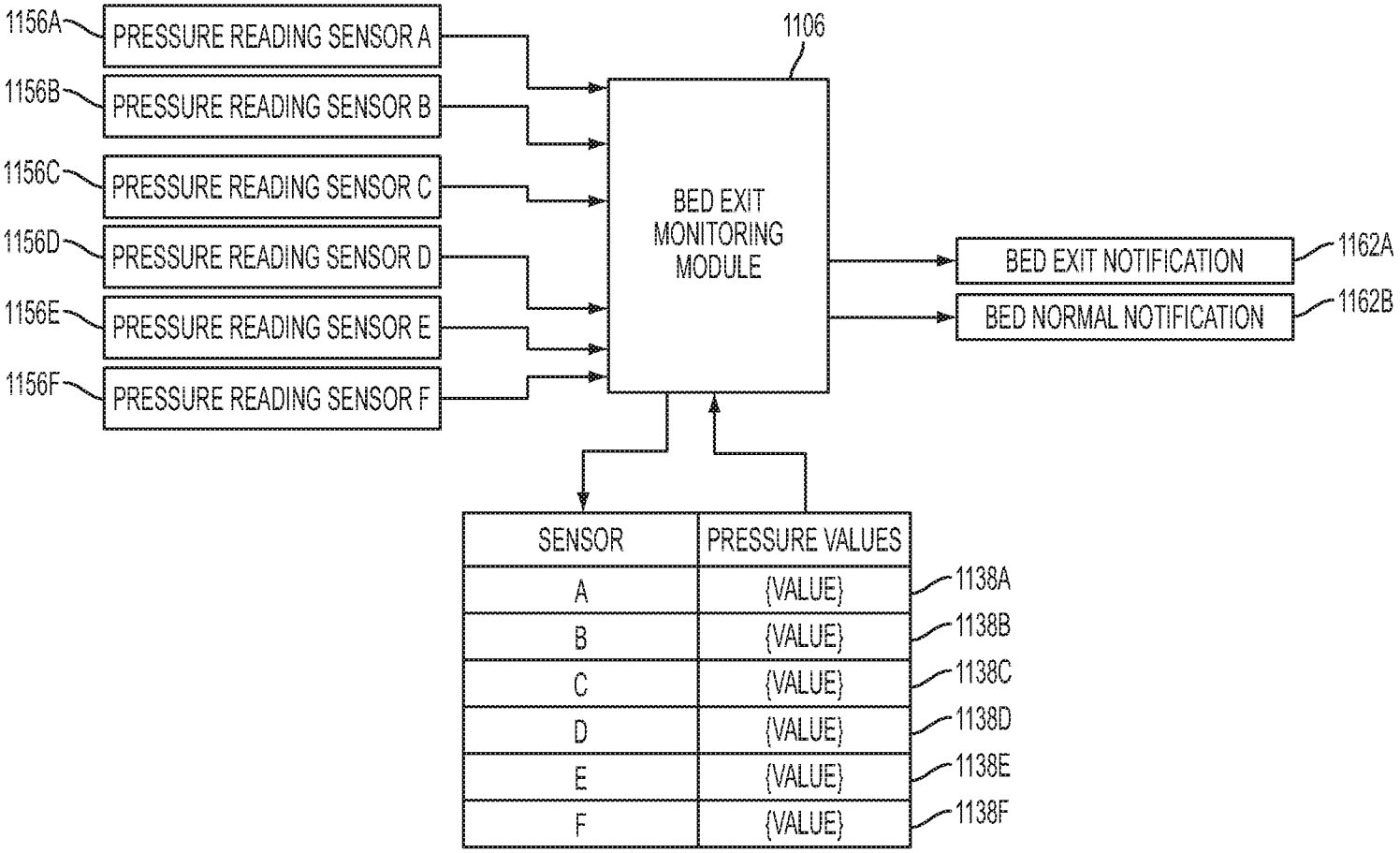
FIG. 45 illustrates an exemplary data flow of the controller of FIG. 27 executing the processing sequence of FIG. 44.

Referring to FIGS. 44 and 45, in one embodiment, controller 800" includes a bed exit monitoring module 1106. An exemplary processing sequence 1150 of bed exit monitoring module 1106 is represented in FIG. 44. Referring to FIG. 44, controller 800" receives pressure readings from pressure sensors 670A-F, as represented by block 1152. The received pressure readings are compared to a historical measure of pressure readings and a determination is made whether a threshold number of received pressure readings are below the corresponding historical measure, as represented by block 1154. If a threshold number of the received pressure readings are below their corresponding historical measures, then a patient supported on the patient support has likely exited the patient support and a bed exit notification is provided, as represented by block 1158. Otherwise, the controller 800" continues to monitor for a bed exit event. In one embodiment, a normal patient status notification is provided, as represented by block 1160.

In one embodiment, if at least two of the received pressure readings are lower than the corresponding historical measure of pressure readings then controller 800" determines that a threshold number of pressure reductions has occurred. In one embodiment, if at least one-third of the received pressure readings are lower than the corresponding historical measure of pressure readings then controller 800" determines that a threshold number of pressure reductions has occurred. In one embodiment, if at least three of the received pressure readings are lower than the corresponding historical measure of pressure readings then controller 800" determines that a threshold number of pressure reductions has occurred. In one embodiment, if at least one-half of the received pressure readings are lower than the corresponding historical measure of pressure readings then controller 800" determines that a threshold number of pressure reductions has occurred. In one embodiment, if at least four of the received pressure readings are lower than the corresponding historical measure of pressure readings then controller 800" determines that a threshold number of pressure reductions has occurred. In one embodiment, if at least two-third of the received pressure readings are lower than the corresponding historical measure of pressure readings then controller 800" determines that a threshold number of pressure reductions has occurred. In one embodiment, if at least five of the received pressure readings are lower than the corresponding historical measure of pressure readings then controller 800" determines that a threshold number of pressure reductions has occurred. In one embodiment, if at least three-quarters of the received pressure readings are lower than the corresponding historical measure of pressure readings then controller 800" determines that a threshold number of pressure reductions has occurred. In one embodiment, if all of the received pressure readings are lower than the corresponding historical measure of pressure readings then controller 800" determines that a threshold number of pressure reductions has occurred.

In one embodiment, an exemplary historical measure is the preceding pressure value. In one embodiment, an exemplary historical value is an average of at least two prior pressure values.

Referring to FIG. 45, the received pressure readings 1156 A-F correspond to pressure sensors 670A-F. Patient support 100, in the illustrated embodiment, includes six pressure sensors 670 so only six pressure readings 856 are received. Bed exit monitoring module 1106 may function with more or less pressure sensors 670. Exemplary pressure readings include a monitored electrical characteristic (exemplary characteristics including voltage and resistance), a digital input, a message sent over a network, or other suitable methods for controller 800" to determine a pressure value corresponding to the pressure sensed by one pressure sensor 670. The pressure readings 856A-F are compared to historical pressure values 1138A-F. In one embodiment, the historical values 838A-F are stored in a table accessible by controller 800". In one example, the historical values are the preceding pressure values.

Bed exit monitoring module 1106 provides a notification 1162A with one or more notification devices 866 when bed exit monitoring module determines that there has been a threshold number of pressure reductions and otherwise provides a bed normal notification 1162B. In one embodiment, buzzer 868 (see FIG. 33) is an exemplary notification device 866. Exemplary notifications include audio notifications, visual notifications, tactile notifications, or combinations thereof. Exemplary audio notifications include an audio alarm and other suitable audio cues. Exemplary audio alarms include a beeping sound. Exemplary visual alarms include lights, text displayed on a screen, graphics displayed on a screen, and other suitable visual cues. Exemplary tactile notifications include a vibration device.

While this disclosure includes particular examples, it is to be understood that the disclosure is not so limited. Numerous modifications, changes, variations, substitutions, and equivalents will occur to those skilled in the art without departing from the spirit and scope of the present disclosure upon a study of the drawings, the specification, and the following claims.

The invention claimed is:

1. A patient support, comprising:

at least one inflatable cell inflated with a fluid;

at least one pressure sensor monitoring a fluid pressure within the at least one inflatable cell;

at least one valve in fluid communication with an interior of the at least one inflatable cell to communicate fluid relative to the interior of the at least one inflatable cell;

at least one controller configured to operate the patient support in a plurality of modes of operation, the plurality of modes of operation including:

a passive mode of operation wherein the at least one controller monitors the fluid pressure of the at least one inflatable cell and does not actively cause fluid to be communicated to the interior of the at least one inflatable cell; and an active mode of operation wherein the at least one controller actively causes fluid to be communicated to the interior of the at least one inflatable cell.

2. The patient support of claim 1, wherein the at least one controller includes a first controller which monitors the fluid pressure of the at least one inflatable cell in the passive mode of operation and a second controller which actively causes fluid to be communicated to the interior of the at least one inflatable cell in the active mode of operation.

3. The patient support of claim 2 wherein the first controller is positioned within an envelope of the patient support and the second controller is positioned outside of the envelope of the patient support.

4. The patient support of claim 3, further comprising an interface including at least one fluid connection in fluid communication with the interior of the at least one inflatable cell through the at least one valve, the interface being accessible from an exterior of the patient support.

5. The patient support of claim 1, further comprising at least one low pressure notification device operatively coupled to the at least one controller, the at least one controller in the passive mode of operation causing the at least one low pressure notification device to provide a notification when the at least one controller determines that the fluid pressure of the at least one inflatable cell is below a threshold value.

6. The patient support of claim 5, wherein the notification is at least one of a visual indicator, an audio indicator, and a signal to a remote device.

7. The patient support of claim 5, wherein the at least one inflatable cell defines a plurality of zones along a longitudinal length of the patient support and the notification is a visual indicator which provides an indication of which zone of the plurality of zones has a fluid pressure below the threshold value.

8. The patient support of claim 1, wherein the at least one inflatable cell includes a first plurality of cells which are monitored in the passive mode of operation and a second plurality of cells which are not monitored in the passive mode of operation.

9. The patient support of claim 1, wherein the at least one inflatable cell includes a first plurality of cells which include a foam core within each of the cells.

10. The patient support of claim 9, wherein the at least one inflatable cell provides one of an alternating therapy during the active mode of operation and a turning therapy during the active mode of operation.

11. The patient support of claim 10, wherein the first plurality of cells provide the alternating therapy during the active mode of the operation.

12. A patient support, comprising:

at least one inflatable cell inflated with a fluid;

at least one pressure sensor monitoring a fluid pressure within the at least one inflatable cell;

at least one valve in fluid communication with an interior of the at least one inflatable cell to communicate fluid relative to the interior of the at least one inflatable cell;

at least one controller configured to operate the patient support in a plurality of modes of operation, the plurality of modes of operation including:

a passive mode of operation wherein the at least one controller monitors the fluid pressure of the at least one inflatable cell and does not actively cause fluid to be communicated to the interior of the at least one inflatable cell; and an active mode of operation wherein the at least one controller actively causes fluid to be communicated to the interior of the at least one inflatable cell;

wherein the at least one controller includes a first controller in the passive mode of operation and a second controller in the active mode of operation; and a sensor which detects a presence of the second controller, the sensor being operatively coupled to the first controller, the at least one controller operating the patient support in the passive mode of operation when the sensor indicates that the second controller is not present and the at least one controller operating the patient support in the active mode of operation when the sensor indicates that the second controller is present.

13. The patient support of claim 12, wherein the sensor is a proximity sensor.

14. A method of operating a patient support, the method comprising:

operating, by at least one controller, the patient support in a passive mode of operation, wherein the at least one controller monitors fluid pressure of at least one inflatable cell of the patient support and does not actively cause fluid to be communicated to an interior of the at least one inflatable cell; and operating, by the at least one controller, the patient support in an active mode of operation, wherein the at least one controller actively causes fluid to be communicated to the interior of the at least one inflatable cell.

* * * * *